US008710472B2

(12) United States Patent
Ishihara et al.

(10) Patent No.: US 8,710,472 B2
(45) Date of Patent: Apr. 29, 2014

(54) TARGET OUTPUT DEVICE AND EXTREME ULTRAVIOLET LIGHT SOURCE APPARATUS

(75) Inventors: Takanobu Ishihara, Hiratsuka (JP); Youichi Sasaki, Hiratsuka (JP); Kouji Kakizaki, Hiratsuka (JP); Masahiro Inoue, Itabashi (JP); Takayuki Yabu, Hiratsuka (JP); Hideo Hoshino, Hiratsuka (JP)

(73) Assignee: Gigaphoton Inc., Tochigi (JP)

( * ) Notice: Subject to any disclaimer, the term of this patent is extended or adjusted under 35 U.S.C. 154(b) by 0 days.

(21) Appl. No.: 13/192,857

(22) Filed: Jul. 28, 2011

(65) Prior Publication Data

US 2011/0284774 A1 Nov. 24, 2011

Related U.S. Application Data

(63) Continuation-in-part of application No. PCT/JP2010/058929, filed on May 26, 2010.

(30) Foreign Application Priority Data

May 27, 2009 (JP) ..... 2009-128192
Jul. 27, 2009 (JP) ..... 2009-173882
Jan. 28, 2010 (JP) ..... 2010-016659

(51) Int. Cl.
*H05G 2/00* (2006.01)

(52) U.S. Cl.
USPC ..... 250/504 R; 250/493.1

(58) Field of Classification Search
USPC ..... 250/493.1, 503.1, 504 R; 315/111.21–111.71
See application file for complete search history.

(56) References Cited

U.S. PATENT DOCUMENTS 5,991,360 A 11/1999 Matsui et al.
6,116,260 A * 9/2000 Nakagawa et al. ..... 137/14
6,377,651 B1 4/2002 Richardson et al.
6,738,452 B2 5/2004 McGregor et al.
6,867,843 B2 3/2005 Ogushi et al.
6,987,279 B2 1/2006 Hoshino et al.
7,361,918 B2 4/2008 Akins et al.

(Continued)

FOREIGN PATENT DOCUMENTS

JP 10-221499 8/1998
JP 2003-297737 10/2003

(Continued)

*Primary Examiner* — Robert Kim
*Assistant Examiner* — David E Smith
(74) *Attorney, Agent, or Firm* — McDermott Will & Emery LLP

(57) ABSTRACT

A target output device may include: a main body for storing a target material; a nozzle unit, connected to the main body, for outputting the target material as a target; an electrode unit provided so as to face the nozzle unit; a voltage control unit that applies predetermined voltage between the electrode unit and the target material to generate electrostatic force therebetween for pulling out the target material through the nozzle unit; a pressure control unit that applies predetermined pressure to the target material; and an output control unit that causes the target to be outputted through the nozzle unit by controlling signal output timing of each of a first timing signal and a second timing signal, the first timing signal causing the voltage control unit to apply the predetermined voltage between the target material and the electrode unit at first timing, and the second timing signal causing the pressure control unit to apply the predetermined pressure to the target material at second timing.

21 Claims, 62 Drawing Sheets

(56) References Cited

U.S. PATENT DOCUMENTS

| | | | | |
|---|---|---|---|---|
| 7,394,083 | B2 | 7/2008 | Bowering et al. | |
| 2004/0238762 | A1 | 12/2004 | Mizoguchi et al. | |
| 2005/0205810 | A1 | 9/2005 | Akins et al. | |
| 2006/0146103 | A1* | 7/2006 | Nakamura | 347/85 |
| 2006/0176925 | A1 | 8/2006 | Nakano | |
| 2006/0192154 | A1* | 8/2006 | Algots et al. | 250/504 R |
| 2006/0193997 | A1* | 8/2006 | Bykanov | 427/585 |
| 2007/0228301 | A1* | 10/2007 | Nakano | 250/504 R |
| 2008/0035865 | A1 | 2/2008 | Komori et al. | |
| 2008/0067456 | A1 | 3/2008 | Kloepfel et al. | |
| 2008/0083887 | A1* | 4/2008 | Komori et al. | 250/504 R |
| 2008/0197297 | A1* | 8/2008 | Akins et al. | 250/504 R |
| 2008/0258085 | A1 | 10/2008 | Bauer | |
| 2009/0230326 | A1* | 9/2009 | Vaschenko et al. | 250/492.2 |

FOREIGN PATENT DOCUMENTS

| | | |
|---|---|---|
| JP | 2004-003134 | 1/2004 |
| JP | 2004-011190 | 1/2004 |
| JP | 2004-039927 | 2/2004 |
| JP | 2005-197456 | 7/2005 |
| JP | 2006-216801 | 8/2006 |
| JP | 2007-103176 | 4/2007 |
| JP | 2007-142306 | 6/2007 |
| JP | 2008-193014 | 8/2008 |
| JP | 2008-226462 | 9/2008 |
| WO | WO01/30122 | 4/2001 |
| WO | WO03/001556 | 1/2003 |

* cited by examiner $$\frac{d^2r}{dz^2}+\frac{1}{2V(z,0)}\frac{dV(z,0)}{dz}\frac{dr}{dz}+\frac{1}{4V(z,0)}\frac{d^2V(z,0)}{dz^2}r=0$$

$$\frac{1}{f2} = \frac{1}{4\sqrt{V(z2,0)}} \int_{z1}^{z2} \frac{1}{\sqrt{V(z,0)}} \frac{d^2V(z,0)}{dz^2} dz$$

TARGET OUTPUT DEVICE AND EXTREME ULTRAVIOLET LIGHT SOURCE APPARATUS

CROSS-REFERENCE TO RELATED APPLICATIONS

This application is a continuation-in-part of International Application No. PCT/JP2010/058929 filed May 26, 2010, which claims priority from Japanese Patent Application No. 2009-128192 filed May 27, 2009, Japanese Patent Application No. 2009-173882 filed Jul. 27, 2009, and Japanese Patent Application No. 2010-016659 filed Jan. 28, 2010.

BACKGROUND

1. Technical Field

This disclosure relates to a target output device and an extreme ultraviolet light source apparatus.

2. Related Art

With recent increase in integration of semiconductor process, transfer patterns for use in photolithography of the semiconductor process have rapidly become finer. In the next generation, microfabrication at 70 to 45 nm, further, microfabrication at 32 nm or less is to be demanded. Accordingly, for example, to meet the demand for microfabrication at 32 nm or less, an exposure apparatus is expected to be developed, where EUV light of a wavelength of approximately 13 nm is combined with a reduction projection reflective optical system.

There are mainly three types of known EUV light generation apparatuses, namely, a laser produced plasma (LPP) type apparatus using plasma produced as a target material is irradiated with a laser beam, a discharge produced plasma (DPP) type apparatus using plasma produced by discharge, and a synchrotron radiation (SR) type apparatus using orbital radiation.

SUMMARY

A target output device according to one aspect of this disclosure may include: a main body for storing a target material; a nozzle unit, connected to the main body, for outputting the target material as a target; an electrode unit provided so as to face the nozzle unit; a voltage control unit that applies predetermined voltage between the electrode unit and the target material to generate electrostatic force therebetween for pulling out the target material through the nozzle unit; a pressure control unit that applies predetermined pressure to the target material; and an output control unit that causes the target to be outputted through the nozzle unit by controlling signal output timing of each of a first timing signal and a second timing signal, the first timing signal causing the voltage control unit to apply the predetermined voltage between the target material and the electrode unit at first timing, and the second timing signal causing the pressure control unit to apply the predetermined pressure to the target material at second timing.

An extreme ultraviolet light source apparatus for generating extreme ultraviolet light by irradiating a target with a laser beam according to another aspect of this disclosure may include: a chamber; a target output device for outputting the target toward a predetermined region inside the chamber, the target output device including a main body for storing a target material, a nozzle unit connected to the main body for outputting the target material as a target, an electrode unit provided so as to face the nozzle unit, a voltage control unit that applies predetermined voltage between the electrode unit and the target material to generate electrostatic force therebetween for pulling out the target material through the nozzle unit, a pressure control unit that applies predetermined pressure to the target material, and an output control unit that causes the target to be outputted through the nozzle unit by controlling signal output timing of each of a first timing signal and a second timing signal, the first timing signal causing the voltage control unit to apply the predetermined voltage between the target material and the electrode unit at first timing, and the second timing signal causing the pressure control unit to apply the predetermined pressure to the target material at second timing; and a laser source for outputting a laser beam with which the target is irradiated to generated the extreme ultraviolet light.

DESCRIPTION OF PREFERRED EMBODIMENTS

Hereinafter, selected embodiments of this disclosure will be described in detail with reference to the drawings. In the embodiments, a droplet target (hereinafter, a droplet) will be generated using electrostatic force and pressure, as will be described below. In the embodiments, with the synergy effect of the pressure applied to a target material and the attractive force caused by the electrostatic force (hereinafter, electrostatic attraction), a smaller droplet which may move faster can be generated.

First Embodiment

Figure 1:
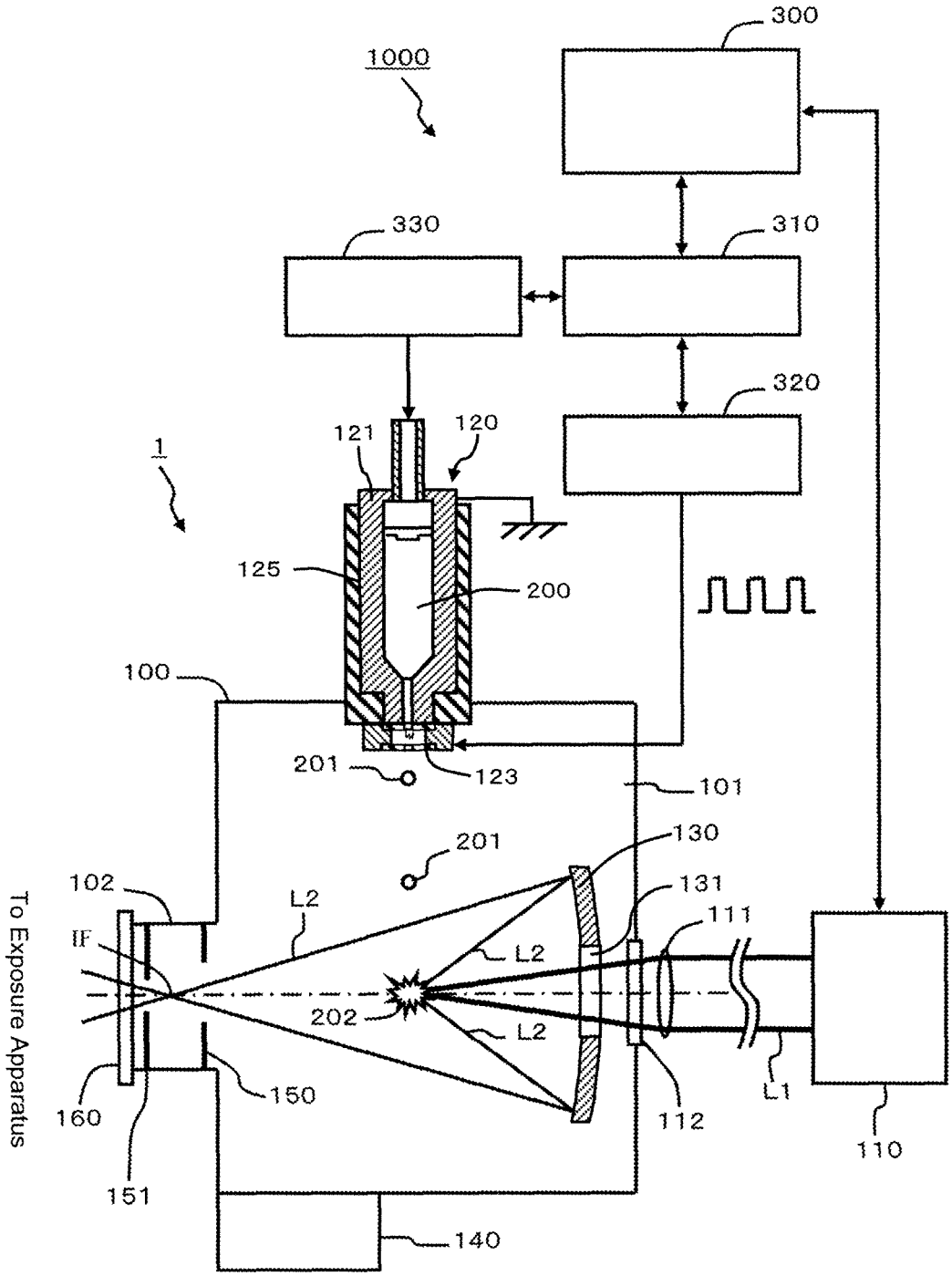
FIG. 1 illustrates the configuration of an EUV light source apparatus according a first embodiment.

A first embodiment will be described with reference to FIG. 1 through FIG. 5. FIG. 1 illustrates the general configuration of an EUV light source apparatus 1. The EUV light source apparatus 1 may comprise, for example, a chamber 100 and a driver laser source 110. The chamber 100 may further comprise a target supply unit 1000, an EUV collector mirror 130, an exhaust pump 140, partition walls 150 and 151, a gate valve 160, and an EUV light source controller 300. The target supply unit 1000 as the "target output device" may be configured of a target output unit 120, a droplet controller 310, a pulse control unit 320, and a pressure control unit 330. Each of the above constituent elements 1, 100, 110, 120, 130, 140, 150, 151, 160, 300, 310, 320, 330, and 1000 may be provided singly, and referenced herein in the singular form. A droplet 201 may be referenced in the plural form in some cases. Accordingly, in the embodiments, it may be written as droplet (s) in some cases.

The chamber 100 may be configured by connecting a first chamber 101, which is larger in volume, and a second chamber 102, which is smaller in volume. The first chamber 101 is a main chamber in which plasma generation and the like may be carried out. The second chamber 102 is a connecting chamber through which EUV light emitted from plasma may be supplied to an exposure apparatus (not shown).

The exhaust pump 140 may be connected to the first chamber 101. With this, the interior of the chamber 100 may be maintained in a low-pressure state. Another exhaust pump may be provided to the second chamber 102. In that case, it is preferable that the pressure in the first chamber 101 is kept lower than the pressure in the second chamber 102, whereby debris can be prevented from flowing into the exposure apparatus.

The target output unit 120 may output a droplet 201 formed of a target material 200, such as tin (Sn) or the like, for example, into the chamber 100. A main body 121 of the target output unit 120 may store the target material 200 in a molten state, and the interior of the main body 121 may be kept at predetermined pressure. Note that the main body 121 may be grounded via the chamber 100 and the like. Further, an electrode unit 123 may be provided to the side of the nozzle of the target output unit 120. When predetermined pulsed voltage is applied to the electrode unit 123, an electric field may be generated between the target material 200 and the electrode unit 123. With this, the droplet 201 may be outputted from the target output unit 120 into the chamber 100. The configuration of the target output unit 120 will be described in detail later with reference to FIG. 2.

The driver laser source 110 may output a pulsed laser beam L1 for turning a droplet 201 into plasma. The driver laser source 110 may, for example be configured as a $CO_2$ (carbon dioxide gas) pulse laser source. The driver laser source 110 may output a laser beam L1 with the following specifications: the wavelength of 10.6 μm, the output of 20 kW, the pulse repetition rate of 30 to 100 kHz, and the pulse width of 20 nsec. The specifications, however, are not limited to the above example. Further, a laser source other than the CO2 pulse laser source may be used.

The laser beam L1 outputted from the driver laser source 110 may enter the first chamber 101 via a focusing lens 111 and an input window 112. The laser beam L1 having entered the first chamber 101 passes through an input hole 131 provided in the EUV collector mirror 130 and strike the droplet 201.

When the laser beam L1 strikes the droplet 201, the tin droplet 201 may be turned into plasma in a plasma generation region 202. The plasma may emit EUV light L2 with the central wavelength of 13.5 nm.

The EUV light L2 emitted from the plasma may be incident on the EUV collector mirror 130 and then reflected by the EUV collector mirror 130. This EUV collector mirror 130 may have a spheroidal reflective surface; however, the configuration is not limited thereto as long as the EUV collector mirror 130 can focus the EUV light. The EUV light L2 reflected by the EUV collector mirror 130 may be focused at an intermediate focus (IF) inside the second chamber 102. The EUV light L2 focused at the IF may be guided into the exposure apparatus via a gate valve 160 in an open state.

In this embodiment, as will be described later, the frequency at which the laser beam is outputted from the driver laser source 110 may be in synchronization with the timing at which the droplet 201 is generated in an amount necessary for generating the EUV light. Accordingly, the amount of debris generated may be small. However, in order to reduce an influence of the debris, for example, two coils (not shown) for generating a magnetic field may be provided such that the two coils face each other across an optical path of the EUV light L2 in the vertical direction in or a direction perpendicular to the paper surface of FIG. 1. The ionic debris can be trapped in the magnetic flux generated by the magnetic field generation coils.

The two partition walls 150 and 151 may be disposed with the IF therebetween. When defined with respect to the traveling direction of the EUV light L2 reflected by the EUV collector mirror 130, the first partition wall 150 may be provided upstream of the IF. The second partition wall 151 may be provided downstream of the IF. Each of the partition walls 150 and 151 may have a through-hole in the order of a few millimeters to 10 millimeters, for example.

The first partition wall 150 may preferably be provided near a connection between the first chamber 101 and the second chamber 102. The second partition wall 151 may preferably be provided near a connection between the second chamber 102 and the exposure apparatus.

In other words, The IF may preferably set to be positioned inside the second chamber 102. The partition walls 150 and 151 may preferably be disposed the IF therebetween. Note that a spectral purity filter (SPF) may be provided either upstream or downstream of the IF, or at both sides thereof to block light with wavelengths of other than 13.5 nm.

Control configurations 300 through 330 of the EUV light source apparatus 1 will be described next. The EUV light source controller 300 may control the operation of the EUV light source apparatus 1. The EUV light source controller 300 may give instructions to the droplet controller 310 and the driver laser source 110, respectively. With the instructions, the droplet 201 may be outputted at predetermined timing. The outputted droplet 201 may be irradiated with the pulsed laser beam L1. The EUV light source controller 300 may further control the operation of the exhaust pump 140, the gate valve 160, and so forth.

The droplet controller 310 may control the operation of the target output unit 120. Connected to the droplet controller 310 are the pulse control unit 320 and the pressure control unit 330.

The pulse control unit 320 may apply predetermined pulsed voltage to the electrode unit 123 provided to the leading end side of the target output unit 120. The pulse control unit 320 may preferably include, for example, a single high-voltage direct-current power supply device, a single switching driver for outputting direct-current high voltage inputted from the high-voltage direct-current power supply device in pulses, and a single pulse generator for inputting pulse frequency into the switching driver (none is shown in the figure).

The pressure control unit 330 may apply predetermined pressure in the main body 121 of the target output unit 120. The interior of the main body 121 may be pressurized at predetermined pressure with an inert gas (for example, argon gas) supplied from the pressure control unit 330.

Figure 2:
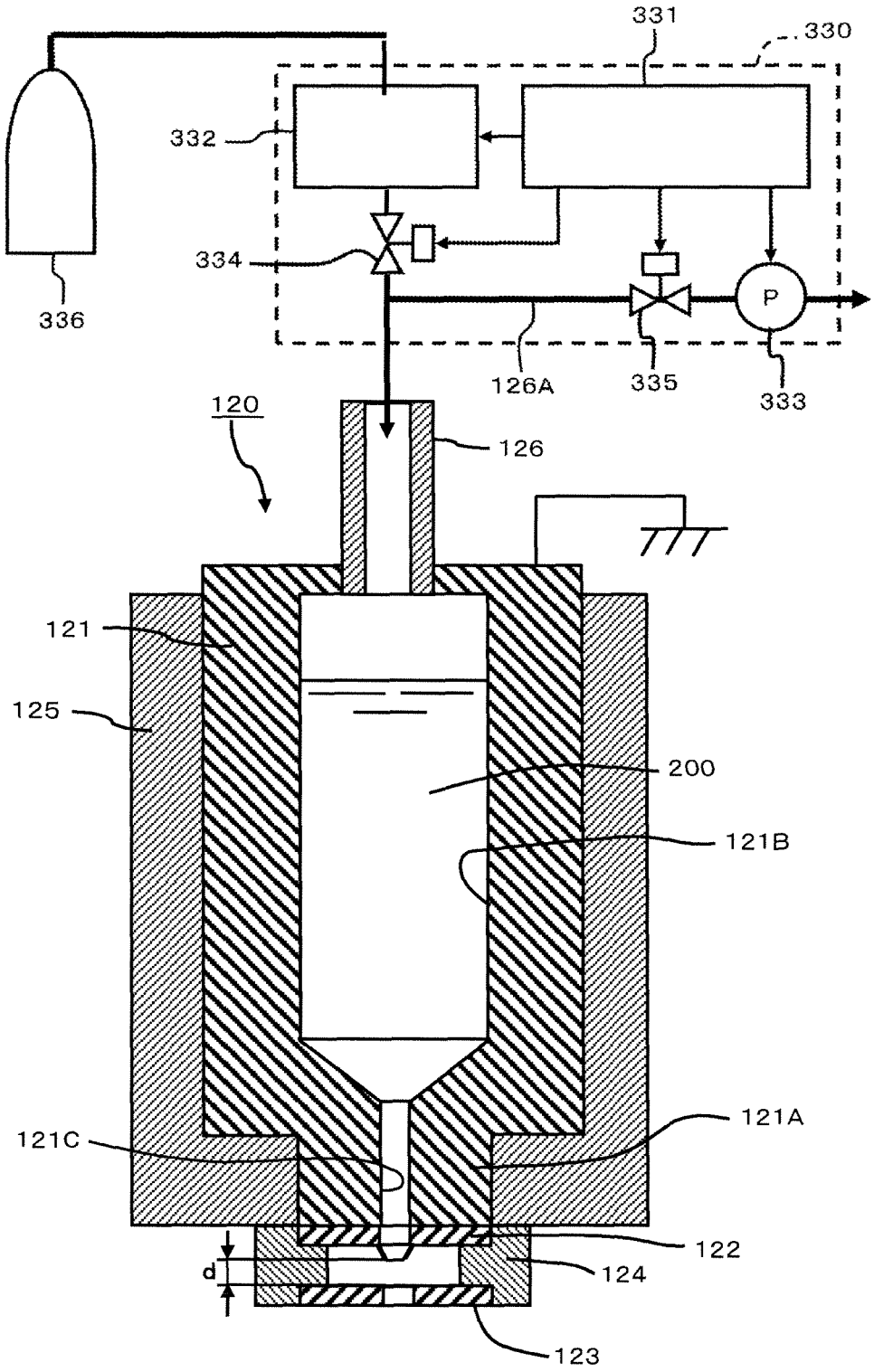
FIG. 2 illustrates a target output unit in enlargement.

FIG. 2 illustrates the configurations of the target output unit 120 and the pressure control unit 330. The configuration of the target output unit 120 will be described first. The target output unit 120 may include, for example, the main body 121, the nozzle unit 122, the electrode unit 123, an insulator 124, and a heating unit 125.

The main body 121 may store the target material 200. The main body 121 may be provided to the chamber 100 such that a leading end portion 121A thereof (lower side in FIG. 2) projects into the first chamber 101. Inside the main body 121, a container 121B may be provided for storing the target material 200. An output flow path 121C may be provided inside the leading end portion 121A.

The container 121B may be connected to the pressure control unit 330 via piping 126 connected to a base end side (upper side in FIG. 2) of the main body 121. The output flow path 121C may allow communication between the interior of the container 121B and the nozzle unit 122. The gas provided through the pressure control unit 330 may be supplied into the container 121B of the main body 121 via the piping 126.

Further, the heating unit 125 may be provided on an outer surface of the main body 121. The heading unit 125 may preferably be configured of an electrothermal heater or the like, for example. The heating unit 125 may heat the main body 121 so that tin inside the main body 121 is approximately at 300° C. Note that the value 300° C. is merely an example, and this disclosure is not limited to that value. That is, any temperature at which the target material 200 is liquid is acceptable.

Figure 3:
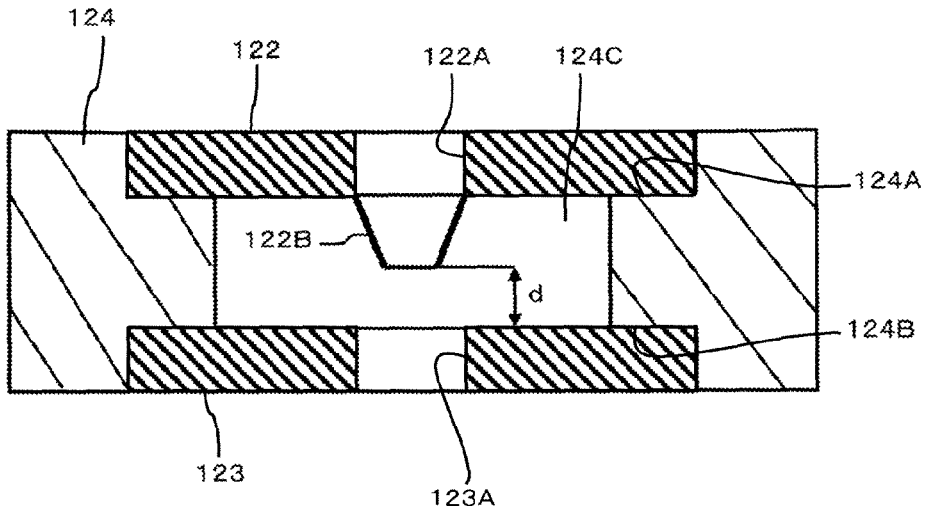
FIG. 3 illustrates a nozzle unit in enlargement.

FIG. 3 illustrates the nozzle unit 122 and the vicinity thereof in enlargement. The nozzle unit 122 may, for example, formed into a disc shape, and a circular output hole 122A may preferably be formed in the center thereof. The output hole 122A and the container 121B of the main body 121 may be in communication with each other. Further, a nozzle 122B is provided at the lower end of the output hole 122A so as to project toward the plasma generation region 202, the nozzle 122B being formed into a downwardly converging frusto-conical shape. The range of volumes of subsequently generated droplet(s) may be regulated by controlling the size of the opening in the nozzle 122B. The reason for the nozzle 122B being formed so as to project toward the plasma generation region 202 may be that this configuration allows the electric field to be enhanced at the target material in the leading end of the nozzle 122B.

Material for the nozzle unit 122 will be described next. Since the nozzle unit 122 comes into contact with tin serving as the target material, material that is insusceptible to corrosion/erosion by tin may be preferable. A property of being insusceptible to corrosion/erosion by tin is herein referred to as "corrosion/erosion resistance" to tin. As materials having the corrosion/erosion resistance to tin, molybdenum (Mo), tungsten (W), tantalum (Ta), titanium (Ti), stainless steel, diamond, ceramics, and the like can be cited, for example.

In addition, in order to cause the electric field to be enhanced at the target material 200 inside the nozzle unit 122, the nozzle unit 122 may preferably have an electrical insulating property. Of the above-mentioned materials that have the corrosion/erosion resistance to tin, diamond or ceramics is known as a material having the insulating property. Accordingly, it is preferable that the nozzle unit 122 is configured of diamond or ceramics. However, a nozzle unit configured of a material other than diamond or ceramics is included within the scope of this disclosure.

The main body 121 may preferably have the corrosion/erosion resistance to tin. Of the entirety of the main body 121, at least part that comes into contact with tin may preferably have the corrosion/erosion resistance to tin. Further, in order to ground the main body 121, the main body 121 may preferably have electrical conductivity. Accordingly, the main body 121 may preferably be configured of molybdenum, tungsten, tantalum, titanium, stainless steel, and the like.

The disc-shaped electrode unit 123 may preferably provided to a discharge side of the nozzle unit 122 with a space provided therebetween. It is preferable that an output hole 123A of the electrode unit 123 and the nozzle 122B are positioned coaxially. A predetermined gap d may be formed between the output hole 123A and a tip of the nozzle 122B. The way how the gap d is set will be described later with reference to FIG. 4.

Material for the electrode unit 123 will be described next. Since the electrode unit 123 may come into contact with tin, it preferably has the corrosion/erosion resistance to tin. In addition, the electrode unit 123 preferably has high resistance to sputtering. This is because a high-speed tin particle from the plasma 202 may strike a surface of the electrode unit 123. Furthermore, the electrode unit 123 preferably has electrical conductivity. The three conditions mentioned above being considered, the electrode unit 123 may preferably be formed, for example, of molybdenum, tungsten, tantalum, titanium, stainless steel, and the like.

The insulator 124 may preferably be provided between the nozzle unit 122 and the electrode unit 123. The insulator 124 may preferably be provided with a nozzle mount 124A and an electrode mount 124B. A space 124C may be formed on the inner circumferential side of the insulator 124. The nozzle 122B may be provided so as to project into the space 124C.

The nozzle mount 124A may preferably be formed as an annular step portion, for example. The nozzle unit 122 may be mounted to the nozzle mount 124A. The electrode mount 124B may also be preferably formed as an annular step portion, for example. The electrode unit 123 may be mounted to the electrode mount 124B.

The nozzle mount 124A and the electrode mount 124B may preferably be positioned coaxially. The nozzle mount 124A may preferably position the nozzle unit 122, and the electrode mount 124B may preferably position the electrode unit 123. With this, the axis of the nozzle 122B of the nozzle unit 122 and the axis of the output hole 123A of the electrode unit 123 may be made to coincide with each other.

The insulator 124 may realize an insulating function and a heat-transfer function besides the above-mentioned positioning function. With the insulating function, electrical insulation may be provided between the nozzle unit 122 and the electrode unit 123. With the heat-transfer function, heat generated at the heating unit 125 may be conducted to the electrode unit 123. With this, temperatures of the nozzle unit 122 and of the electrode unit 123 may be made higher than the melting point of tin, whereby tin should be prevented from being fixed onto the nozzle unit 122 and the electrode unit 123.

Materials for the insulator 124 will be described next. The insulating function and the heat-transfer function which the insulator 124 should preferably have being considered, the insulator 124 may preferably configured of a material with excellent insulation and high thermal conductivity. Accordingly, the insulator 124 may be configured of a material such as aluminum nitride (AlN), diamond or the like, for example.

Figure 4:
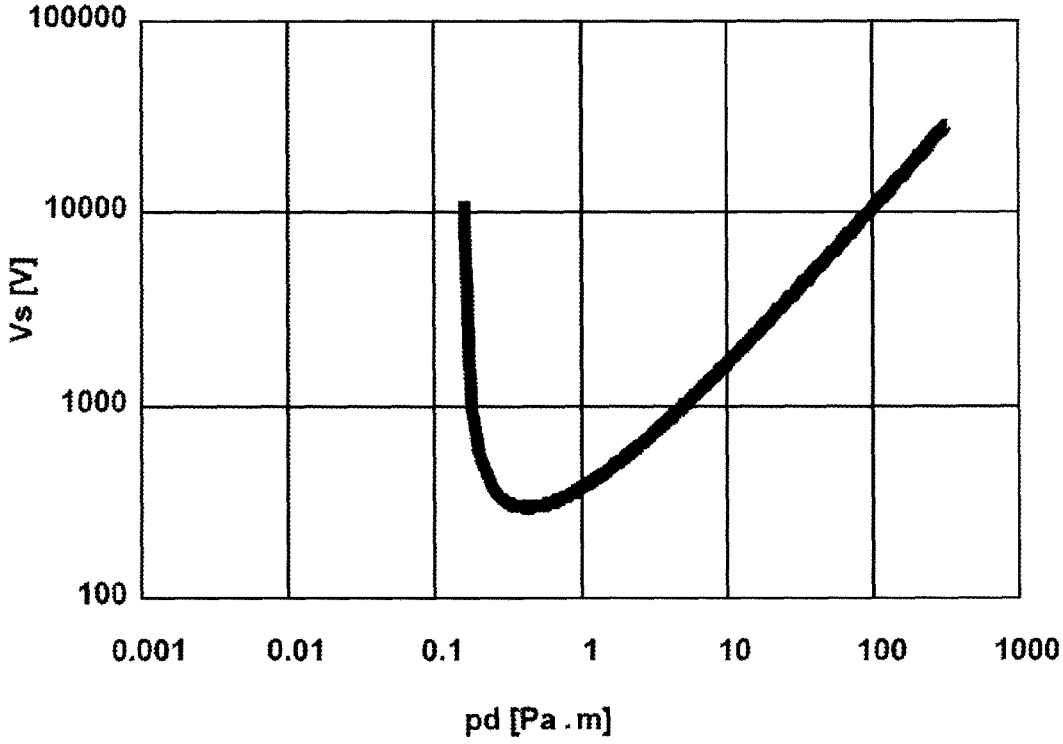
FIG. 4 shows a change in breakdown voltage in accordance with a relationship between gas pressure and a gap between electrodes.

FIG. 4 is a diagram for explaining Paschen's Law. The horizontal axis in FIG. 4 represents a product pd of the pressure p (Pa) inside the space 124C and the gap d (m), and the vertical axis in FIG. 4 represents a sparking voltage Vs (V). As the number of gaseous molecules inside the space 124C decreases, collisions between the electrons and the gaseous molecules may become less frequent, whereby electric discharge may become less likely to occur. On the contrary, as the number of gaseous molecules inside the space 124C increases, velocity of molecules cannot be increased; therefore, electric discharge is less likely to occur. Accordingly, as shown in FIG. 4, electric discharge is most likely to occur when the product of the pressure and the gap d is at a predetermined value. Once electric discharge occurs, the voltage between the nozzle unit 122 and the electrode unit 123 cannot be retained. As in this embodiment, it is preferable that the pressure p inside the first chamber 101 and the size of the gap d may be set such that breakdown voltage of not less than 10 kV/mm can be obtained, whereby the voltage between the nozzle unit 122 and the electrode unit 123 can be retained.

In particular, since the pressure p inside a chamber used for an EUV light source apparatus may be low (approximately $10^{-3}$ Pa), the value of pd may become small, and even with a small gap d, high voltage can be applied thereto. Even if the pressure is not low, a range in which the sparking voltage can be suppressed may be selected by reducing the value of pd. The voltage may be applied to make the force due to electrostatic attraction act on the nozzle unit, whereby the droplet can be formed.

Returning to FIG. 2, the configuration of the pressure control unit 330 will be described. The pressure control unit 330 may preferably include, for example, a pressure controller 331, a pressure adjusting valve 332, an exhaust pump 333, a supply valve 334, and an exhaust valve 335. The pressure control unit 330 may preferably supply a gas from a gas supply 336 into the main body 121 of the target output unit 120 via the pressure adjusting valve 332 or the like. Note that as a gas for pressurizing the target material 200, argon gas is used in this embodiment. However, any inert gas other than argon gas can also be used.

The pressure adjusting valve 332 may adjust the pressure of the gas flowing in from the gas supply 336 to predetermined pressure set by the pressure controller 331, and send the gas into the piping 126. The gas of which pressure is adjusted to the predetermined pressure may be supplied into the main body 121 via the supply valve 334 provided midway in the piping 126.

The exhaust pump 333 may allow the gas inside the main body 121 to be discharged. The exhaust pump 333 may preferably be actuated in a state where the supply valve 334 is closed and the exhaust valve 335 provided midway in an exhaust path 126A is opened. With this, the gas inside the main body 121 will be discharged.

Figure 5A:
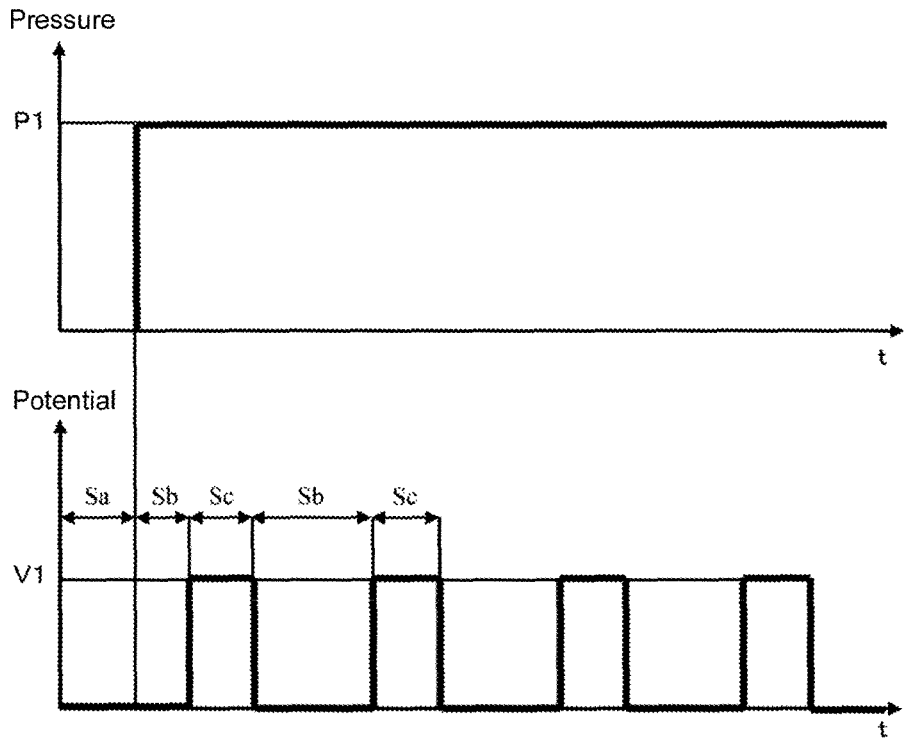
FIG. 5A is a descriptive diagram showing a relationship between pulsed voltage and pressure.

FIG. 5A illustrates a relationship between pressure applied to the target material 200 inside the main body 121 and pulsed voltage applied to the electrode unit 123. As shown in FIG. 5A, constant pressure P1 may be applied to the target material 200. Pulses with a potential V1 may be applied to the electrode unit 123 at predetermined frequency. The predetermined frequency may be set to coincide with the frequency of the laser beam L1 outputted from the driver laser source 110. Alternatively, the frequency of the laser beam L1 may be set to coincide with the predetermined frequency at which the potential V1 is applied to the electrode unit 123. The pulse shape of the potential V1 may be rectangular, triangular, or sinusoidal, as required.

Figure 5B:
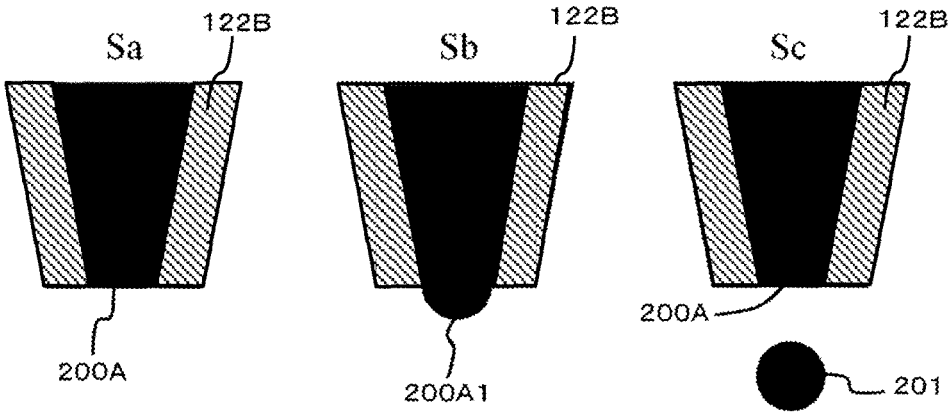
FIG. 5B shows changes in a meniscus.

FIG. 5B schematically illustrates states of the nozzle 122B. The description will be given with reference to FIGS. 5A and 5B. In an initial state (Sa), the target material 200 inside the main body 121 is not pressurized by the gas, and the pulsed potential is not applied to the electrode unit 123. In the initial state (Sa), a liquid surface 200A at the tip of the nozzle may generally be flat.

In a state (Sb) where the target material 200 is pressurized by the gas but the pulsed potential is not applied to the electrode unit 123, the liquid surface 200A1 somewhat may project outwardly from the tip of the nozzle. That is, a downwardly projecting meniscus may be formed. The volume of the projecting portion of the meniscus formed at this point may be regulated in accordance with the opening size of the nozzle 122B and the pressure of the gas applied to the target material 200. That is, it may be possible to modify the volume of the droplet subsequently formed by properly selecting the opening size of the nozzle 122B.

In a state (Sc) where the target material 200 is pressurized by the gas and the pulsed potential is applied to the electrode unit 123, the meniscus that has projected downwardly may be cut off at the tip of the nozzle by electrostatic attraction and outputted as the droplet 201. At this time, the electrostatic attraction force can be regulated by controlling the value of the pulsed potential. That is, the volume of the outputted droplet can be regulated by controlling the value of the pulsed voltage.

According to this embodiment configured in this way, the droplet 201 can be outputted through the nozzle 122B by applying the pulsed potential to the electrode unit 123 provided so as to face the nozzle 122B, in a state where the target material 200 inside the main body 121 is pressurized by the gas. Accordingly, in this embodiment, the droplet 201 of a necessary size can be generated at necessary timing. Further, since the droplet 201 pulled out due to the electrostatic attraction may be electrically charged, the droplet 201 can be accelerated using an electric field.

In this embodiment, the electrostatic attraction force may be generated in a state where the target material 200 has been pressurized. Accordingly, the droplet 201 of a relatively small size (for example, 10 to 30 μm in diameter) can be outputted at relatively high speed. Thus, it is possible to consume the target material 200 efficiently, and running cost of the extreme ultraviolet light source apparatus 1 may be reduced.

In this embodiment, the frequency at which the droplet 201 is generated may be controlled by controlling the frequency of the pulsed potential. Accordingly, in this embodiment, the frequency at which the droplet 201 is generated can be synchronized with the frequency of the driver laser beam L1. This is expected to prevent unnecessary droplet(s) from being generated. With this, the tin use efficiency is likely to increase.

In this embodiment, high-speed droplet(s) 201 can be obtained. Accordingly, a distance between the droplets 201 can be set such that a droplet 201 may not be affected by debris from plasma generated as an immediately preceding droplet 201 is irradiated with a laser.

In this embodiment, it is possible to deliver the high-speed droplet 201 precisely to a desired position where the laser beam L1 may strike the droplet 201.

In this embodiment, the main body 121 may be grounded, and a positive or negative pulsed potential may be applied to the electrode unit 123 facing the nozzle 122B. That is, in this embodiment, the side that outputs the droplet(s) 201 may be grounded, and the periphery of the outputted droplet 201 may charged either positively or negatively.

In this embodiment, the main body 121 and the chamber 100 may be grounded, and it is sufficient that only the electrode unit 123 is electrically insulated. Accordingly, the configuration of the EUV light source apparatus 1 can be simplified.

Second Embodiment

Hereinafter, a second embodiment will be described with reference to FIG. 6 and FIG. 7. Each of the embodiments described below may serve as a modification of the first embodiment. Thus, points that differ from the first embodiment will primarily be described. In the second embodiment, the pressure may be applied to the target material 200 into pulses. In this embodiment, under a state where bias pressure P2 is applied to the target material 200, the pressure may be applied to the target material 200 in pulses. Further, while a bias potential is applied to the electrode unit 123, a pulsed potential may be applied thereto.

Figure 6:
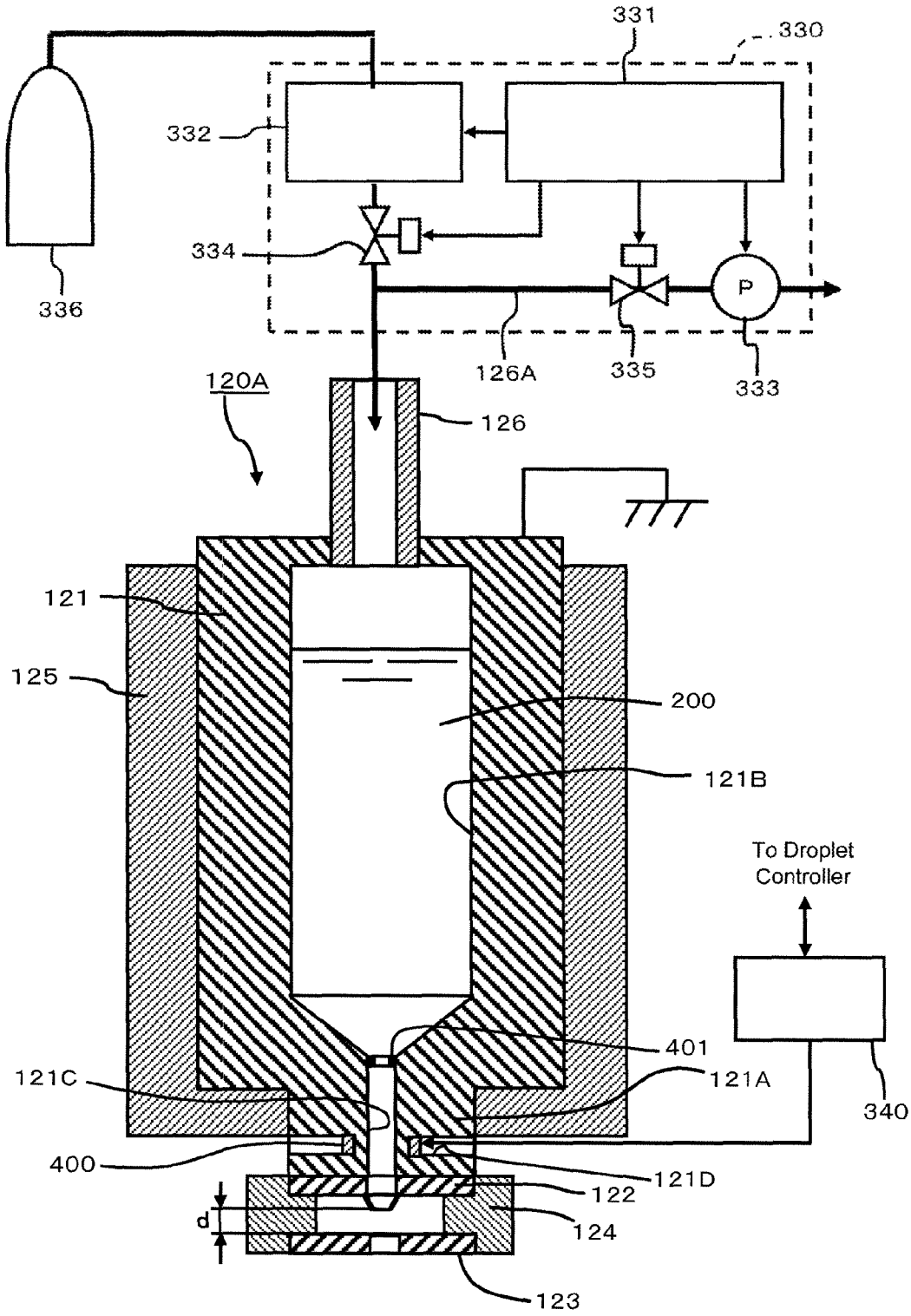
FIG. 6 illustrates a target output unit according to a second embodiment.

FIG. 6 illustrates a target output unit 120A according to this embodiment. In this embodiment, a piezoelectric element 400 that deforms in accordance with a pulsed potential applied thereto may be provided at a leading end portion 121A of the main body 121.

Amount groove 121D may be provided to part of the leading end portion 121A. The piezoelectric element 400 may be mounted in the mount groove 121D. The piezoelectric element 400 may deform in accordance with the pulsed potential inputted from a second pulse control unit 340. The second pulse control unit 340 may control the piezoelectric element 400, and operate in accordance with an instruction from the droplet controller 310. When the piezoelectric element 400 deforms, the volume inside the output flow path 121C may decrease, whereby the pressure on the target material 200 inside the leading end portion 121A may rise.

An orifice 401 may be provided at a seam between the container 121E and the output flow path 1210. The orifice 401 may prevent the target material 200 inside the leading end portion 121A from being pushed back into the container 121B.

Figure 7:
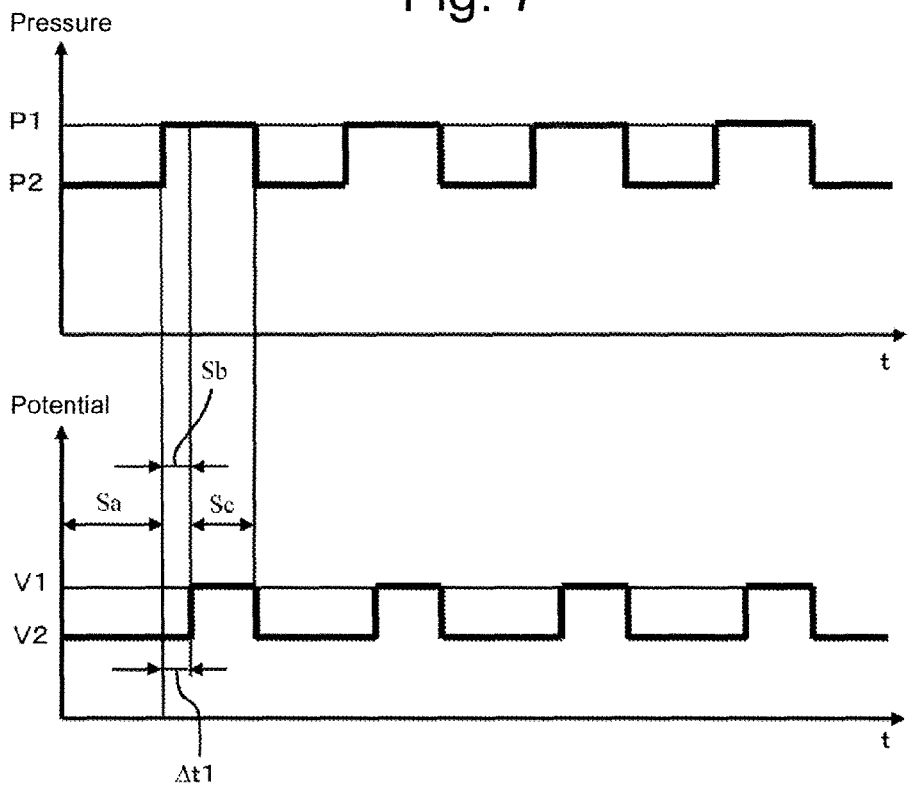
FIG. 7 is a descriptive diagram showing a relationship between pulsed voltage and pressure.

FIG. 7 shows a relationship between the pressure applied to the target material 200 inside the main body 121 and the potential applied to the electrode unit 123. The value of the pressure applied inside the main body 121 by the pressure control unit 330 may be set to P2. For example, in this embodiment, the pressure applied inside the main body 121 may be set to the value P2 that is smaller than P1 of the first embodiment (P2<P1).

When the piezoelectric element 400 is made to deform at a predetermined frequency under a state where the pressure P2 is applied to the target material 200 inside the main body 121, the pressure on the target material 200 inside the leading end portion 121A may change in pulses between P2 and P1.

The embodiment configured in this way may yield similar effects as the first embodiment. Further, in this embodiment, the target material 200 being pressurized to P2 by the pressure control unit 330, the piezoelectric element 400 may be actuated in accordance with the frequency of the driver laser beam L1, or alternatively, the frequency of the driver laser beam L1 may be synchronized with the frequency at which the piezoelectric element 400 is actuated, whereby the pressure on the target material 200 may be changed from P2 to P1. Accordingly, it may be sufficient that the pressure is changed by a difference JP (=P1−P2) between P1 and P2 when generating a droplet.

Further, in this embodiment, a bias potential V2 being applied to the electrode unit 123, a pulsed potential may be applied thereto in accordance with the frequency of the driver laser beam L1. Alternatively, the frequency of the driver laser beam L1 may be synchronized with the frequency at which the pulsed potential is applied to the electrode unit 123. By changing the potential at the electrode unit 123 from V2 to V1, electrostatic attraction force capable of causing the target material 200 to be pulled out through the nozzle 122B may be generated.

As shown in FIG. 7, a rise in the potential from V2 to V1 may be delayed for a time Δt1 from a rise in the pressure from P2 to P1. Note that a fall in the potential may be set to the same timing as a fall in the pressure. The states Sa, Sb, and Sc shown in FIG. 7 correspond to the changes in the meniscus shown in FIG. 5B.

In this embodiment, pressure and electrostatic attraction force that are not sufficient to cause the droplet 201 to be pulled out may be generated in advance, and the pressure and the potential may be increased, respectively, to predetermined values required to cause the droplet 201 to be generated in accordance with the frequency of the driver laser beam L1. Accordingly, a response time required to generate the droplet 201 can be made shorter than that in the first embodiment. With this, even when the frequency of the driver laser beam L1 is made shorter (even in the case of higher repetition rate), it is possible to accommodate to the shorter frequency (higher repetition rate).

Third Embodiment

Figure 8:
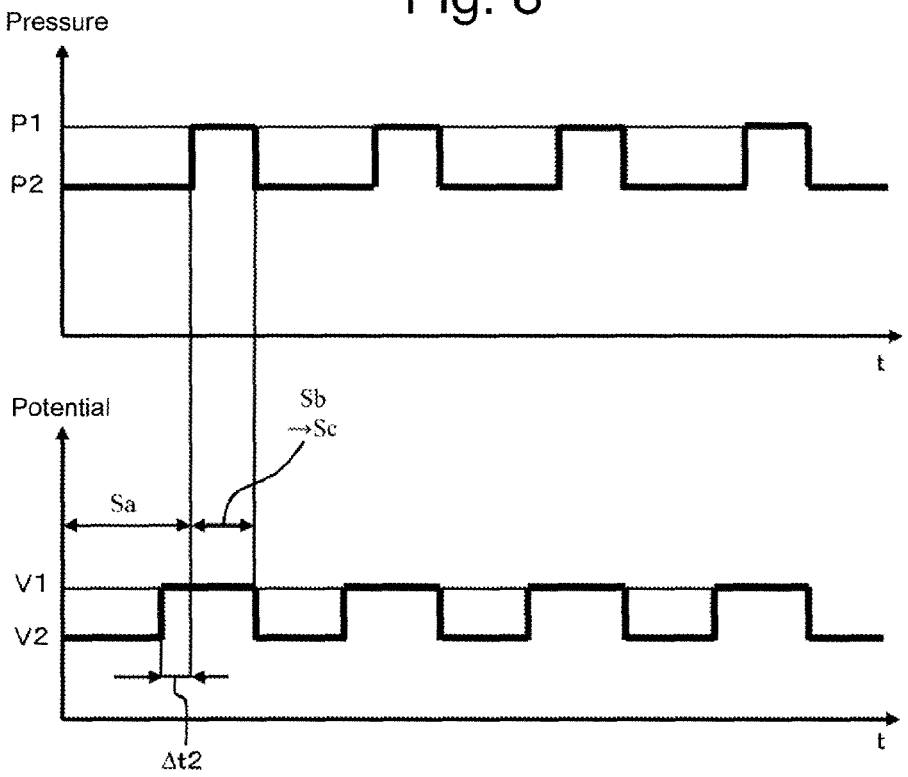
FIG. 8 is a descriptive diagram showing a relationship between pulsed voltage and pressure according to a third embodiment.

A third embodiment will be described with reference to FIG. 8. The third embodiment is based on the configuration according to the second embodiment. FIG. 8 shows a relationship between the pressure applied to the target material 200 inside the main body 121 and the potential applied to the electrode unit 123. The potential may be changed from V2 to V1 first, and after a slight delay by a time Δt2, the pressure may be changed from P2 to P1.

In this embodiment, a rise in the pressure from P2 to P1 may be delayed for the time Δt2 from a rise in the voltage from V2 to V1. The embodiment configured in this way may yield similar effects as the second embodiment.

Fourth Embodiment

A fourth embodiment will be described with reference to FIG. 9. In this embodiment, as in the second and third embodiments, a piezoelectric element 400A may be made to deform so as to generate pulsed pressure with the bias pressure being applied to the target material in the main body 121. Further, in this embodiment, as in the second and third embodiments, a pulsed potential may be applied with a bias potential being applied to the electrode unit 123.

Figure 9:
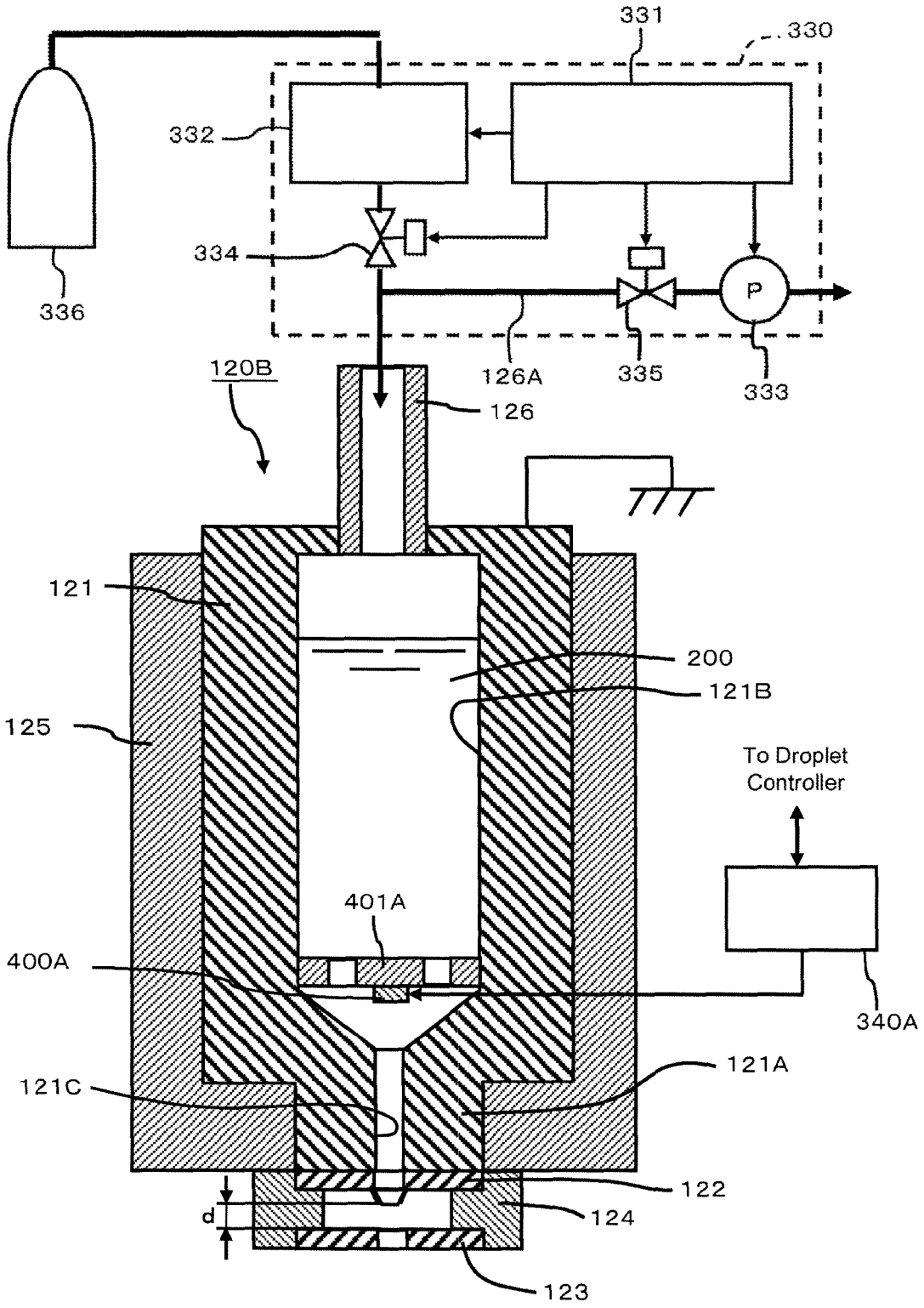
FIG. 9 illustrates a target output unit according to a fourth embodiment.

FIG. 9 illustrates a target output unit 120B according to this embodiment. The container 121B may be provided with an orifice plate 401A and the piezoelectric element 400A to the side toward the leading end portion 121A.

As in the orifice 401 described in the second embodiment, the orifice plate 401A may allow the pressure below the orifice plate 401A (pressure at the side of the leading end portion 121A) to be maintained while delaying the propagation thereof.

As in the piezoelectric element 400 described in the second embodiment, the piezoelectric element 400A may deform in accordance with the pulsed potential inputted from a second pulse control unit 340A. The piezoelectric element 400A may be provided on a bottom surface of the orifice plate 401A.

In this embodiment, the pressure and the voltage may be controlled in a method shown in either FIG. 7 or FIG. 8, whereby a high-speed, small-sized droplet 201 may be outputted from the target output unit 120B.

Fifth Embodiment

A fifth embodiment will be described with reference to FIG. 10 through FIG. 12. In this embodiment, the droplet 201 may be generated with electrostatic attraction. That is, in this embodiment, additional pressure (P1 or P2) may not have to be applied to the target material 200 inside the main body 121.

Figure 10:
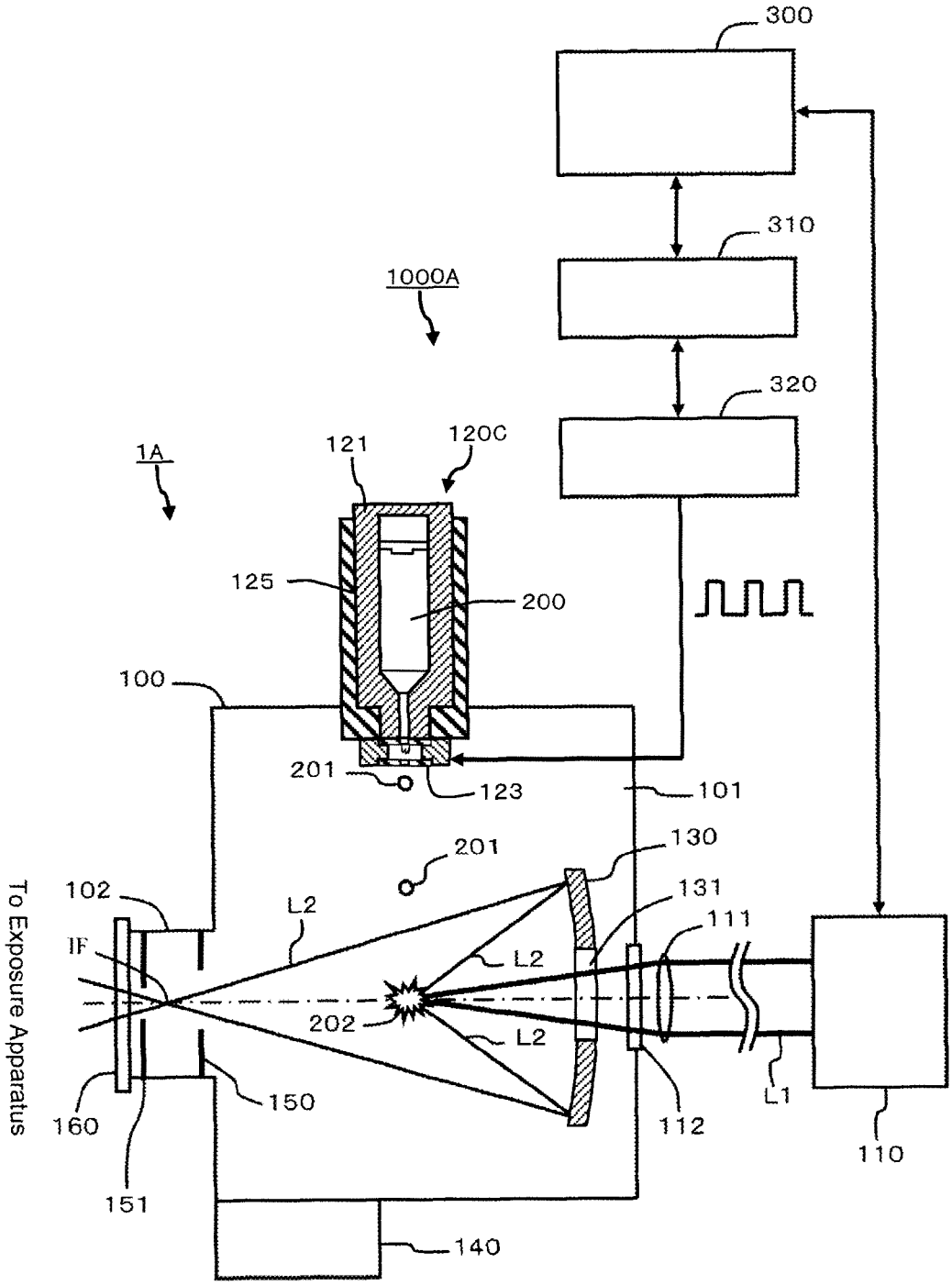
FIG. 10 illustrated the configuration of an EUV light source apparatus according to a fifth embodiment.

FIG. 10 illustrates the general configuration of the EUV light source apparatus 1A according to this embodiment. FIG. 11 is an enlarged view of a target output unit 120C according to this embodiment. The EUV light source apparatus 1A of this embodiment may differ from that of the first through fourth embodiments and may not include the pressure control unit 330. A target supply unit 1000A may include the target output unit 120C, the droplet controller 310, and the pulse control unit 320.

Figure 11:
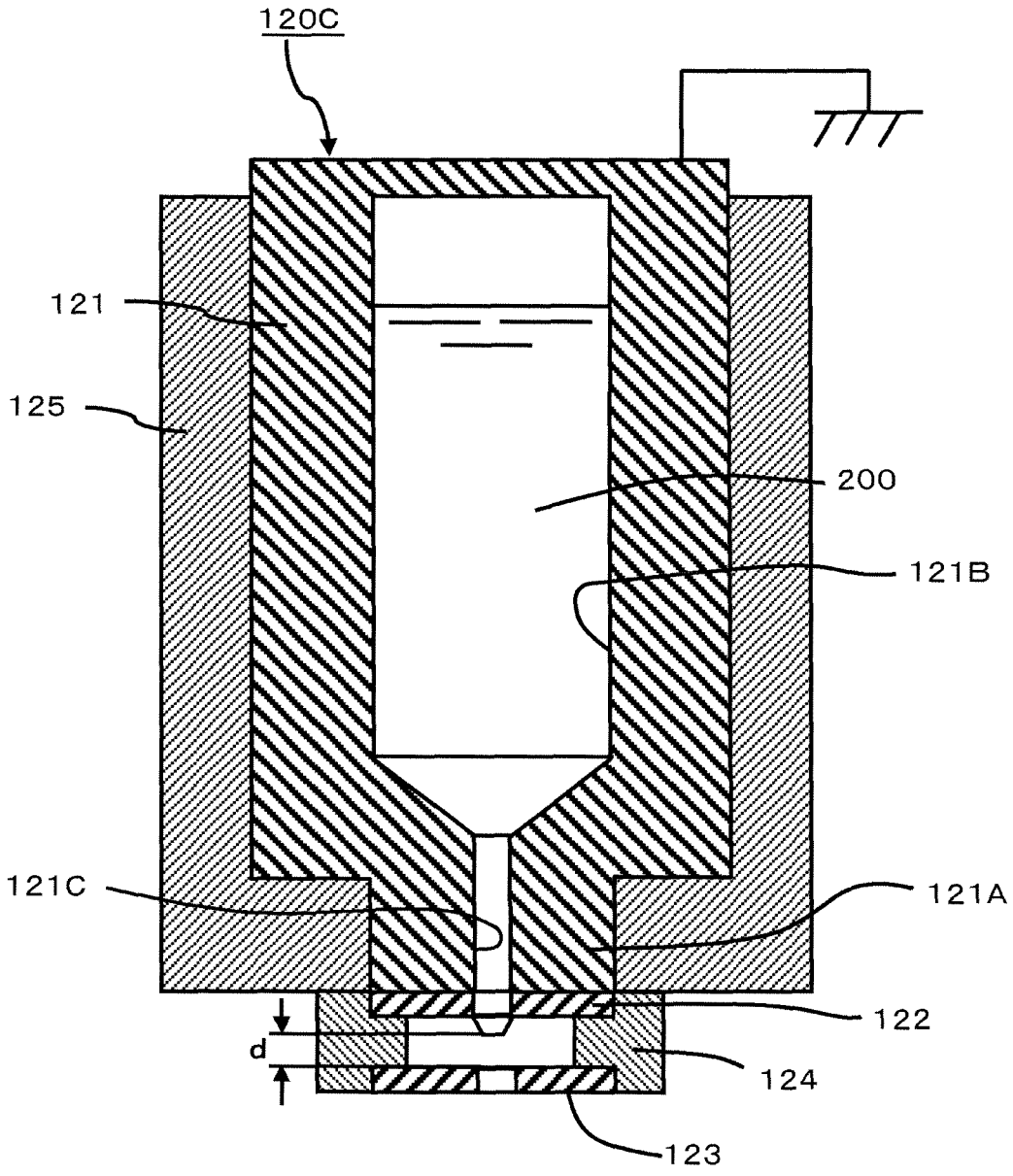
FIG. 11 illustrates a target output unit.

As shown in FIG. 11, the electrode unit 123 may be provided to the target output unit 120C of this embodiment. The piping 126 for supplying argon gas may not be connected to the main body 121.

Figure 12:
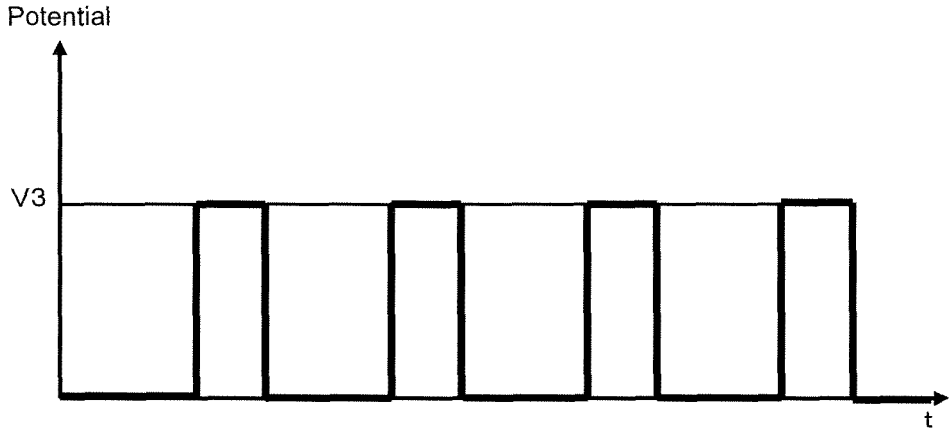
FIG. 12 is a diagram showing pulsed voltage applied to an electrode unit.

FIG. 12 shows a pulsed potential applied to the electrode unit 123. In this embodiment, since pressure is not applied to the target material 200, a value V3 of the pulsed potential may be set higher than the value V1 described in the first embodiment (V3>V1). Since the electrostatic attraction force may be proportional to a square of the voltage V, in this embodiment, electrostatic attraction force that is stronger than that described in the first through fourth embodiments may be generated.

The embodiment configured in this way may yield similar effects as the first embodiment. Further, in this embodiment, the droplet 201 can be generated by causing the target material 200 to be discharged through the nozzle 122B solely by the electrostatic attraction force.

In this embodiment, since a mechanism for pressurizing the target material 200 inside the main body 121 may not need to be provided, the configuration of the target supply unit 1000A can be simplified. Accordingly, manufacturing cost and running cost may be reduced.

Sixth Embodiment

Figure 13:
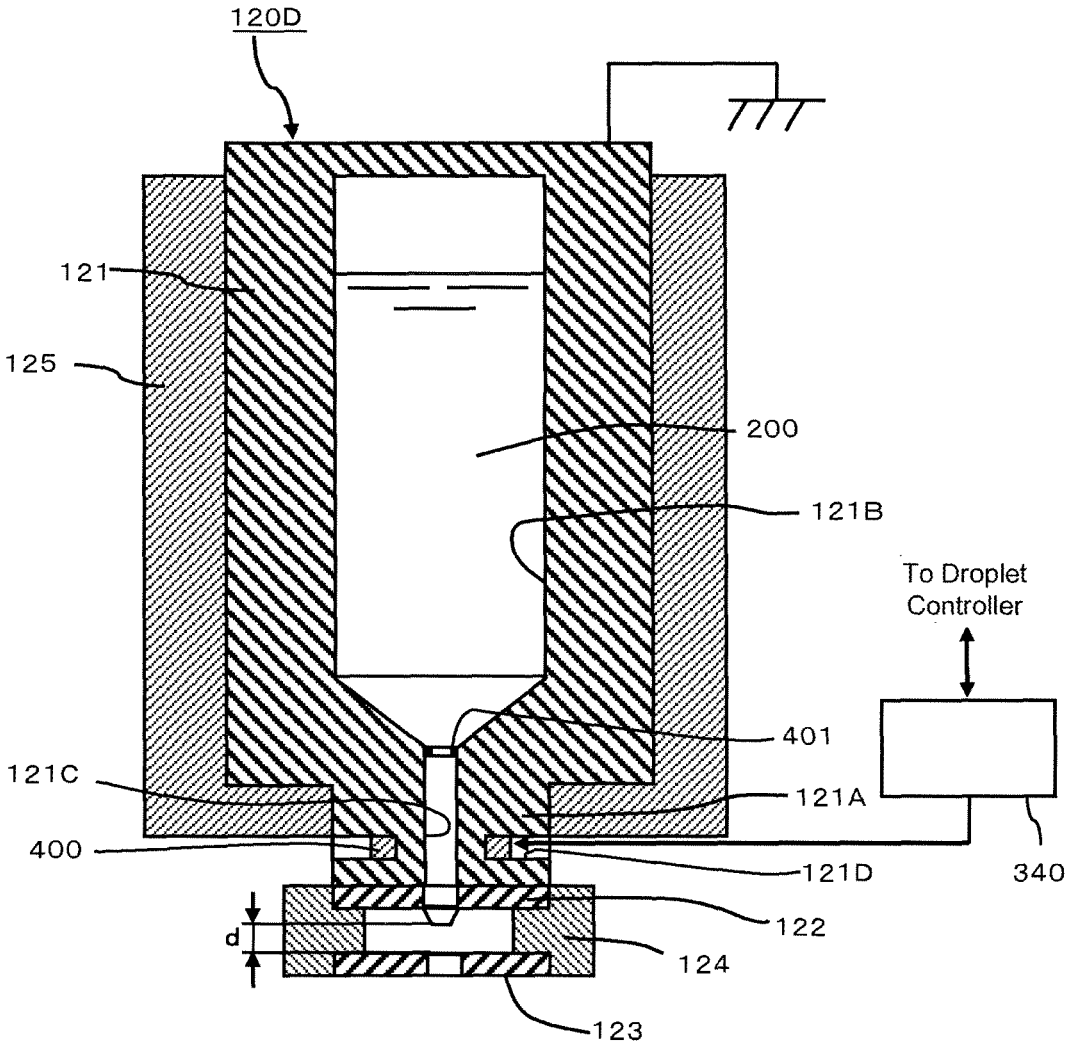
FIG. 13 illustrates a target output unit according to a sixth embodiment.

A sixth embodiment will be described with reference to FIG. 13 and FIG. 14. In this embodiment, a pulsed potential applied to the electrode unit 123 may be synchronized with pulsed pressure applied to the target material 200. FIG. 13 illustrates a target output unit 120D according to this embodiment. The target output unit 120D of this embodiment may substantially be similar in configuration to the target output unit 120A shown in FIG. 6, except in that the configuration for supplying gas may not be provided.

In this embodiment, the pressure control unit 330 for applying constant pressure to the target material 200 inside the main body 121 may not be provided. The target supply unit 1000 according to this embodiment may preferably include the target output unit 120D, the droplet controller 310, the pulse control unit 320, and the second pulse control unit 340.

Figure 14:
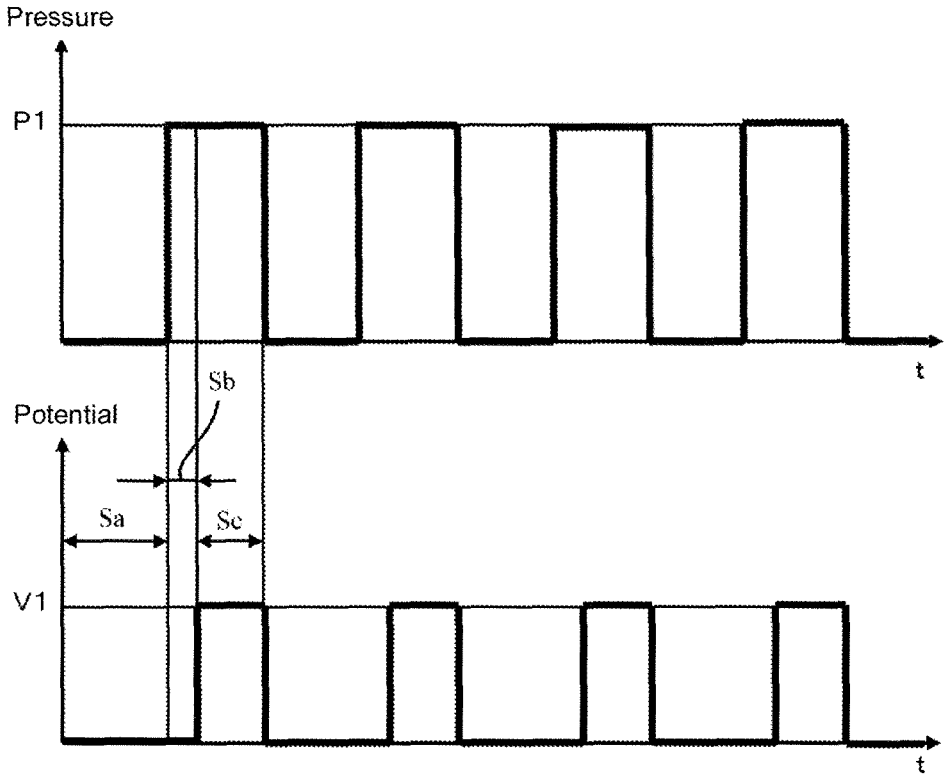
FIG. 14 is a descriptive diagram showing a relationship between pulsed voltage and pressure.

FIG. 14 shows a relationship between a change in pressure on the target material 200 and a change in a pulsed potential applied to the electrode unit 123. The piezoelectric element 400 may deform in accordance with the pulsed potential (also called second pulsed potential) inputted from the second pulse control unit 340. With the deformation, the pressure on the target material 200 inside the leading end portion 121A may change in pulses. In this embodiment, a rise in the pulsed potential may be delayed from a rise in the pressure. Conversely, a rise in the pressure may be delayed from a rise in the pulsed potential.

According to this embodiment, the droplet 201 may be generated by changing the pressure and the potential in pulses in accordance with the frequency of the driver laser beam L1. Alternatively, the frequency of the driver laser beam L1 may be synchronized with the timing at which the pressure and the potential mentioned above are changed. The embodiment configured in this way may yield similar effects as the first embodiment. Further, in this embodiment, since the pressure control unit 330 may not need to be provided, manufacturing cost and running cost can be reduced further, compared to the second through fourth embodiments.

Seventh Embodiment

Figure 15:
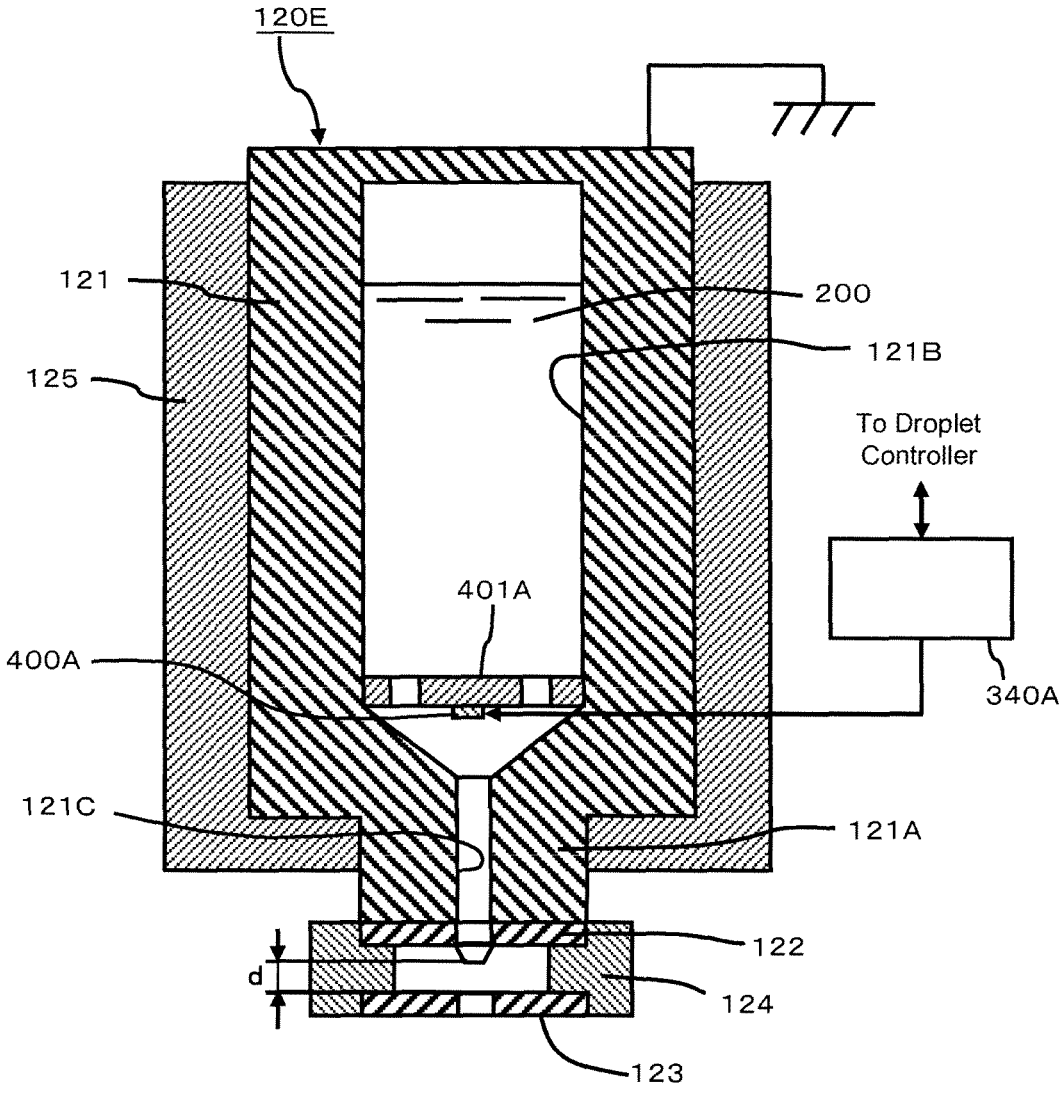
FIG. 15 illustrates a target output unit according to a seventh embodiment.

A seventh embodiment will be described with reference to FIG. 15. A target output unit 120E of this embodiment may be substantially similar in configuration to the target output unit 120B shown in FIG. 9, except in that the configuration for supplying gas may not be provided.

In this embodiment, as described in the sixth embodiment, the droplet 201 can be generated by changing the pressure and the potential in pulses in accordance with the frequency of the driver laser beam L1. The target supply unit 1000 of this embodiment may include the target output unit 120E, the droplet controller 310, the pulse control unit 320, and the second pulse control unit 340A, and may not need to include the pressure control unit 330.

In the embodiment configured in this way, as described with reference to FIG. 14, the pulsed pressure may be applied to the target material 200 inside the leading end portion 121A in accordance with the frequency of the driver laser beam L1, and further, the pulsed voltage may be applied to the electrode unit 123. Accordingly, this embodiment may yield similar effects as the sixth embodiment.

Eighth Embodiment

Figure 16A:
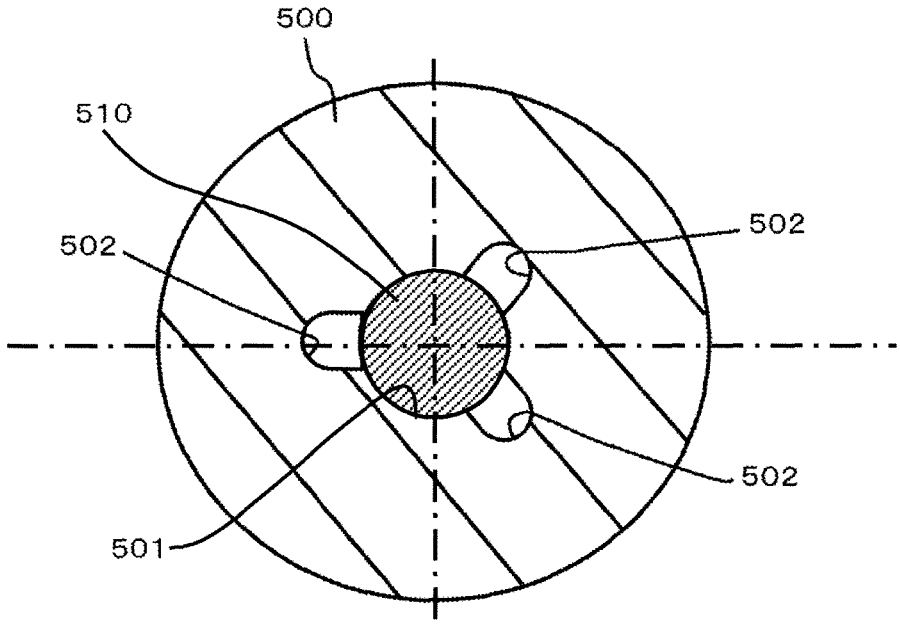
FIGS. 16A and 16B illustrate a nozzle unit according to an eighth embodiment.
Figure 16B:
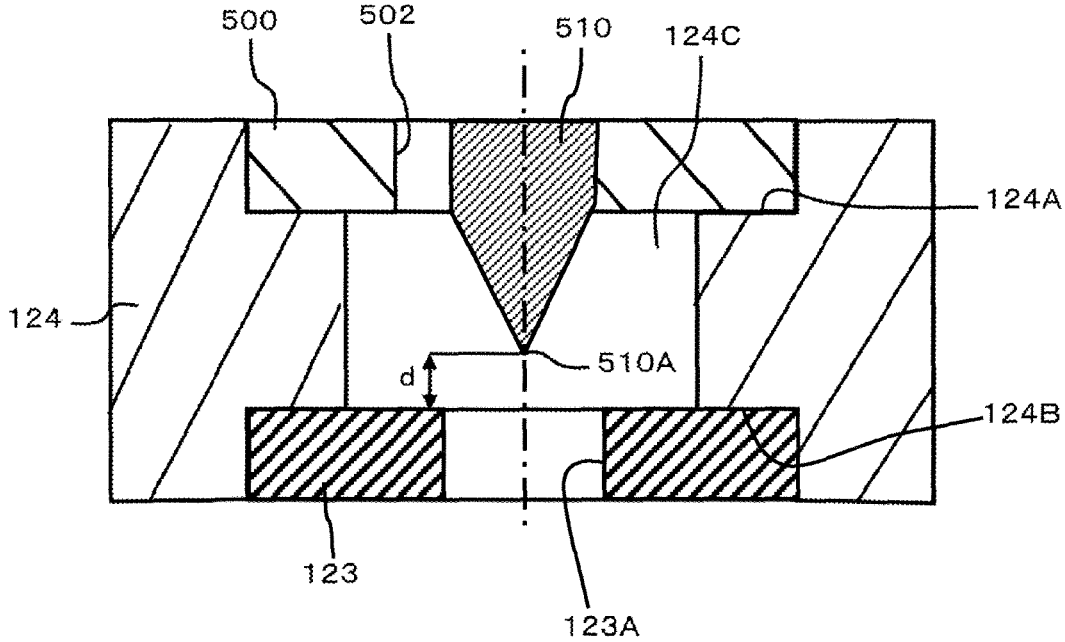

An eighth embodiment will be described with reference to FIGS. 16A and 16B. In this embodiment, a nozzle unit 500 is newly proposed. FIGS. 16A and 16B illustrate the nozzle unit 500 and so forth. FIG. 16A is a plan view of the nozzle unit 500. FIG. 16B is a sectional view in a state where the insulator 124 and the electrode unit 123 are mounted to the nozzle unit 500.

A wire 510 of which the may be formed into a sharp-pointed conical shape may be fixed in a mount hole 501 formed in the center of the nozzle unit 500 using a fixing method such as welding or the like. A plurality of (for example, three) output holes 502 may be provided on the periphery of the mount hole 501, the output holes 502 being spaced apart in a circumferential direction. The output holes 502 may be in communication with the interior of the leading end portion 121A. Alternatively, the entire periphery of the wire 510 may be configured as the output hole 502.

In this embodiment, the target material 200 in a molten state may flow along a surface of the sharp-pointed wire 510 through each output hole 502. The target material 200 having flowed along the surface of the wire 510 may remain adhered thereonto due to the surface tension. When the pulsed potential is applied to the electrode unit 123, the target material 200 that has flowed through each output hole 502 may gather at the tip of the wire 510, and the target material 200 may be outputted as the droplet 201 from the tip of the wire 510. The embodiment configured in this way may yield similar effects as the first through seventh embodiments.

Ninth Embodiment

A ninth embodiment will be described with reference to FIG. 17. In this embodiment, configurations 600, 610, and 113 pertaining to a pre-pulse laser beam for striking the droplet 201 prior to the droplet 201 being irradiated with the driver laser beam L1 may be provided.

Figure 17:
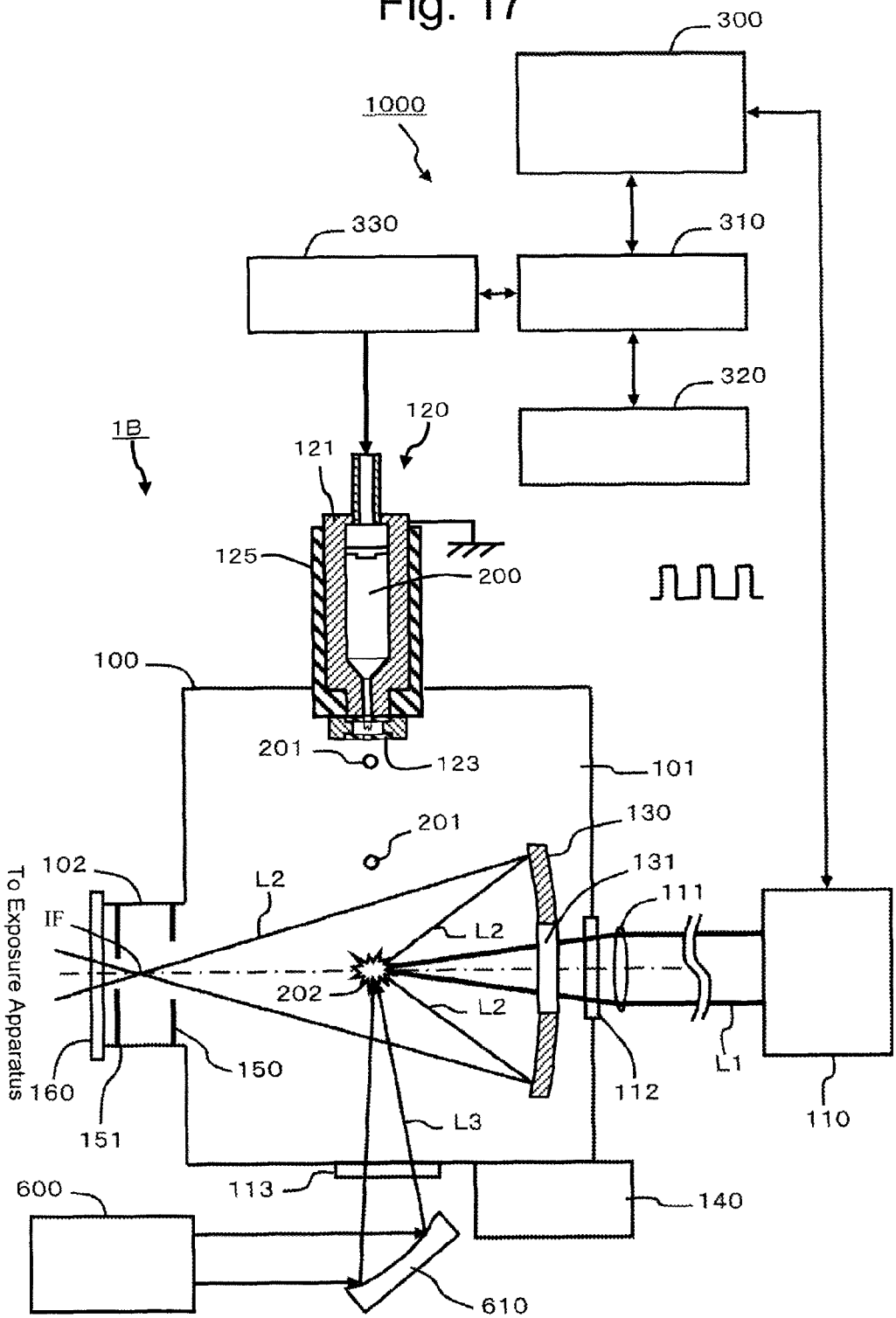
FIG. 17 illustrates the configuration of an EUV light source apparatus according to a ninth embodiment.

FIG. 17 illustrates an EUV light source apparatus 1B according to this embodiment. The pre-pulse laser source 600 for allowing a small-diameter droplet to be diffused may output a pulsed laser beam L3. The pre-pulse laser beam L3 may enter the first chamber 101 via, for example, the concave mirror 610 and the input window 113 for the pre-pulse laser beam.

The pre-pulse laser beam L3 having entered the first chamber 101 may strike the droplet 201 before the droplet 201 is irradiated with the driver laser beam L1. With this, the droplet 201 may be diffused. The diffused droplet 201 may be irradiated with the driver laser beam L1 in a predetermined region. With this, the droplet 201 may be turned into plasma, and the EUV light L2 may be emitted from the plasma.

The embodiment configured in this way may yield similar effects as the first embodiment. Further, in this embodiment, the droplet 201 may be diffused in advance using the pre-pulse laser beam L3. With this, a surface area of the droplet 201 on which the droplet 201 can absorb the laser beam may be increased, and a spatial density can be decreased. Accordingly, the driver laser beam L1 may be absorbed by the droplet 201 efficiently, whereby the emission efficiency of the EUV light can be improved.

As described above, in this embodiment, a small-diameter droplet 201 can be outputted at high-speed with electrostatic attraction force (and change in pressure). Further, the small-diameter droplet 201 may be diffused with the pre-pulse laser beam L3 before the droplet 201 is irradiated with the driver laser beam L1, whereby the area where the driver laser beam L1 strikes can be increased and the emission efficiency of the EUV light can be further improved.

Tenth Embodiment

A tenth embodiment will be described with reference to FIG. 18 through FIG. 20. In the following several embodiments including this embodiment, a position correction unit 700 for correcting a trajectory of the droplet 201 may be provided. The position correction unit 700, as will be described later, may correct the trajectory (position) of the droplet 201 with an electric field or a magnetic field.

Figure 18:
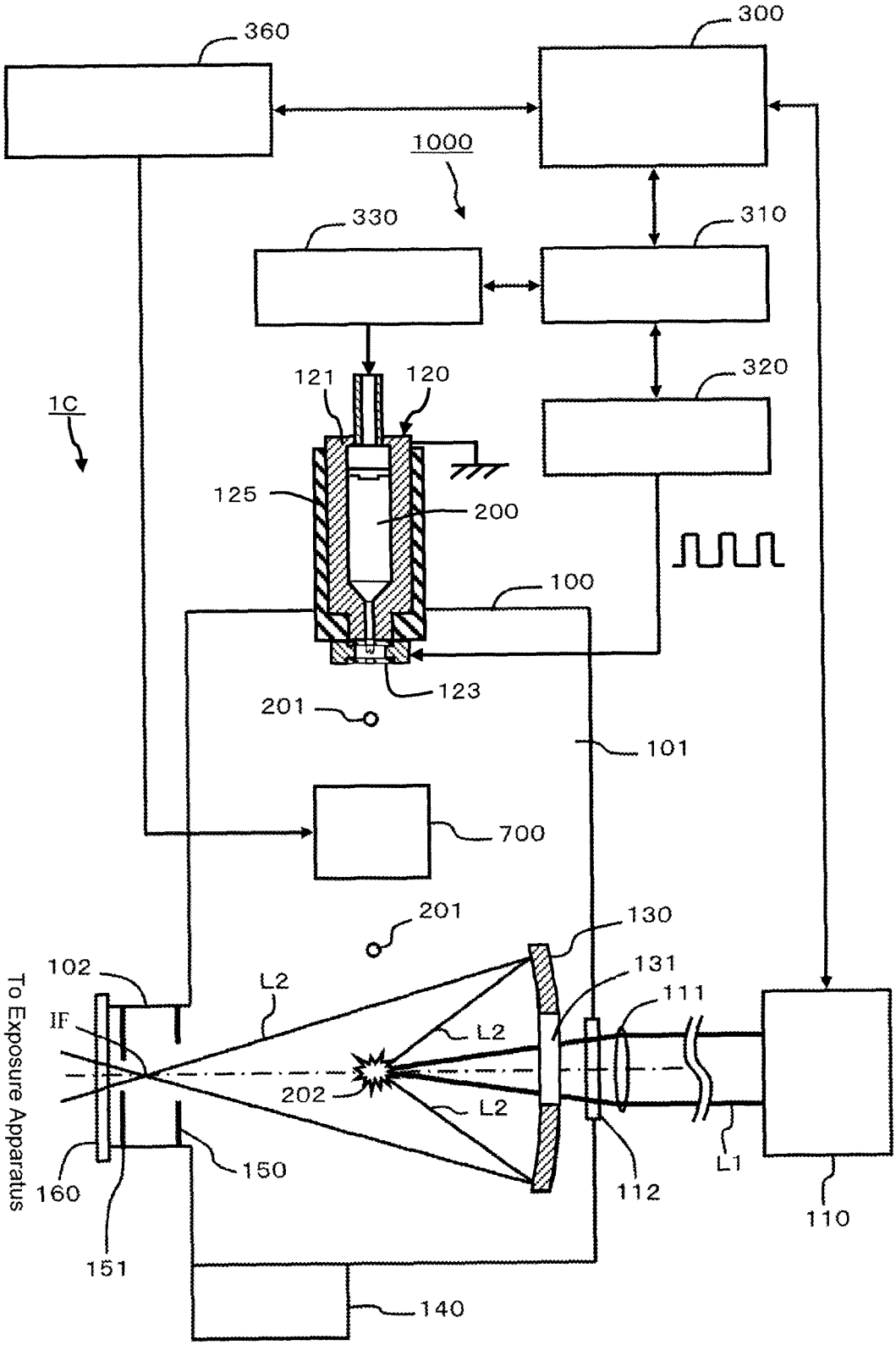
FIG. 18 illustrates the configuration of an EUV light source apparatus according to a tenth embodiment.

FIG. 18 is a general view of an EUV light source apparatus 1C according to this embodiment. The EUV light source apparatus 1C of this embodiment may include a position correction unit 700 for making the trajectory of the droplet 201 coincide with an ideal trajectory R (see FIG. 19B). A predetermined potential may be applied to the position correction unit 700 by a position correction controller 360. The position correction controller 360 may preferably operate in accordance with an instruction from the EUV light source controller 300.

Here, of the trajectories along which the droplets 201 may pass through the position correction unit 700, a trajectory which may linearly travel to the plasma generation region and which may not need to be corrected by the position correction unit 700 may hereinafter be called an "ideal trajectory."

Electrodes of the position correction unit 700 may be configured as either a single electrode configuration composed of a single electrode or as a block electrode configuration in which a plurality of electrodes forms a block. Further, as the block electrode configuration, either a one-block configuration including only one electrode block or a multiple-block configuration including a plurality of electrode blocks can be employed. Below, the configurations of these electrodes will be described.

Figure 19A:
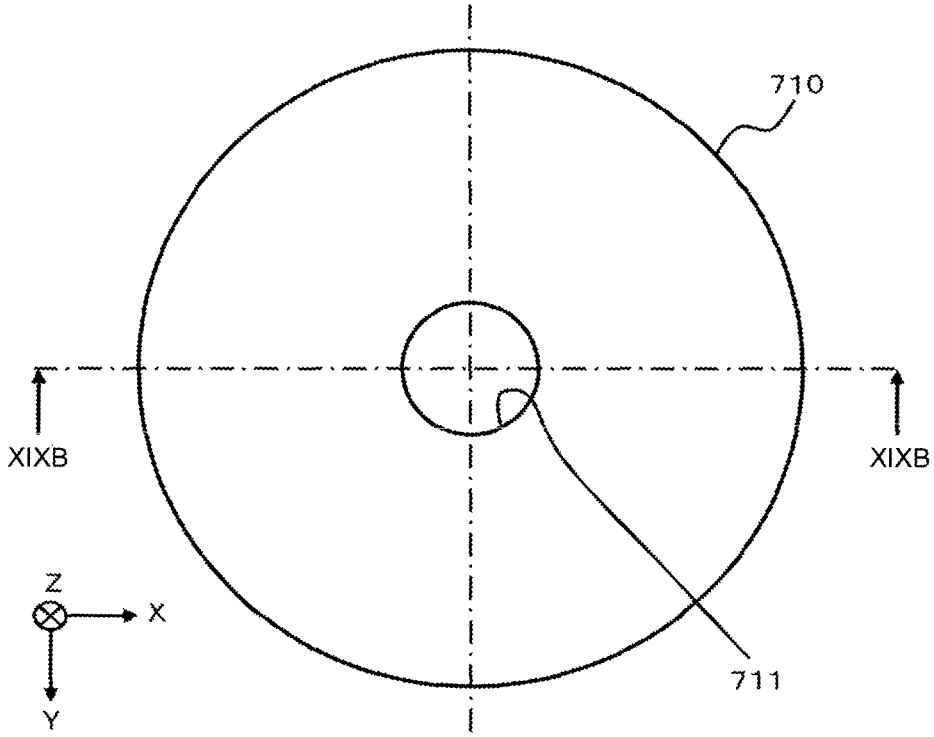
FIGS. 19A and 19B show the configuration of an electrode of a position correction unit.
Figure 19B:
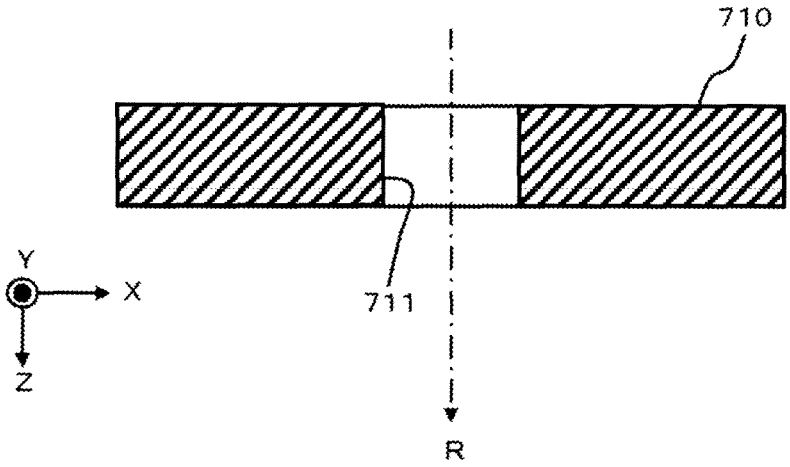

FIGS. 19A and 19B illustrate an exemplary configuration of the electrode of the position correction unit 700. The position correction unit 700 may include a single circular-hole electrode 710. FIG. 19A is a plan view of the circular-hole electrode 710. FIG. 19B is a sectional view of the circular-hole electrode 710.

The circular-hole electrode 710 may be a disc-shaped electrode having a circular hole 711 formed at the center thereof. The circular-hole electrode 710 may preferably be provided perpendicularly with respect to the ideal trajectory R. The circular-hole electrode 710 may preferably be disposed such that the center thereof coincides with the ideal trajectory R of the droplet 201. The single electrode is not limited to the disc-shaped electrode but may be a cylindrical electrode. Even in the case of a cylindrical electrode, the cylindrical electrode may be disposed such that the axis thereof coincides with the ideal trajectory R.

Figure 20:
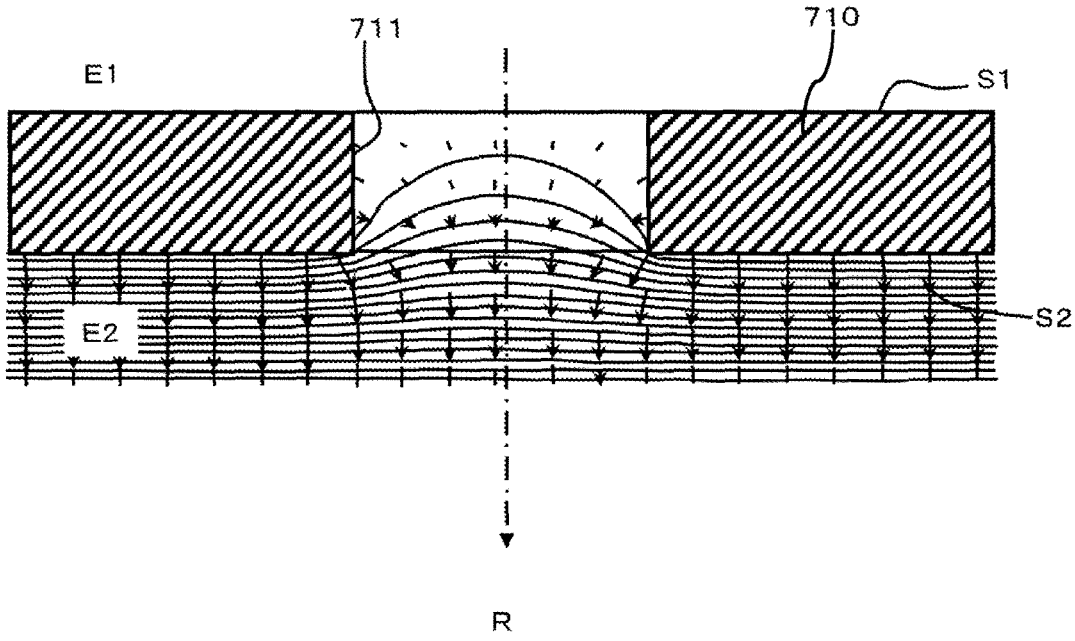
FIG. 20 is shows the distribution of equipotential surfaces around a circular hole in an electrode.

FIG. 20 shows the distribution of equipotential surfaces near the circular hole 711, in the case where electric fields E1, E2 (E1<E2) with differing strengths are respectively formed on one surface S1 and on the other surface S2 of the circular-hole electrode 710.

As shown in FIG. 20, in the circular hole 711, the equipotential surfaces may be distributed so as to project toward the surface S1 of a weaker electric field strength from the surface S2 of a stronger electric field strength. That is, the equipotential surfaces that have projected into the circular hole 711 may form curved surfaces of which the apex may fall on the ideal trajectory R. When a charged particle, or the droplet 201, enters the circular hole 711 from the upper side in FIG. 20, the charged particle may have the trajectory thereof changed in a direction substantially perpendicular to the equipotential surfaces. As a result, as with a convex lens in an optical system, the trajectory of the droplet 201 may be corrected so as to approach the ideal trajectory R.

The embodiment configured in this way may yield similar effects as the first embodiment. Further, since the position correction unit 700 may be provided in this embodiment, the position of the droplet 201 can be corrected to the ideal trajectory R, whereby the droplet 201 can be sent even more precisely to the region in which the droplet 201 may be irradiated with the laser beam.

Figure 26:
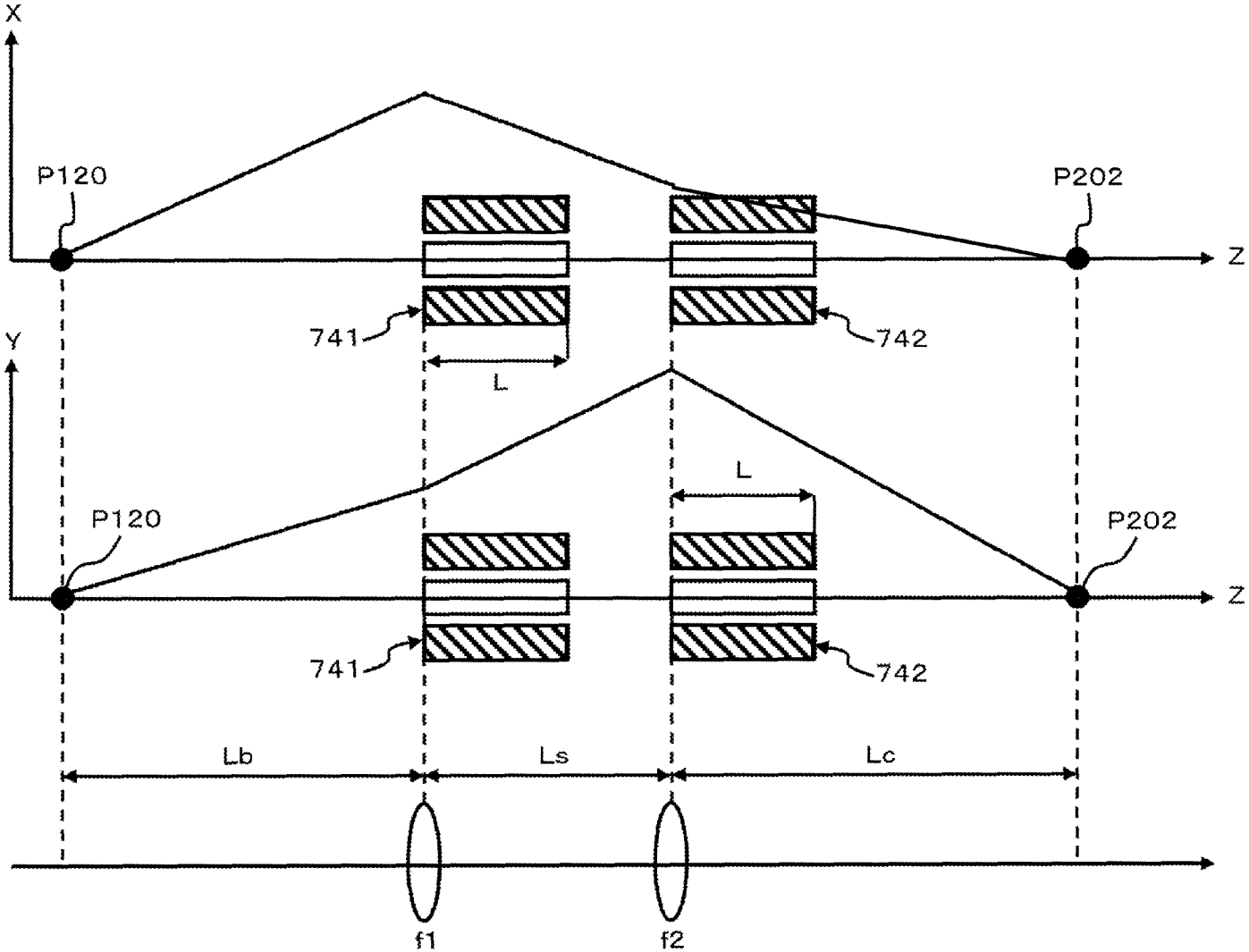
FIG. 26 shows a trajectory of a droplet.

In this embodiment, a travel direction of the droplet 201 that enters the position correction unit 700 with the trajectory thereof being deviated from the ideal trajectory R may be corrected by the electric field formed inside the position correction unit 700 so as to head toward the plasma generation region (P202 in FIG. 26). With this, even if the direction of the droplet 201 outputted from the target output unit 120 is unstable, the position correction unit 700 can correct the trajectory thereof such that the droplet 201 travels toward the plasma generation region.

In particular, even when the output direction from the target output unit 120 changes momentarily, the trajectory of the droplet 201 may automatically be corrected to the trajectory heading toward the plasma generation region by the electric field formed inside the position correction unit 700. With the EUV light source apparatus 1C of this embodiment, the droplet 201 may be supplied to the plasma generation region stably, whereby the EUV light may be emitted even more stably.

Eleventh Embodiment

Figure 21A:
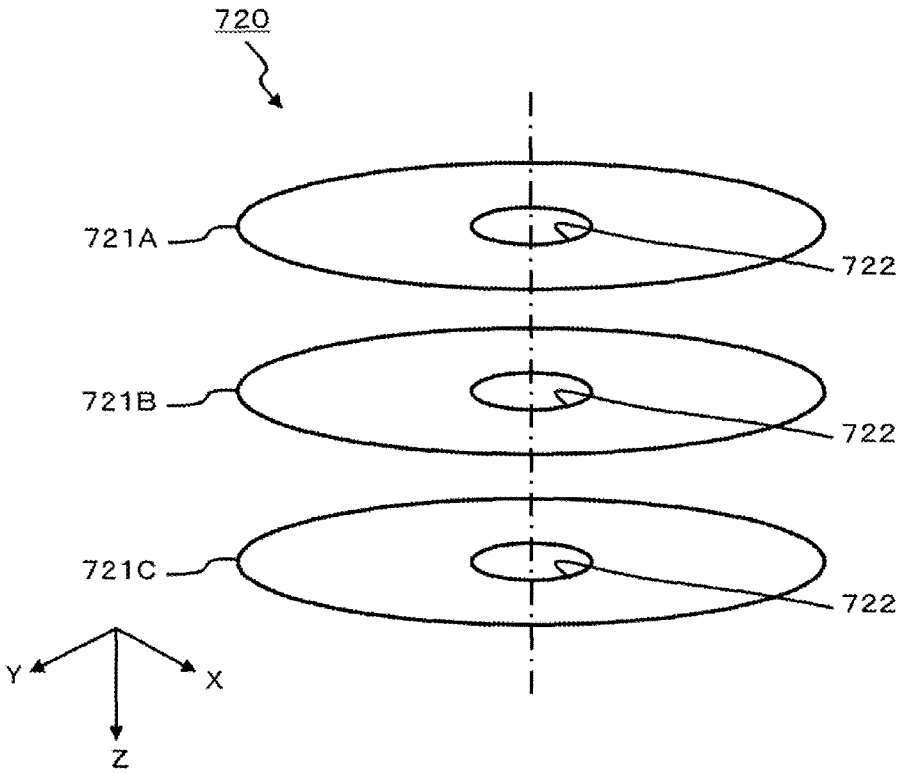
FIGS. 21A and 21B illustrate the configuration of electrodes of position correction unit according to an eleventh embodiment.
Figure 21B:
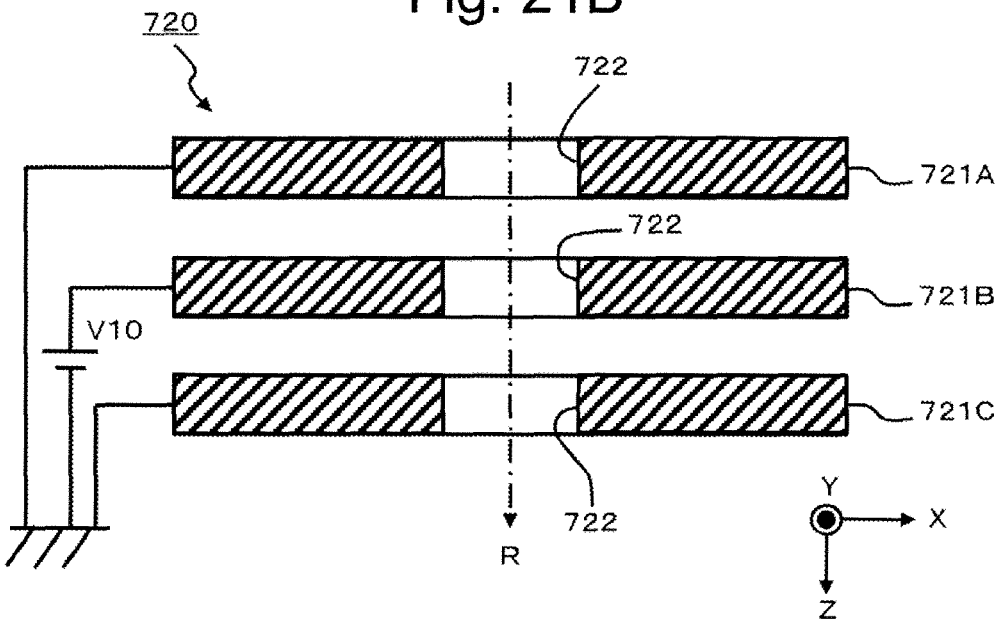

Referring to FIG. 21, an eleventh embodiment will be described. FIGS. 21A and 21B illustrate an exemplary configuration of electrodes of the position correction unit 700. FIG. 21A is a perspective view of a block electrode 720. The block electrode 720 may be an electrode of the one-block configuration configured of three circular-hole electrodes 721A through 721C. The circular-hole electrodes 721A through 721C may be disposed coaxially. The circular-hole electrodes 721A through 721C may preferably be disposed so as to be parallel with one another and equally spaced from one another. Further, the three circular-hole electrodes 721A through 721C may preferably disposed that that the axes thereof coincide with the ideal trajectory R of the droplet 201.

FIG. 21B is a sectional view of the block electrode 720 taken along the X-Z plane passing through the ideal trajectory R. The block electrode 720 may constitute a so-called einzel lens (unipotetial lens), in which the circular-hole electrode 721A (entrance side) and the circular-hole electrode 721C (exit side) may be maintained at the same potential (for example, ground potential) and a positive or negative potential may be applied to the circular-hole electrode 721B in the middle. With this, the block electrode 720 may act like a convex lens on the charged droplet 201.

That is, in this embodiment, the block electrode 720 may cause the droplet 201 to converge in both the x-direction and the y-direction without accelerating or decelerating the droplet 201 in the z-direction. This embodiment may yield similar effects as the tenth embodiment.

Twelfth Embodiment

Figure 22A:
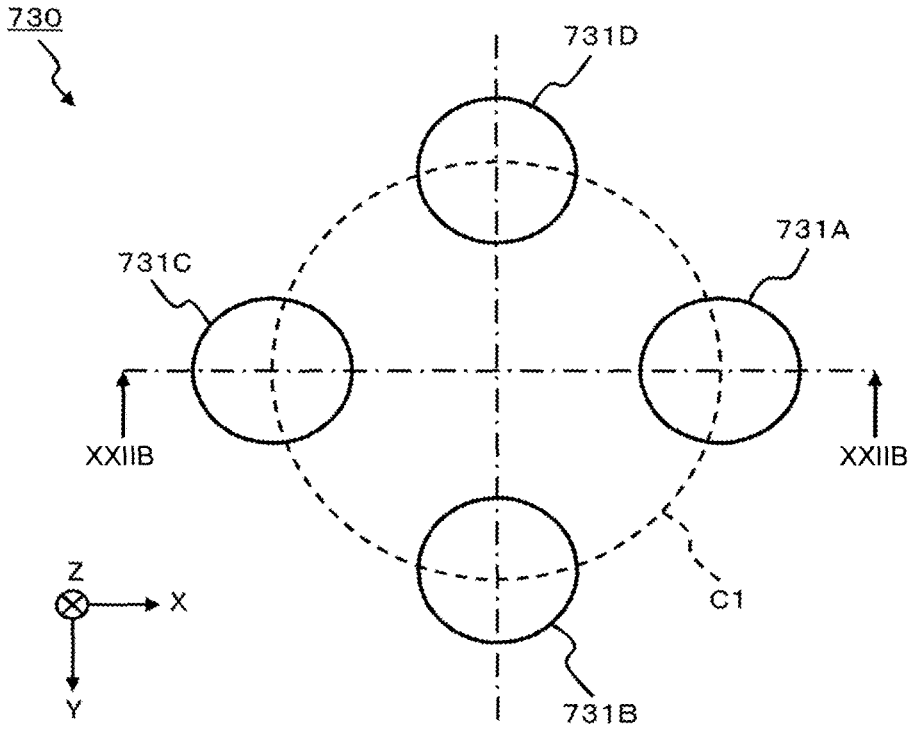
FIGS. 22A and 22B illustrate the configuration of electrodes of a position correction unit according to a twelfth embodiment.
Figure 22B:
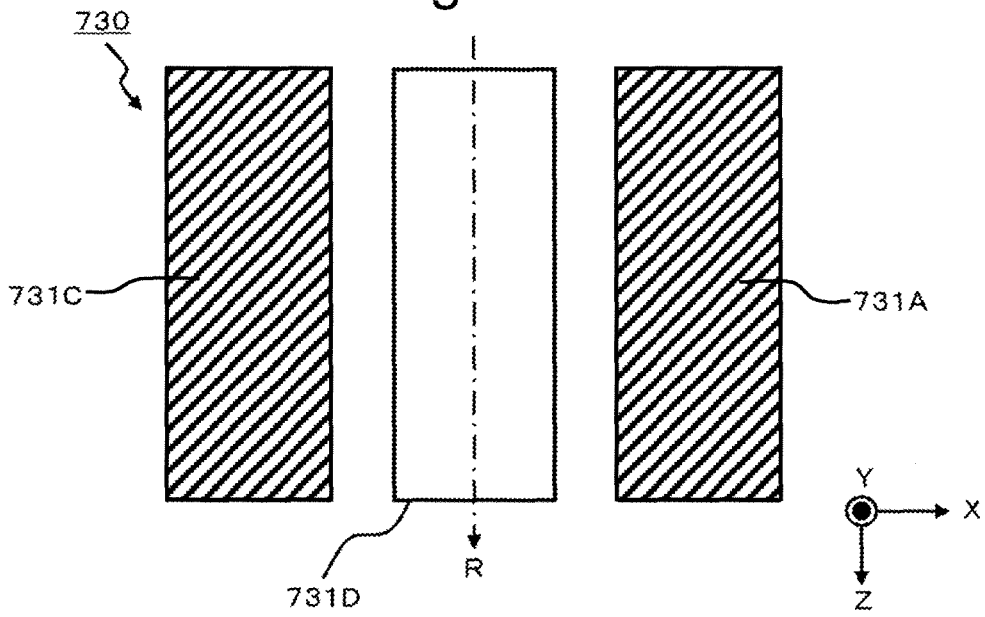
Figure 23:
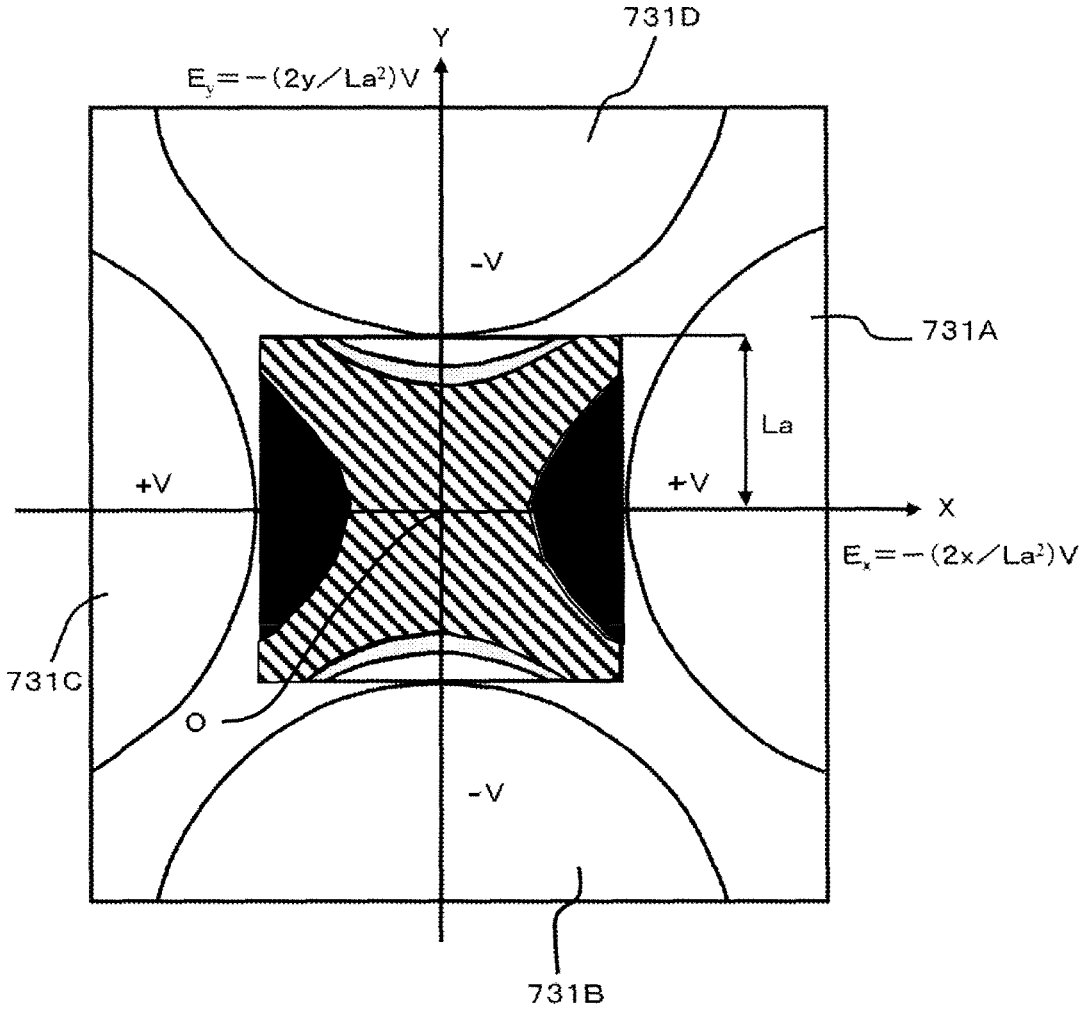
FIG. 23 shows potentials of a block electrode and the distribution thereof.

Referring to FIGS. 22A, 22B and 23, a twelfth embodiment will be described. In this embodiment, a block electrode 730 may be used as the position correction unit 700. The block electrode 730 may preferably be configured as a quadrupole electrode having four column electrodes 731A through 731D.

FIG. 22A is a plan view of the block electrode 730, and FIG. 22B is a sectional view of the block electrode 730 taken along the XXIIB-XXIIB line in FIG. 22A. The column electrodes 731A through 731D may be parallel to one another and equally spaced on a circle C1 having a predetermined radius. The block electrode 730 may preferably disposed such that the center of the circle C1 coincide with the ideal trajectory R of the droplet 201. The configuration of the block electrode 730 is not limited to the quadrupole electrode having four column electrodes, but may be a multipole electrode having six or more even number of column electrodes.

With the multipole electrode configuration, by adjusting the length of the column electrode in the z-axis direction (height of the column), stronger force may be applied on the droplet 201 than a flat circular-hole electrode can. Accordingly, the multipole electrode configuration may work more effectively on the droplet 201 composed of a molten metal.

FIG. 23 illustrates potentials of the electrodes 731A through 731D and the distribution of the potentials by the electrodes 731A through 731D on an X-Y plane in the block electrode 730. In the illustrated example, a pair of electrodes 731A and 731C disposed so as to be axially symmetric and opposing each other may be provided with the same potential (V), and the other pair of the electrodes 731B and 731D may be provided with the same potential (−V) of the reverse polarity.

When La represents a distance from an origin O (X,Y)=(0, 0) to each of the electrodes 731A through 731D, an electric field Ex in the X-axis direction and an electric field Ey in the Y-axis direction may be expressed in the following expressions (1), (2).

$$Ex=-(2x/La^2)V \quad (1)$$

$$Ey=-(2y/La^2)V \quad (2)$$

That is, the distribution of potentials in a space surrounded by the four electrodes 731A through 731D may be such that the potential of the origin O is 0. The potential in the Y-axis direction may become lower as the distance from the origin O increases. The potential in the X-axis direction may become higher as the distance from the origin O increases. When a positively charged droplet 201 enters this electric field, converging force may act in the X-axis direction, with which the droplet 201 may move in the direction of X=0, and diverging force may act in the Y-axis direction, with which the droplet 201 may move in the direction in which the absolute value of y increases. At this time, the magnitude of the converging force and the magnitude of the diverging force may be substantially equal. In the case of a negatively charged droplet 201, on the contrary to the case where the droplet is charged positively, the converging force may act in the Y-axis direction, and the diverging force will act in the X-axis direction.

The embodiment configured in this way may yield similar effects as the tenth embodiment. Further, in this embodiment, the block electrode 730 having four column electrodes 731A through 731D may be used as the position correction unit 700, whereby stronger force may be applied to the droplet 201 and the position of the droplet 201 can be corrected therewith.

Thirteenth Embodiment

Referring to FIG. 24 through FIG. 28, a thirteenth embodiment will be described. In this embodiment, a plurality of block electrodes 741 and 742 may be used. As described above, with the quadrupole electrode configuration, the converging force may act in either one of the X-axis direction or the Y-axis direction, and the diverging force may act in the other direction. Accordingly, in order to guide the droplet 201 being deviated in both the X-axis direction and the Y-axis direction to the Plasma generation region, two or more block electrodes may be arranged in the Z-axis direction.

The block electrode of the multiple-block configuration, as a whole, may exert such force on the droplet 201 (charged particle) that the travel direction of the droplet 201 may converge at one point. That is, the block electrode of the multiple-block configuration may exhibit a function equivalent to that of a lens on light. Accordingly, the electrode of the multiple-block configuration may be called an electrostatic lens. With the configuration in which a plurality of block electrodes is included, each block electrode may function as a lens in either the X-axis direction or the Y-axis direction. Accordingly, the block electrode of the multiple-block configuration, as a whole, may demonstrate similar effects as an imaging optical system.

Figure 24:
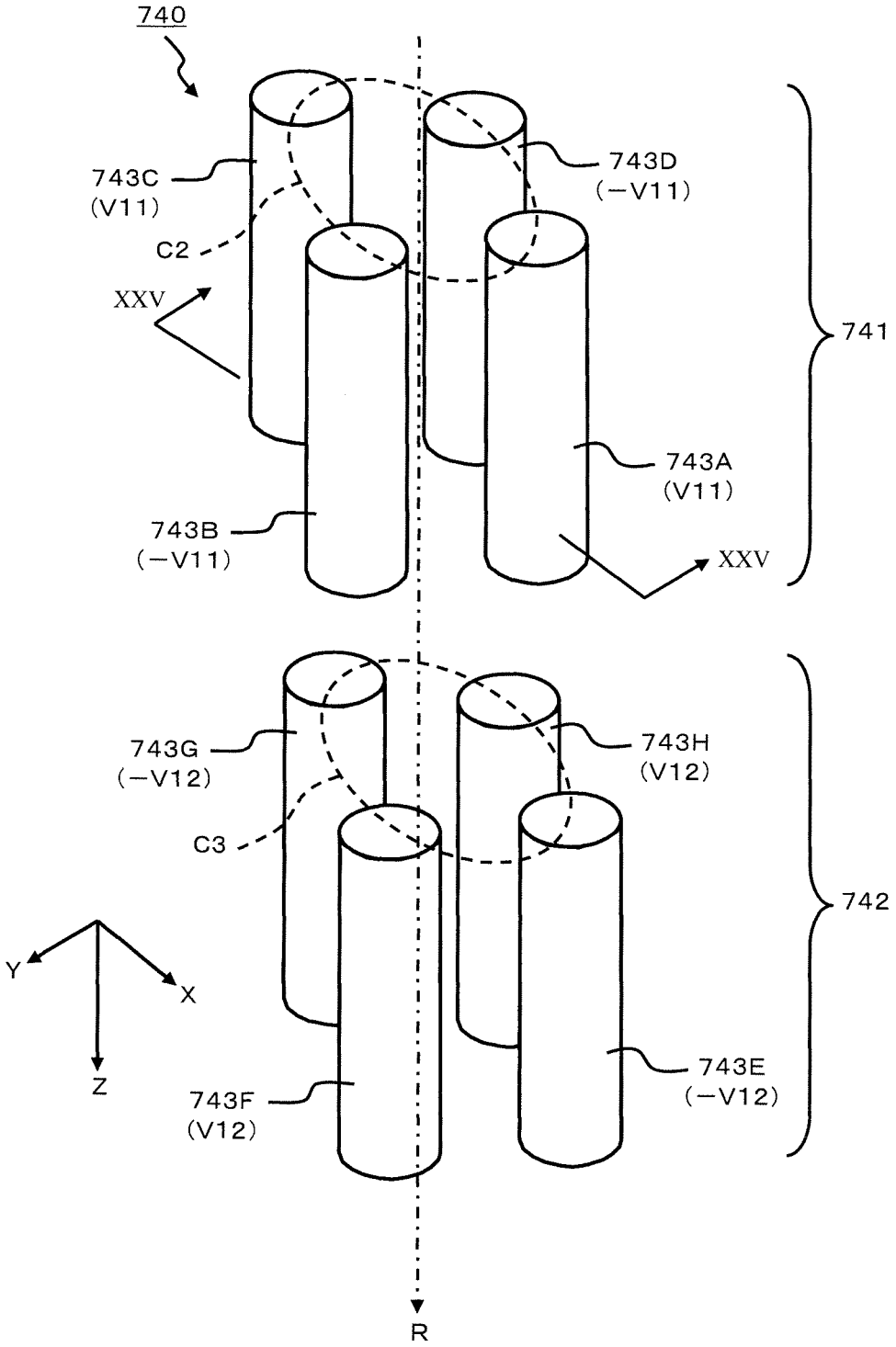
FIG. 24 is a perspective view illustrating the configuration of electrodes of a position correction unit according to a thirteenth embodiment.
Figure 25:
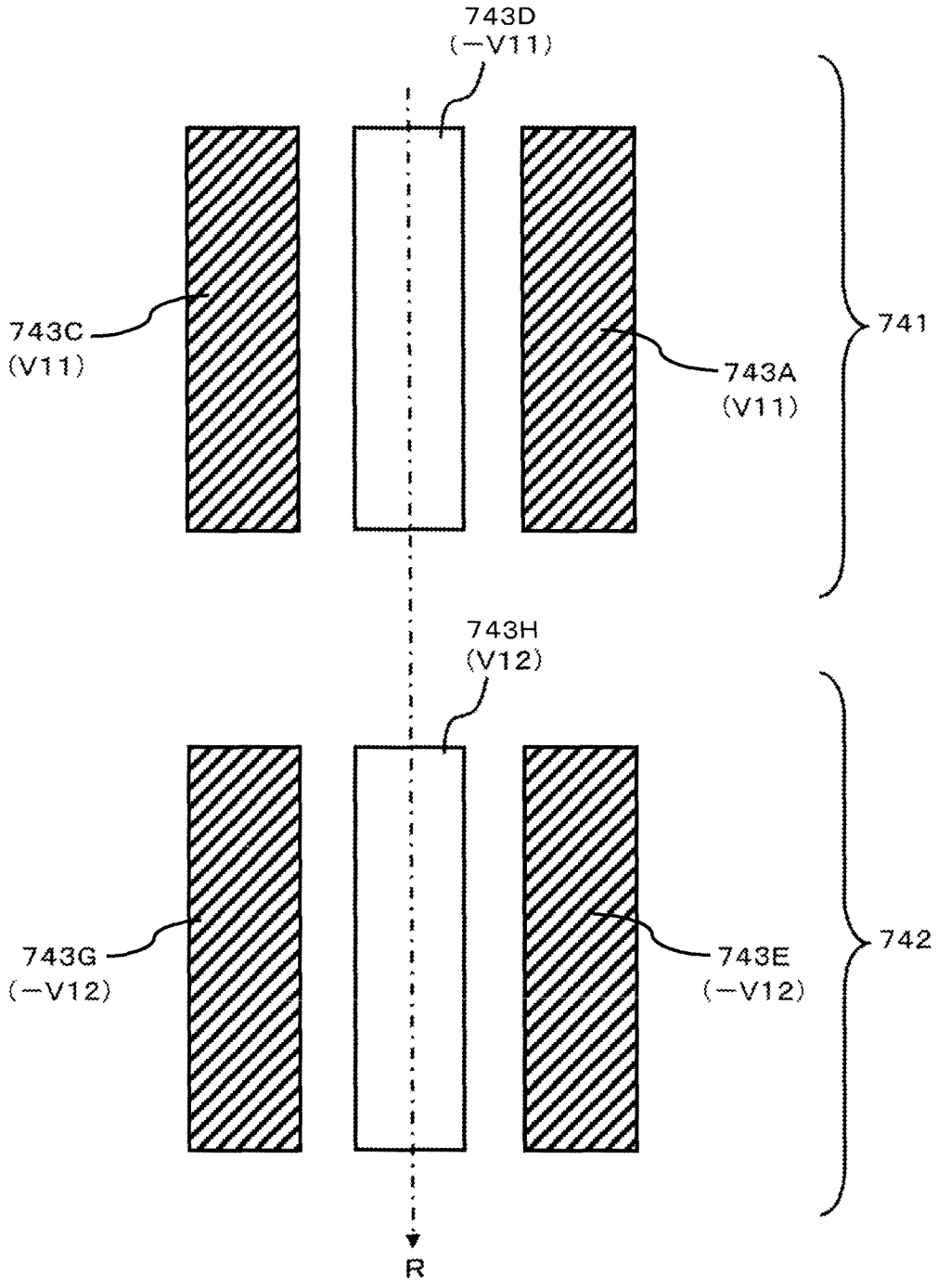
FIG. 25 is a sectional view illustrating a block electrode of a doublet configuration.

FIG. 24 is a perspective view of a block electrode 740 of the doublet configuration, which may serve as the position correction unit 700. In this embodiment, the block electrode 740 of the doublet configuration in which two quadrupole electrodes may be arranged in the Z-axis direction may be used. FIG. 25 is a sectional view of the block electrode 740 taken along the X-Z plane containing the ideal trajectory R.

The block electrode 740 may include a first quadrupole electrode 741 configured of column electrodes 743A through 743D and a second quadrupole electrode 742 configured of column electrodes 743E through 743H. As in the one-block configuration described with reference to FIGS. 22A and 22B, in the first quadrupole electrode 741, the column electrodes 743A through 743D may be parallel to one another and equally spaced on a circle C2 having a predetermined radius.

Similarly, in the second quadrupole electrode 742, the column electrodes 743E through 743H may be parallel to one another and equally spaced on a circle C3 having the same radius as the circle C2. Further, the quadrupole electrode 741 and the quadrupole electrode 742 may be disposed such that the center of each of the circle C2 and the circle C3 coincides with the ideal trajectory R and that the quadrupole electrode 741 and the quadrupole electrode 742 are aligned in the Z-axis direction. Note that in the example shown in FIG. 24, the column electrodes 743A and 743C and the column electrodes 743E and 743G may be disposed on the X-axis, and the column electrodes 743B and 743D and the column electrodes 743F and 743H may be disposed on the Y-axis.

In the block electrode 740 in which the column electrodes 743A-743H may be disposed as described above, a pattern of potentials applied on the quadrupole electrode 741 and a pattern of potentials applied on the quadrupole electrode 742 may preferably be such that they are rotated by 90 degrees with respect to each other.

That is, in the quadrupole electrode 741, a positive potential (V11) may be applied to the column electrodes 743A and 743C disposed on the X-axis, and a negative potential (−V11) may be applied to the column electrodes 743B and 743D disposed on the Y-axis. Meanwhile, in the quadrupole electrode 742, a negative potential (−V12) may be applied to the column electrodes 743E and 743G disposed on the X-axis, and a positive potential (V12) may be applied to the column electrodes 743F and 743H disposed on the Y-axis. Note that the absolute values of the potentials applied to the quadrupole electrode 741 and to the quadrupole electrode 742 (that is, values of V11, V12) may be the same or may be different.

The distribution of the potentials around the quadrupole electrode 741 may be similar to what has been shown in FIG. 23. That is, having passed through the quadrupole electrode 741, the positively charged droplet 201 may converge in the X-axis direction and diverge in the Y-axis direction. Meanwhile, the distribution of the potentials around the quadrupole electrode 742 should be such that the distribution of the potentials shown in FIG. 23 is rotated by 90 degrees. Accordingly, having passed through the quadrupole electrode 742, the positively charged droplet 201 may diverge in the X-axis direction and converge in the Y-axis direction.

FIG. 26 illustrates a case where the above-described block electrode 740 of the doublet configuration is employed as the position correction unit 700. Shown in FIG. 26 is a trajectory along which the droplet 201 may pass through the first quadrupole electrode 741 and the second quadrupole electrode 742 of the block electrode 740 from a generation point P120 of the droplet 201 and reach the plasma generation region P202. The generation point 9120 of the droplet may be the position of the nozzle of the target output unit 120. With reference to FIG. 26, an imaging condition for the droplet 201 to converge at the plasma generation region P202 will be determined. The upper part in FIG. 26 shows the trajectory in the X-Z plane. The lower part in FIG. 26 shows the trajectory in the Y-Z plane.

As shown in FIG. 26, Lb represents the distance between the generation point P120 of the droplet 201 of the target output unit 120 and the first quadrupole electrode 741. Ls represents the distance between the first quadrupole electrode 741 and the second quadrupole electrode 742. Lc represents the distance between the second quadrupole electrode 742 and the plasma generation region P202. L represents the length (column height) of the quadrupole electrodes 741 and 742 in the Z-axis direction.

When effective focal distances of electrostatic lenses served by the quadrupole electrodes 741 and 742 being f1 and f2, respectively, a composite focal distance F (focal distance of block electrode 740) of the two electrostatic lenses may easily be expressed in the following expression (3) using the thin lens approximation.

$$1/F=(1/f1)+(1/f2)-(Ls/f1\cdot f2) \quad (3)$$

Accordingly, using the composite focal distance F determined by the above expression (3), the block electrode 740 may preferably be configured as such optical system that the droplet 201 is imaged at the plasma generation region P202. The electrostatic lenses configured of the quadrupole electrodes 741 and 742 may have an equal focal distance with differing polarities (f=f1=−f2) in each of the X-Z plane (y=0) and the Y-Z plane (x=0).

For example, the initial speed of the droplet 201 in the Z-axis direction may be set to 20 m/s, the particle size of the droplet 201 may be set to 30 μm, the electric charge of the droplet 201 may be set to 2 pC. In accordance with the relationship shown in the expression (1), in the case where V is 500 V, Lb is 5 mm, and L is 10 mm, the effective focal distance (f) of each of the electrostatic lenses (741, 742) may be 50 mm. Accordingly, when Ls is 37.5 mm, the imaging condition of Lb=Lc=150 mm may be satisfied.

Figure 27:
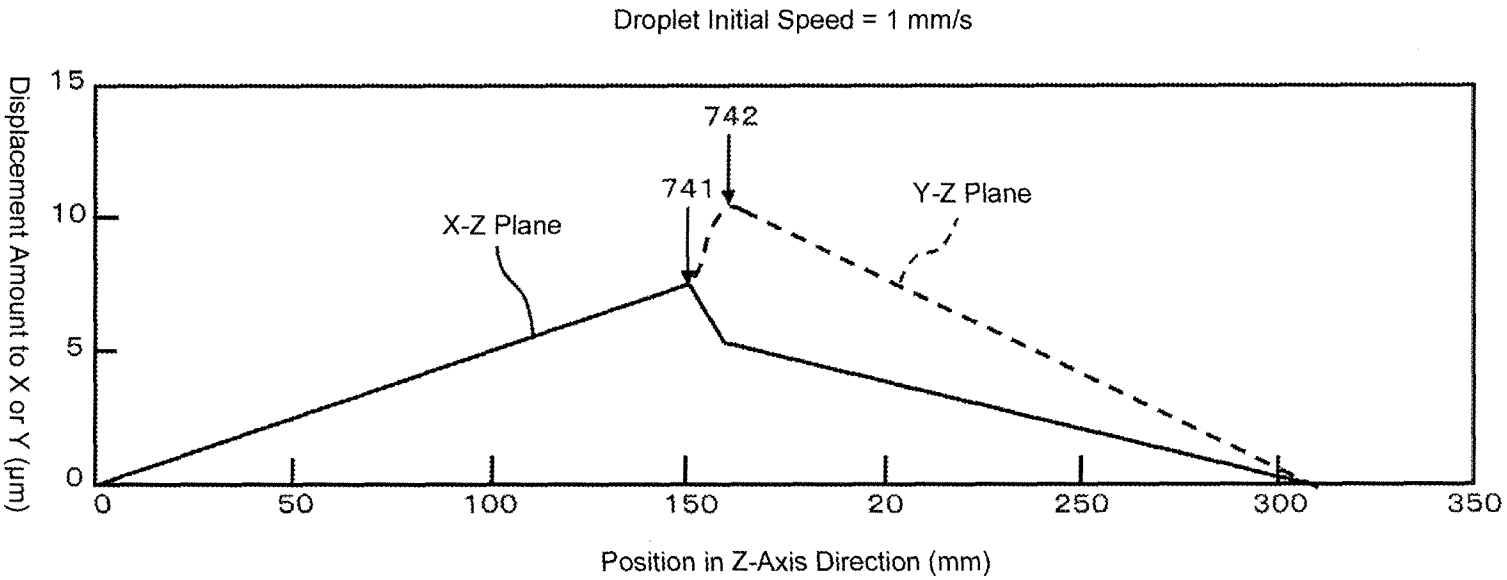
FIG. 27 shows a trajectory of a droplet of a simulation result in the case where the block electrode of the doublet configuration satisfies an imaging condition.
Figure 28:
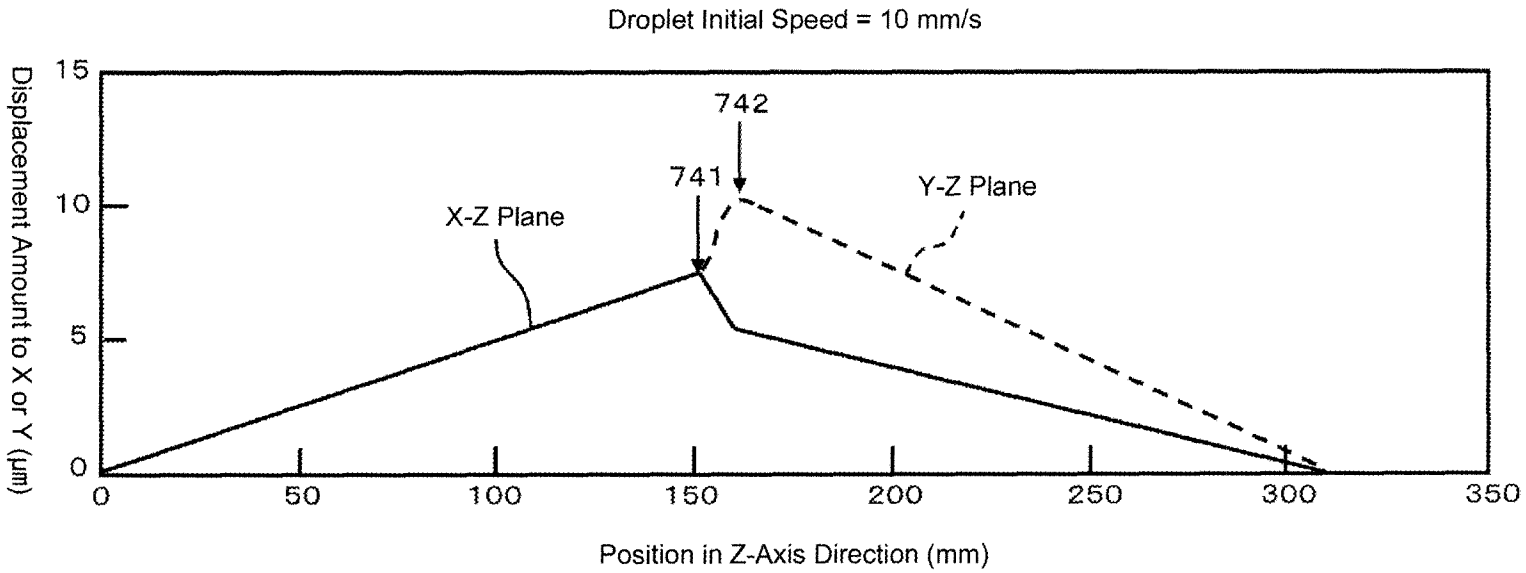
FIG. 28 is shows a result of a simulation similarly to that of FIG. 27.

FIG. 27 and FIG. 28 show the trajectory of the droplet 201 of a simulation result in the case where the block electrode 740 that satisfies the above imaging condition is used. The droplet 201 may have the initial speed in a direction perpendicular to the Z-axis (direction of X-Y plane).

FIG. 27 shows a simulation result where the droplet 201 has the initial speed of 1 mm/s in the direction perpendicular to the Z-axis.

FIG. 28 shows the simulation result where the droplet 201 has the initial speed of 10 mm/s in the direction perpendicular to the Z-axis. As can be seen from FIG. 27 and FIG. 28, regardless of the initial speed in the direction perpendicular to the Z-axis, the trajectories of the droplets 201 may converge to a position where Lc=150 mm.

The embodiment configured in this way may yield similar effects as the tenth embodiment. Further, in this embodiment, since the doublet configuration of the quadrupole electrodes is employed as the position correction unit 700, it is possible to guide the droplet 201 precisely to the plasma generation region P202.

Fourteenth Embodiment

Figure 29:
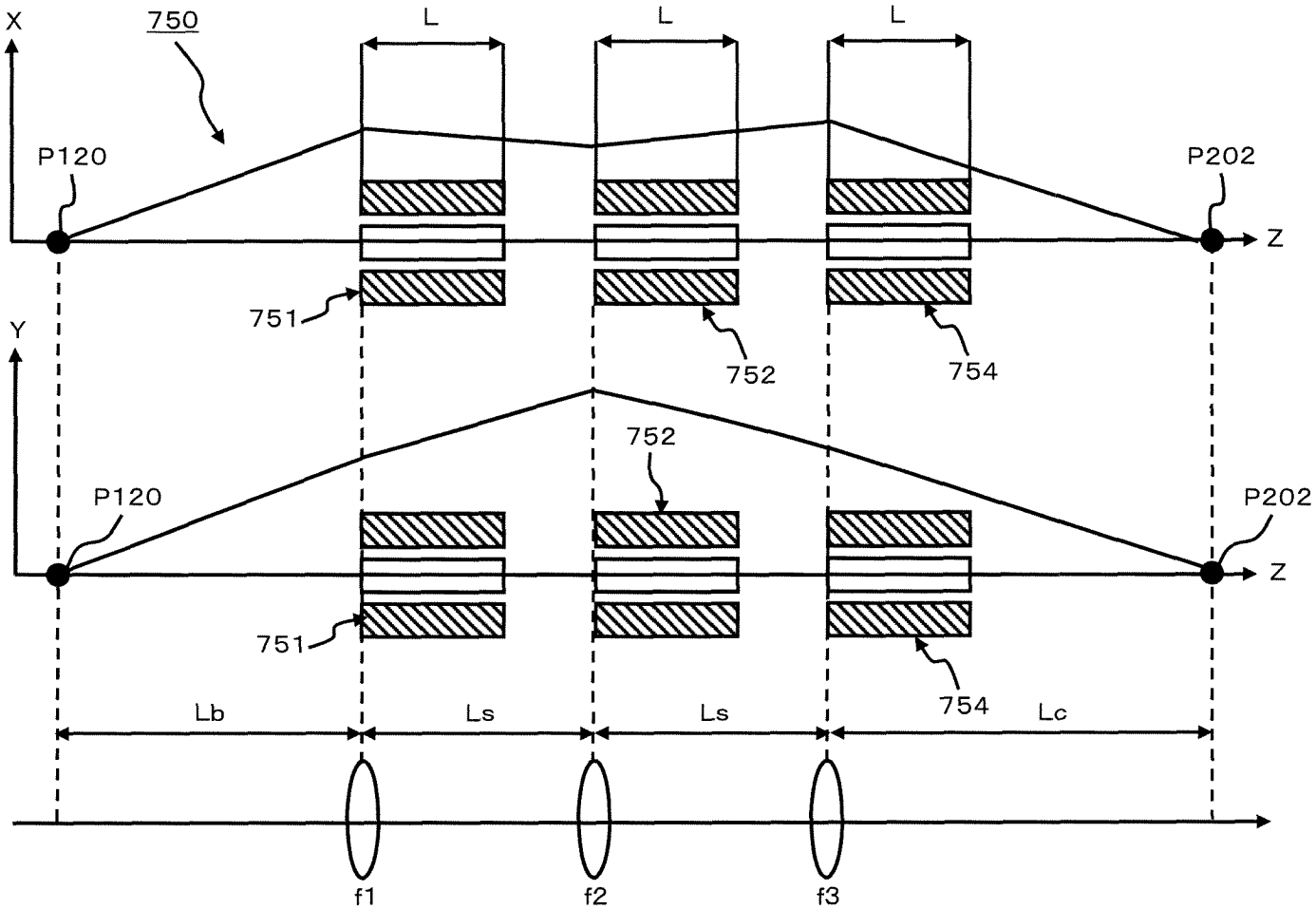
FIG. 29 shows the configuration of electrodes of a position correction unit and a trajectory of a droplet according to a fourteenth embodiment.
Figure 30A:
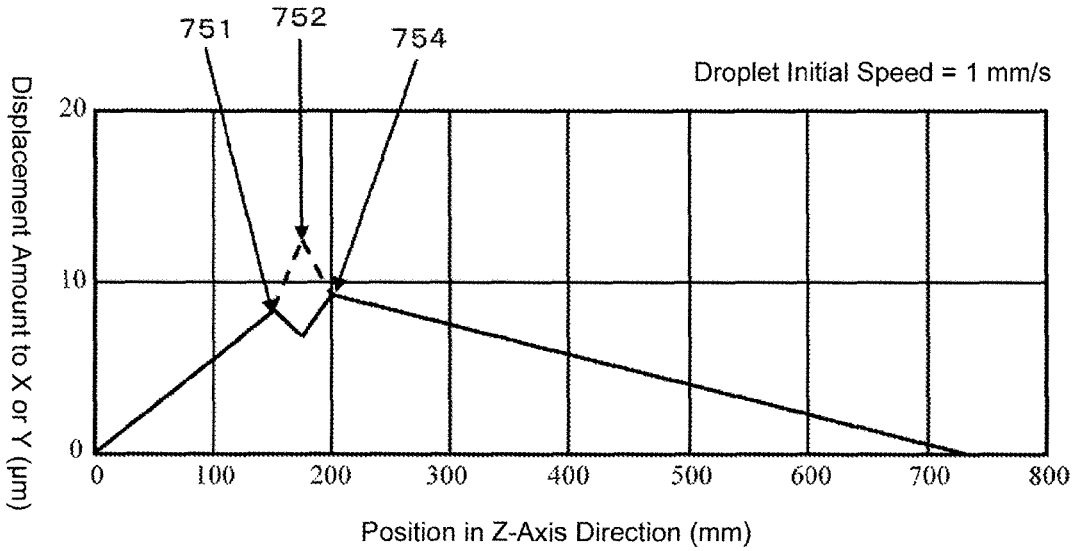
FIGS. 30A and 30B show a trajectory of a droplet of a simulation result in the case where the block electrode of the triplet configuration satisfies an imaging condition.
Figure 30B:
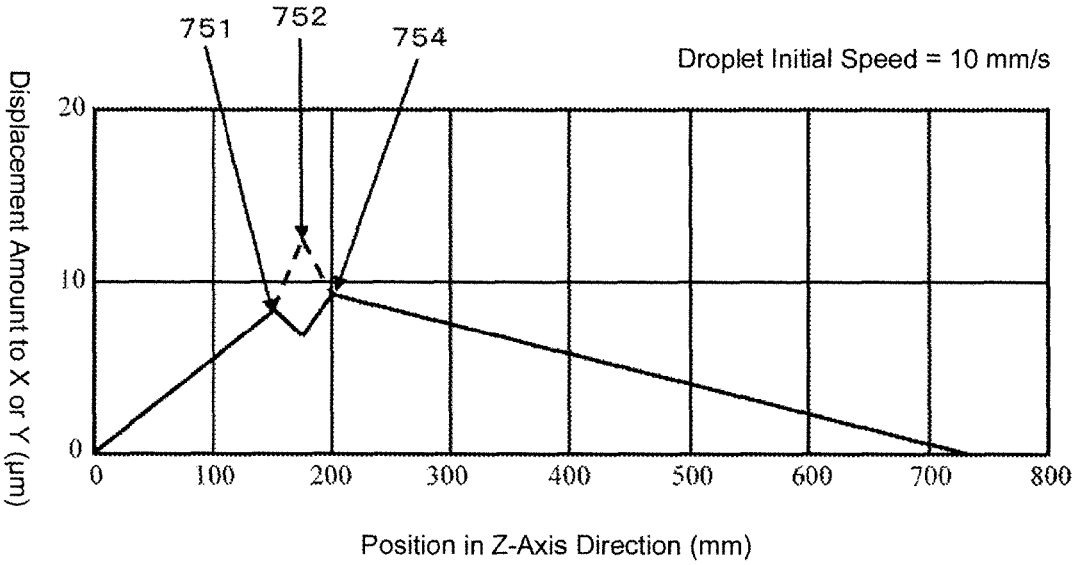

Referring to FIG. 29 through FIG. 30B, a fourteenth embodiment will be described. In this embodiment, a block electrode 750 of the triplet configuration may be used.

As has been shown in FIG. 26 through FIG. 28, the distance Lb between the droplet generation point P120 and the quadrupole electrode 741 may substantially equal to the distance Lc between the quadrupole electrode 742 and the plasma generation region P202 (converging position). Accordingly, in the case of the doublet configuration, by determining the distance Lb, the distance Lc may uniquely be determined. That is, with the block electrode of the doublet configuration, it may difficult to set the distance Lc to a desired value.

On the other hand, in the case of the block electrode 750 of the triplet configuration in which three quadrupole electrodes may be arranged in the Z-axis direction, the distance Lc between a quadrupole electrode 754 of the block electrode to the plasma generation region P202 can be set to a desired value. The configuration of the block electrode 750 of the triplet configuration is shown in FIG. 29. The trajectory of the droplet of the simulation result in the case where the block electrode 750 of the triplet configuration is used is shown in FIGS. 30A and 30B.

The block electrode 750 of this embodiment may be configured such that a first quadrupole electrode 751, a second quadrupole electrode 752, and a third quadrupole electrode 754 are coaxially disposed in the Z-axis direction. The quadrupole electrodes 751, 752, 754 may each be configured of four column electrodes equally spaced in the circumferential direction on the same circle as shown in FIG. 24.

Here, the distance between the quadrupole electrode 751 and the quadrupole electrode 752, and the distance between the quadrupole electrode 752 and the quadrupole electrode 754 may be set to an equal distance Ls. The distance Lb between the droplet generation point P120 and the quadrupole electrode 751 may be set to 150 mm. The electrostatic lenses of the three quadrupole electrodes 751, 752, and 754 may have an equal focal distance with differing polarities (f=f1=−f2=f3) in each of the X-Z plane (y=0) and the Y-Z plane (x=0).

With a tin droplet, the case where the initial speed of the droplet 201 in the Z-axis direction is 18 m/s, the particle size of the droplet 201 is 30 μm, the electric charge of the droplet 201 is 2 pC will be described. In this case, in accordance with the relationship shown in the expression (1), when V is set to 330 V, Lb is set to 5 mm, and L is set to 10 mm, regardless of the initial speed in the direction perpendicular to the Z-axis, the droplet 201 may converge at a point distanced approximately by 725 mm from the droplet generation point P120, as shown in FIGS. 30A and 30B.

As has been described above, with the doublet configuration shown in FIG. 24, it is difficult to change the distance Lb between the droplet generation point P120 to the converging point P202 (plasma generation region) of the droplet trajectory. However, with the triplet configuration according to this embodiment, regardless of the distance Lb between the droplet generation point P120 and the block electrode 750, the distance Lc between the block electrode 750 and the droplet trajectory converging point P202 (plasma generation region) can be set to a desired value. The distance Lc can be set to a desired value by optimizing an electrode potential.

The embodiment configured in this way may yield similar effects as the tenth embodiment. Further, since the distance Lc between the block electrode 750 and the plasma generation region P202 can be set to a desired value by adjusting the electrode potential in this embodiment, greater flexibility in design may be achieved.

Fifteenth Embodiment

Figure 31A:
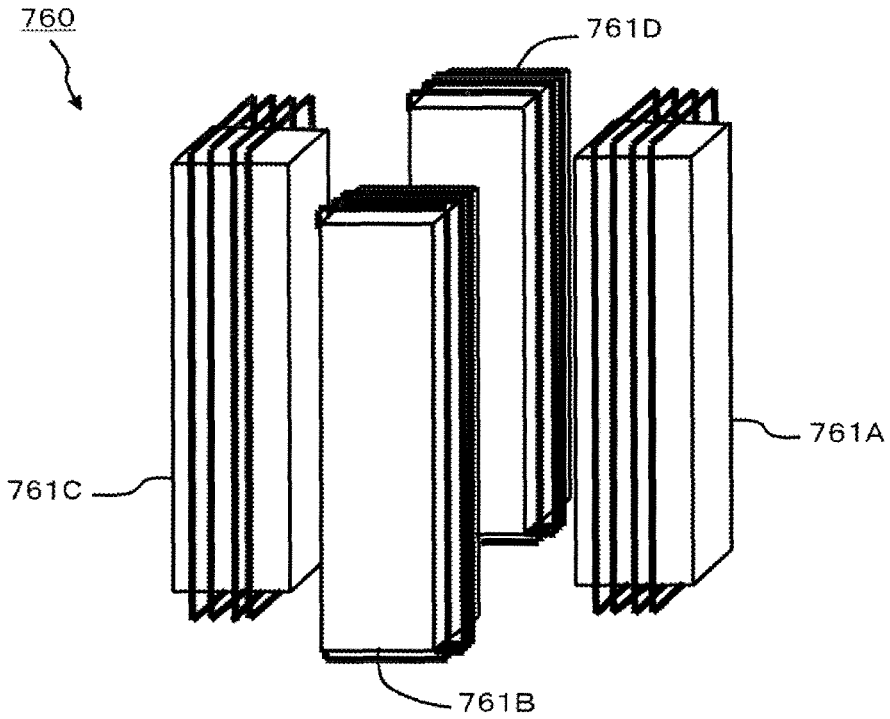
FIGS. 31A and 31B illustrate the configuration of magnetic blocks of a position correction unit according to a fifteenth embodiment.
Figure 31B:
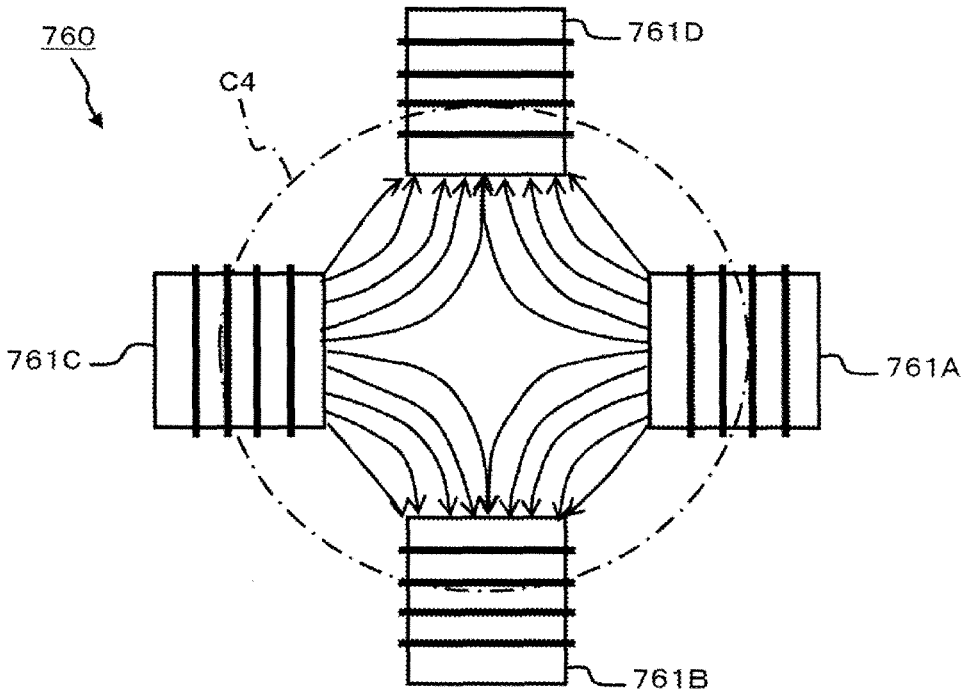

Referring to FIGS. 31A and 31B, a fifteenth embodiment will be described. In the tenth through fourteenth embodiments, the trajectory of the charged droplet 201 may be made to converge at the plasma generation region P202 with the electric field. In this embodiment, the trajectory of the charged droplet 201 may be made to converge at the plasma generation region P202 with the magnetic field. In this embodiment, a magnet may preferably be used as the position correction unit 700.

FIGS. 31A and 31B show an example of a magnetic block 760 which can be employed as the position correction unit 700. The magnetic block 760 according to this embodiment may be configured of a plurality of magnets 761A through 761D. FIG. 31A is a perspective view of the magnetic block 760. The magnetic block 760 may be constituted by four rectangular parallelepiped magnets 761A through 761D of an identical shape. FIG. 31B is a plan view of the magnetic block 760. Each of the magnets 761A through 761D may be a permanent magnet, an electromagnet, or the like.

The magnets 761A through 761D may preferably be spaced equally on a circumference of a circle C4 of a predetermined radius. Further, the magnets 761A through 761D may preferably be in parallel to one another with one side surface (inner surface) of each of the magnets 761A through 761D being arranged to face the center of the circle C4. That is, inner surfaces of the pairs of facing magnets 761A and 7610, and 761B and 761D may preferably be substantially parallel to each other. Further, the magnets 761A through 761D may preferably disposed such that the center of the circle C4 coincides with the ideal trajectory R.

The facing magnets 761A and 761C, and 761B and 761D should be arranged such that each facing surface may have the same polarity. Further, for example, with respect to the inner surface of the magnet 761A, the inner surfaces of the adjacent magnets 761B and 761D may preferably have the reversed polarity. That is, with reference to FIGS. 31A and 31B, it may be preferable that the facing surfaces of the magnets 761A and 761C are the N-pole and the facing surfaces of the magnets 761B and 761D are the S-pole. As a result, the magnetic force lines may have such distribution that they extend from the magnets 761A and 761C toward the magnets 761B and 761D, as shown in FIG. 31B.

When the charged droplet 201 enters the magnetic field generated by the above magnet block 760, the Lorentz force may work on the droplet 201. With this, the trajectory of the droplet 201 may be deflected. The direction of the Lorentz force that may work on the droplet 201 may be inclined 45 degrees with respect to the X-axis and the Y-axis, unlike the above-described quadrupole electrode. However, this embodiment is similar to the above embodiments where the electric field is used in that the droplet 201 may be guided to the plasma generation region P202 with the force of the magnetic field generated by the magnet block 760. Accordingly, even when the magnetic block 760 is used in place of an electrode as in this embodiment, similar effects as the tenth embodiment may be obtained.

Sixteenth Embodiment

Figure 32:
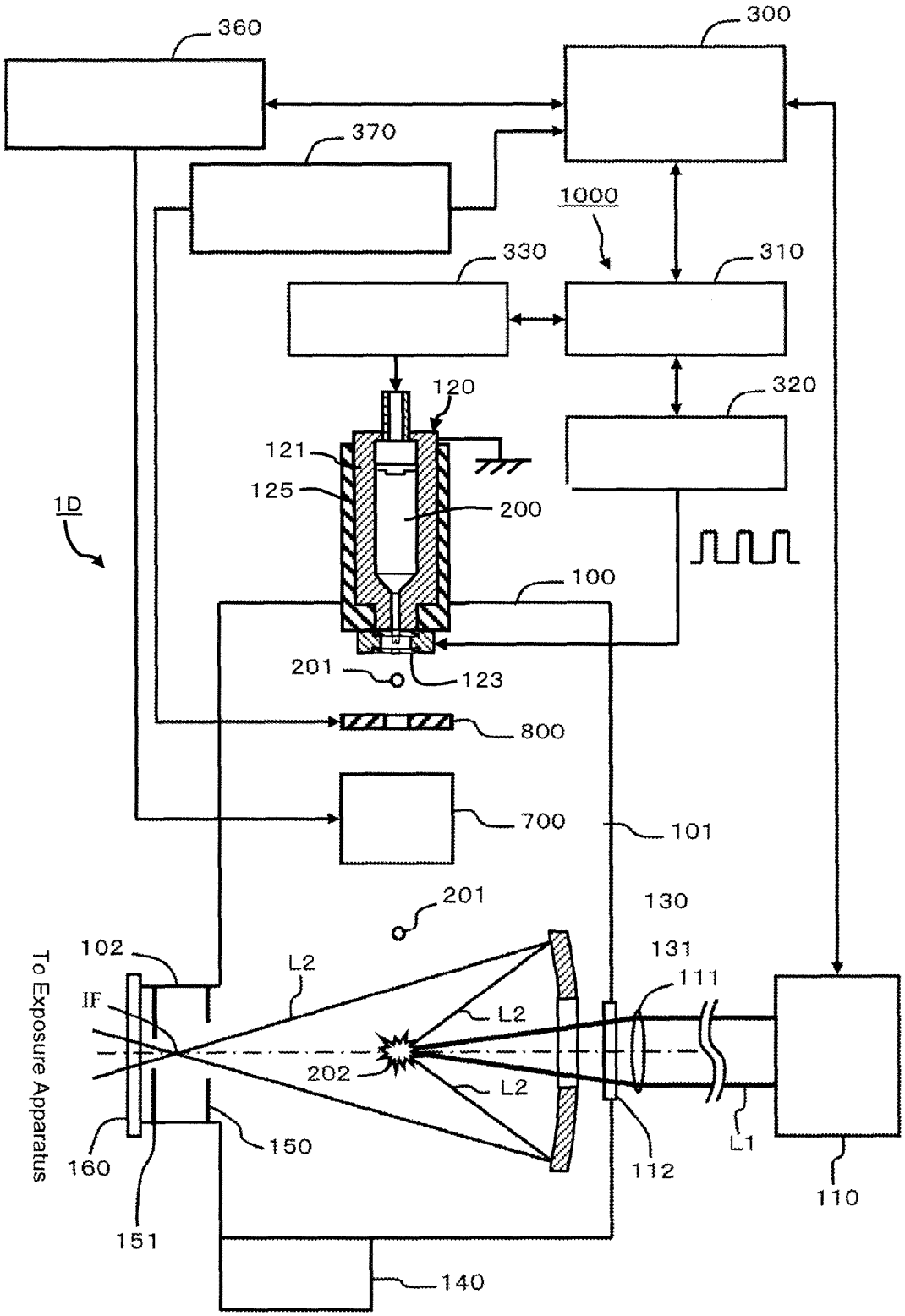
FIG. 32 illustrates the configuration of an EUV light source apparatus according to a sixteenth embodiment.
Figure 33:
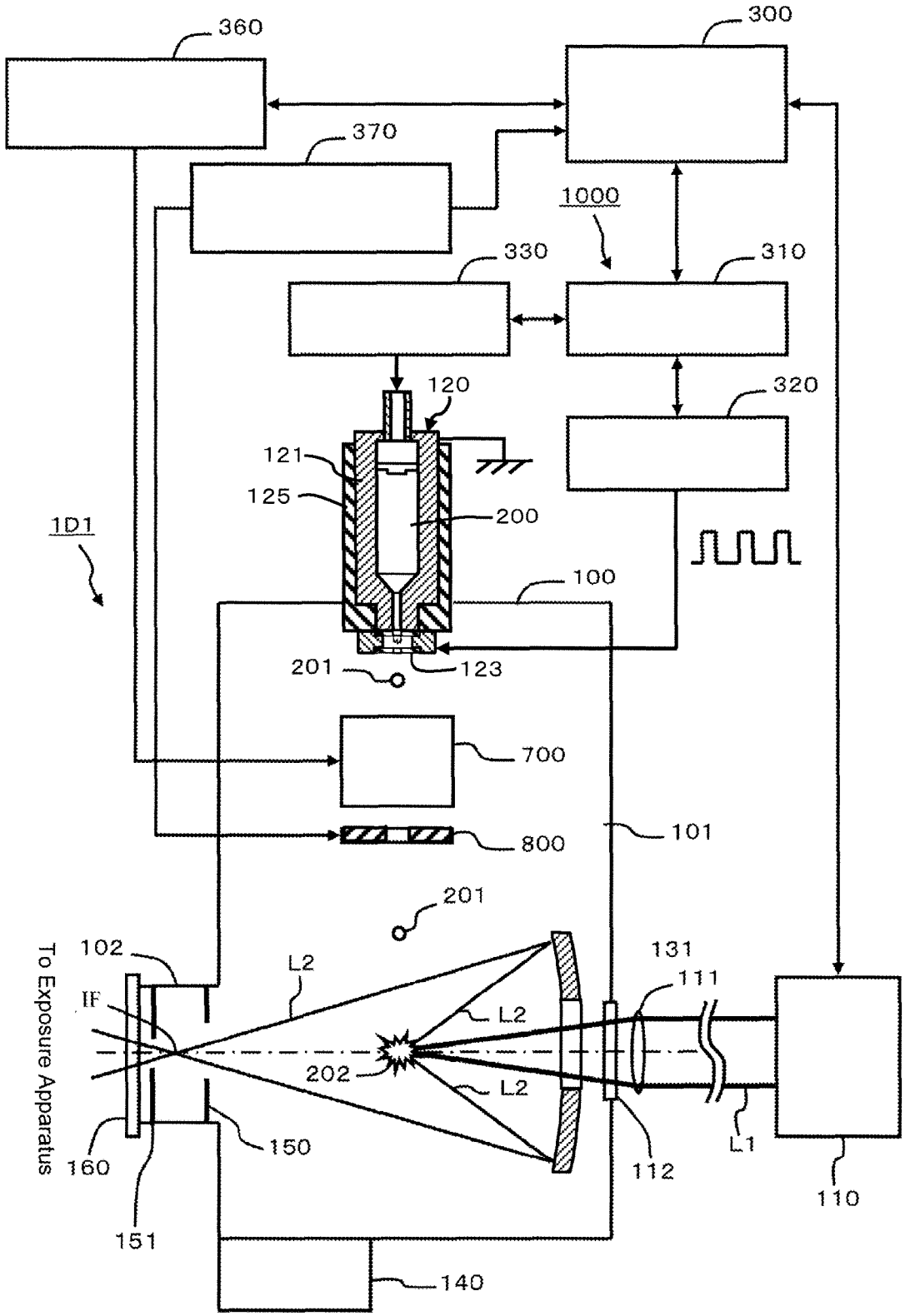
FIG. 33 illustrates the configuration of an EUV light source apparatus according to a modification.

Referring to FIG. 32 and FIG. 33, a sixteenth embodiment will be described. In this embodiment, in addition to the position correction unit 700, an acceleration unit may further be provided. The acceleration unit may include at least one acceleration electrode 800 and one acceleration controller 370 for applying a predetermined potential to the acceleration electrode 800. The acceleration controller 370 may be operated by an instruction from the EUV light source controller 300.

The acceleration electrode 800 may preferably be formed into a circular plate having a circular hole therein, for example. The droplet 201 may be accelerated with the electric field generated by the acceleration electrode to which the predetermined potential is applied. The accelerated droplet 201 may pass through the position correction unit 700 and reach the plasma generation region P202.

Even with the embodiment configured in this way, since the droplet 201 may be accelerated with the electric field generated by the acceleration electrode 800, the distance between the droplets 201 can be increased. Accordingly, a droplet 201 may be prevented from being affected by a preceding droplet 201 at the plasma generation region P202.

Note that even though a case where the acceleration electrode 800 is provided between the target output unit 120 and the position correction unit 700 is shown in FIG. 32, the configuration may be such that the acceleration electrode 800 is provided between the position correction unit 700 and the plasma generation region P202 as shown in FIG. 33.

Seventeenth Embodiment

Figure 34:
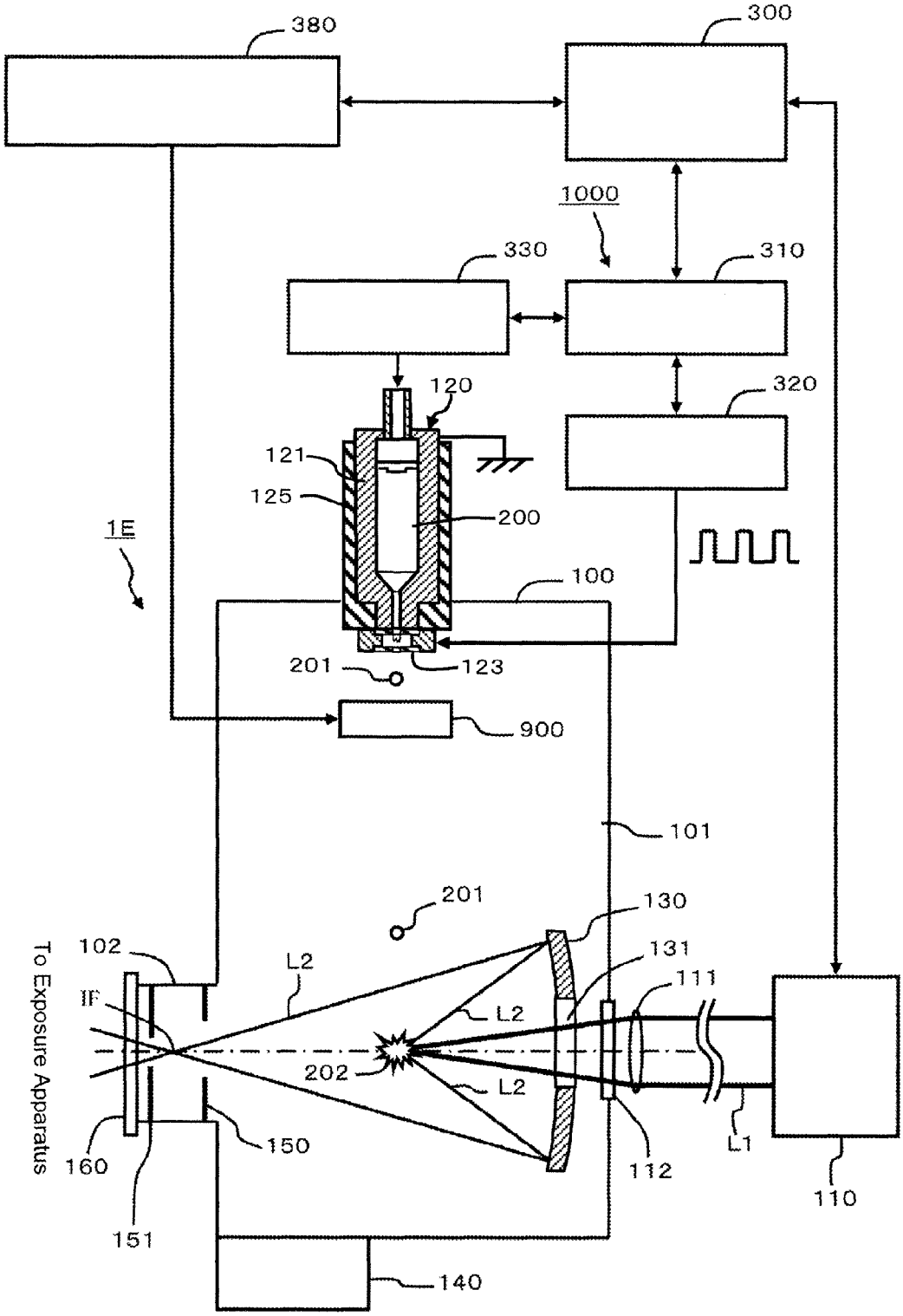
FIG. 34 illustrates the configuration of an EUV light source apparatus according to a seventeenth embodiment.

Referring to FIG. 34 through FIG. 36B, a seventeenth embodiment will be described. An EUV light source apparatus 1E according to this embodiment may comprise a unit 900 for acceleration and position correction. FIG. 34 shows the general configuration of the EUV light source apparatus 1E according to this embodiment. FIG. 35A is a sectional view of the unit 900.

The acceleration and position correction unit 900 may, in cooperation with the electrode unit 123 of the target output unit 120, cause the droplet 201 to be accelerated and further the position (trajectory) of the droplet 201 to be corrected. To the acceleration and position correction unit 900, a predetermined potential may preferably be applied by an acceleration and position correction controller 380. The acceleration and position correction controller 380 may preferably operate in accordance with an instruction from the EUV light source controller 300.

Figures 35A, 35B:
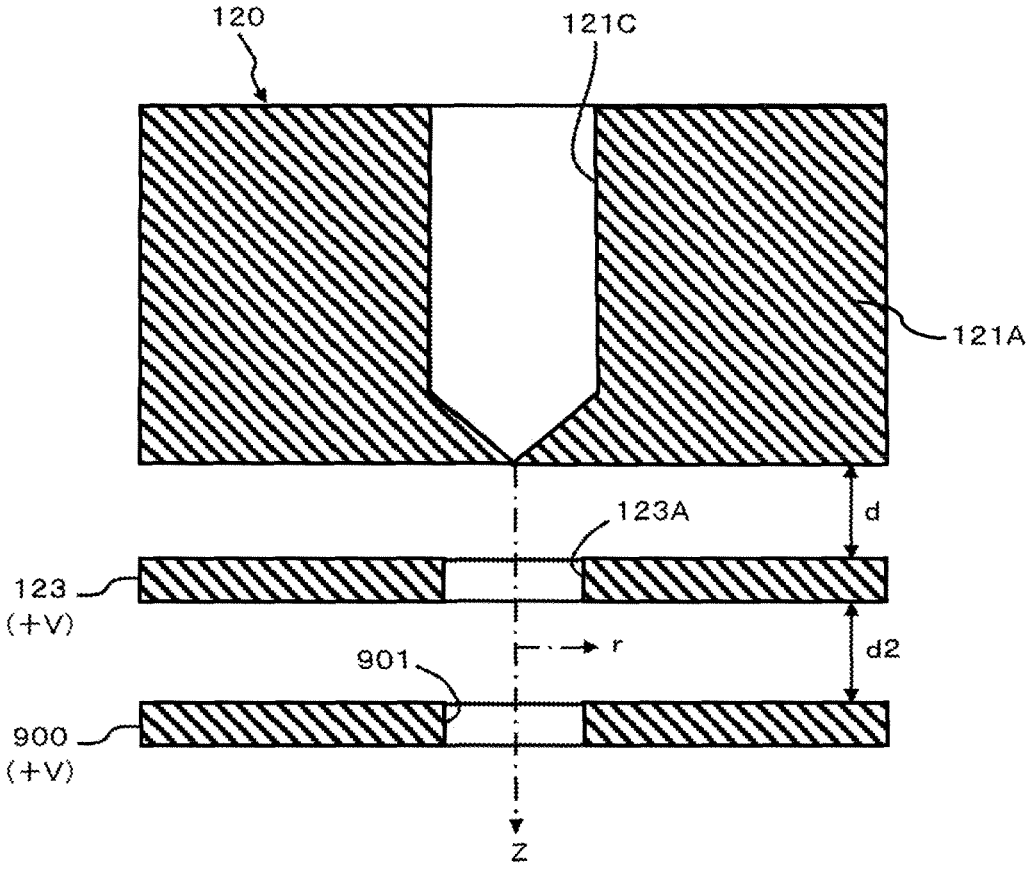
FIG. 35A schematically illustrates a relationship among a target output unit, a pull-out electrode, and an acceleration electrode.
FIG. 35B is an expression representing the relationship.

As shown in the sectional view in FIG. 35A, the acceleration and position correction unit 900 may preferably be configured as a circular plate electrode having a circular hole 901 formed therein, for example. Below, for the sake of simplicity, the acceleration and position correction unit 900 may be called the acceleration electrode 900 in some cases.

The acceleration electrode 900 may preferably be disposed with a predetermined distance d2 provided from the electrode unit 123 and with the center thereof coinciding with the center of the electrode unit 120. A predetermined positive potential may preferably be applied to each of the electrode unit 123 and the acceleration electrode 900. With this, the electrode unit 123 and the droplet acceleration electrode 900, together as a whole, may function as an electrostatic lens.

A trajectory of a charged particle in an electrostatic field may be determined by the potential distribution in a region in which the charged particle may move. In the case of a laser beam of which the beam profile is axially symmetric, the potential distribution in a region close to the axis of the beam may be expressed by the potential distribution at the axis. Accordingly, the properties of the lens may be described only with the information on the potential at the axis (one-dimensional potential information).

The reason for the above is that three-dimensional information of the potentials may be interconnected by the Laplace expression, and each is not independent but correlated. An expression that may express a trajectory of a charged particle close to the axis only with the potential distribution at the axis may be called the paraxial trajectory expression.

The paraxial trajectory expression may be the expression shown in FIG. 35B, when using a cylindrical coordinate system having a cylindrically symmetric circular cross-section in which the axis in the travel direction is the z-coordinate, a radial direction is the r-coordinate, and there is no change in the θ direction. In the expression, V(z,r) may represent a potential in the coordinates (z, r).

$$\frac{d^2 r}{dz^2} + \frac{1}{2V(z,0)}\frac{dV(z,0)}{dz}\frac{dr}{dz} + \frac{1}{{}_{20}4V(z,0)}\frac{d^2 V(z,0)}{dz^2} r = 0 \qquad \text{Expression 1}$$

Figures 36A, 36B:
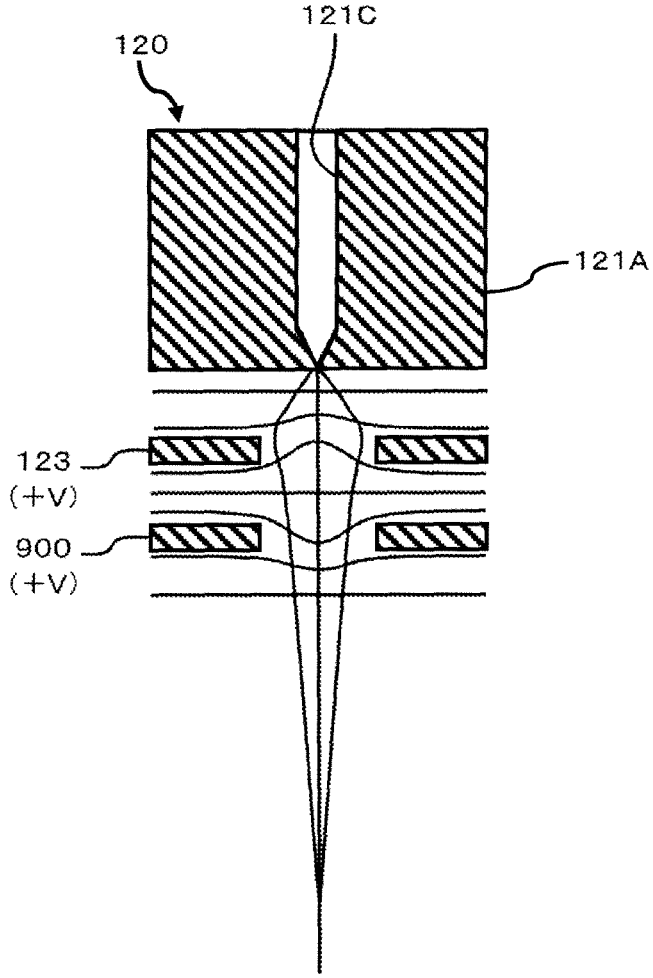
FIG. 36A shows the distribution of potentials at each electrode.
FIG. 36B shows a relationship between electric fields generated with the electrodes.

FIG. 36A shows a relationship between the electric field generated with the electrodes 123 and 900 and the trajectory of the droplet 201 passing therethrough. With the paraxial trajectory expression shown in Expression 1, the focal point of the electrostatic lens may be determined.

The range in which the electric field generated by the electrodes is between z1 to z2. The distance between z1 and z2 is short; a value r0 of the trajectory of the charged particle in the r-direction is substantially unchanged between z1 and z2; and only the slope thereof changes. The focal distance f2 in the case where the charged droplet 201 enters the electric field in the direction parallel to the Z-axis from the electrode unit 123 of the target output unit 120 can be obtained from the following expression.

$$\frac{1}{f2} = \frac{1}{4\sqrt{V(z2,0)}}\int_{z1}^{z2}\frac{1}{\sqrt{V(z,0)}}\frac{d^2 V(z,0)}{dz^2}dz \qquad \text{Expression 2}$$

When the focal distance is a positive value, the electric field may function as a converging lens. When the focal distance is a negative value, the electric field may function as a diverging lens. Accordingly, in order to make the droplet 201 converge at the plasma generation region P202, the potential distribution may preferably be such that the focal distance shown in Expression 2 is a positive value.

The embodiment configured in this way may yield similar effects as the tenth embodiment. Further, in this embodiment, the electrostatic lens may be configured of the electrode unit 123 to which a potential is applied to cause the droplet 201 to be pulled out through the nozzle unit 122 and the electrode 900 to which a potential is applied to cause the pulled-out droplet 201 to be accelerated. Accordingly, with this embodiment, compared to the configurations shown in FIG. 32 and FIG. 33, the configuration can be simplified and the production cost may be reduced.

Although the case where a single acceleration electrode is used, the embodiment is not limited thereto, and the configuration may be such that two or more acceleration electrodes are provided. When two or more acceleration electrodes are used, the potential distribution may preferably be such that the focal distance is a positive value. Further, in this embodiment, the case where positive potentials are applied respectively to the electrodes 123 and 900, but the configuration may be such that negative potentials are applied thereto.

Eighteenth Embodiment

Figure 37:
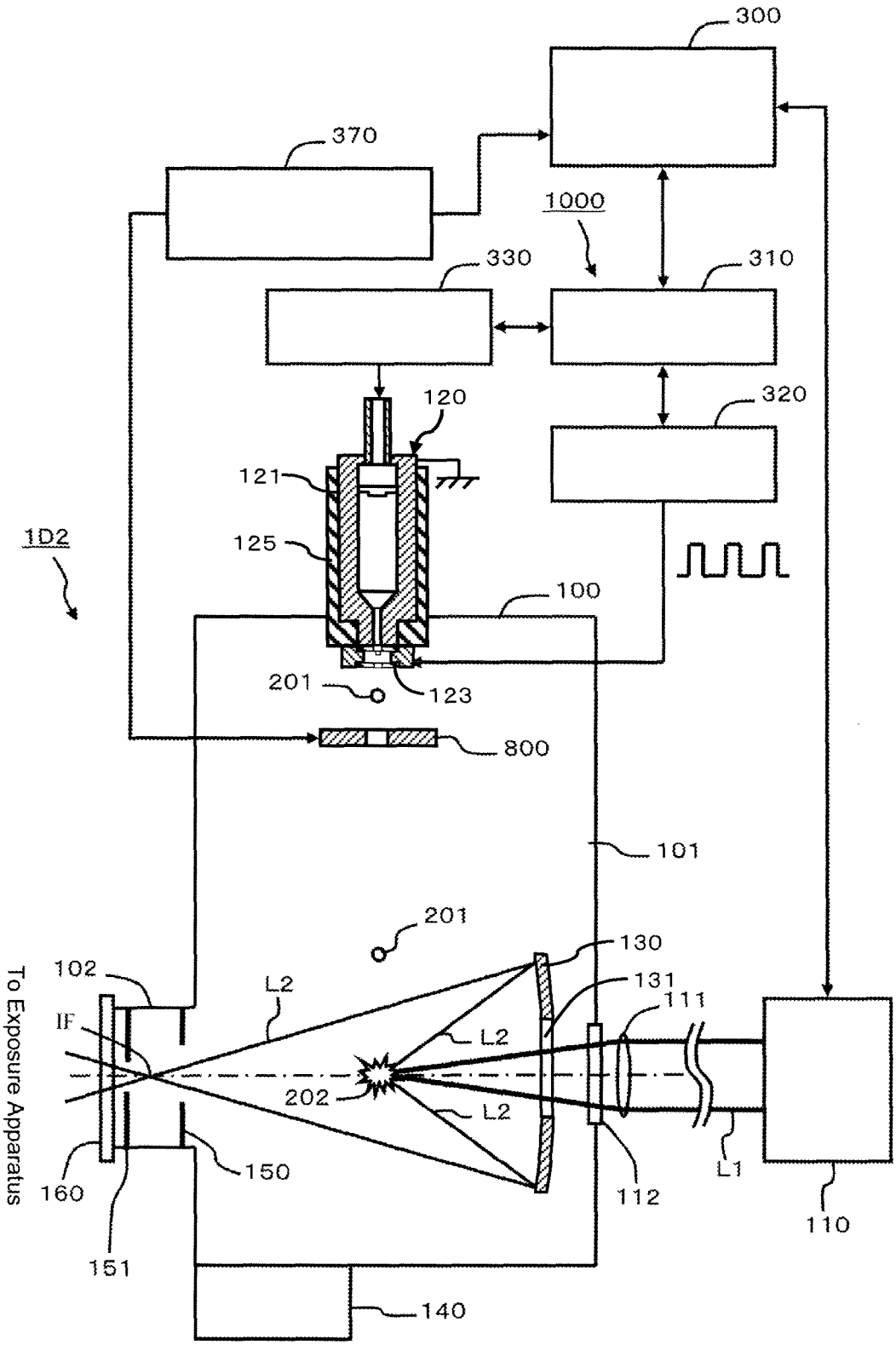
FIG. 37 illustrates the configuration of an EUV light source apparatus according to an eighteenth embodiment.

Referring to FIG. 37, an eighteenth embodiment will be described. FIG. 37 is a descriptive view illustrating the general configuration of an EUV light source apparatus 1D2. In this embodiment, the position correction unit 700 may be omitted from the configuration shown in FIG. 32 or FIG. 33. In this embodiment, only an acceleration unit for accelerating the droplet 201 outputted from the target output unit 120 toward the plasma generation region P202 may be provided.

The acceleration unit may include, as in the sixteenth embodiment, at lease one acceleration electrode 800 and an acceleration controller 370 for applying a predetermined potential to the acceleration electrode 800. The acceleration controller 370 may preferably be operated with an instruction from the EUV light source controller 300.

The embodiment configured in this way may yield similar effects as the first embodiment. In this embodiment as well, the droplet 201 can be accelerated with electric field generated by the acceleration electrode 800. Thus, the distance between the droplets 201 can be increased. Accordingly, a droplet 201 may be prevented from being affected by a preceding droplet 201 at the plasma generation region P202.

Nineteenth Embodiment

Figure 38:
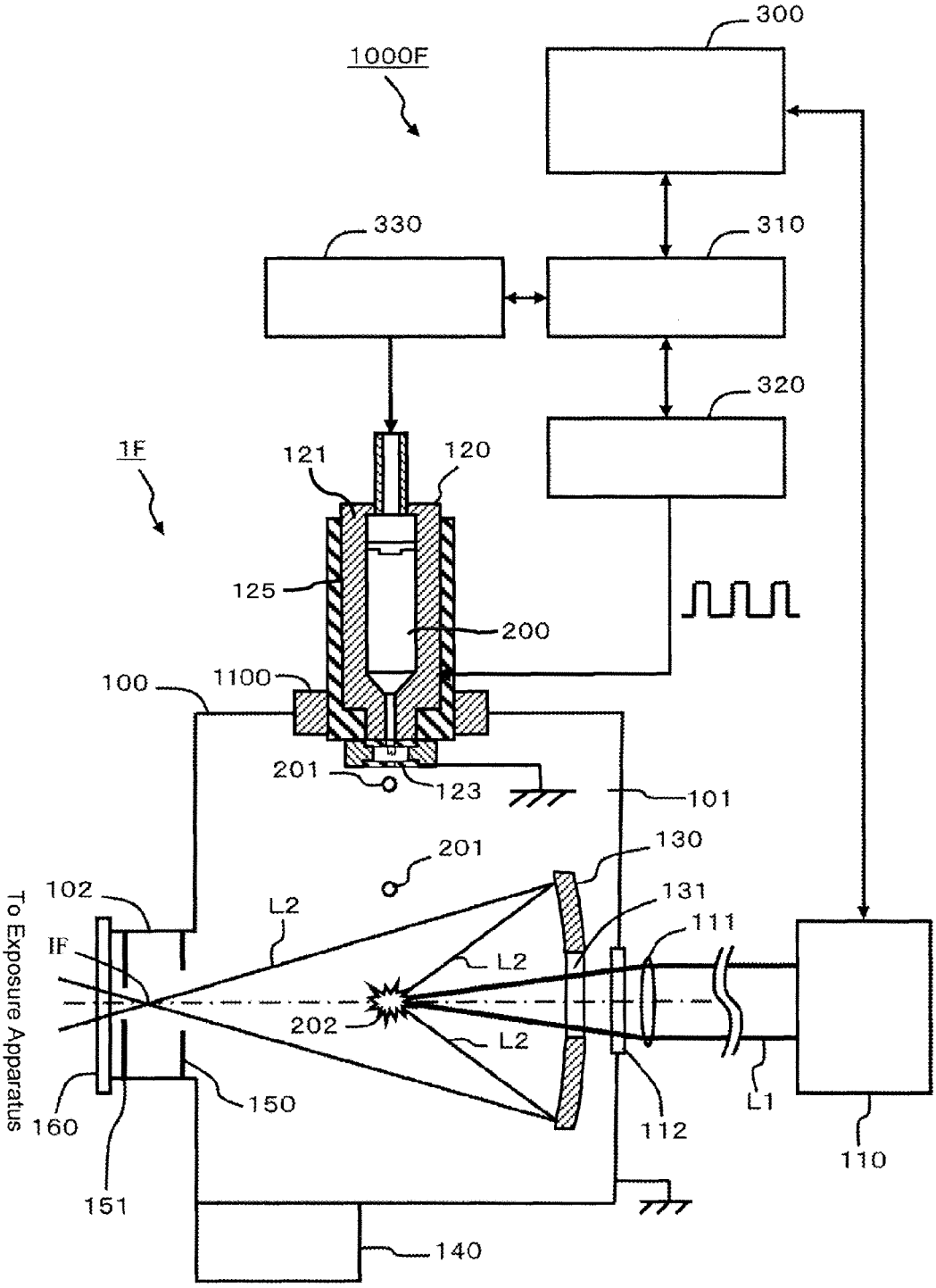
FIG. 38 illustrates the configuration of an EUV light source apparatus according to a nineteenth embodiment.
Figure 39:
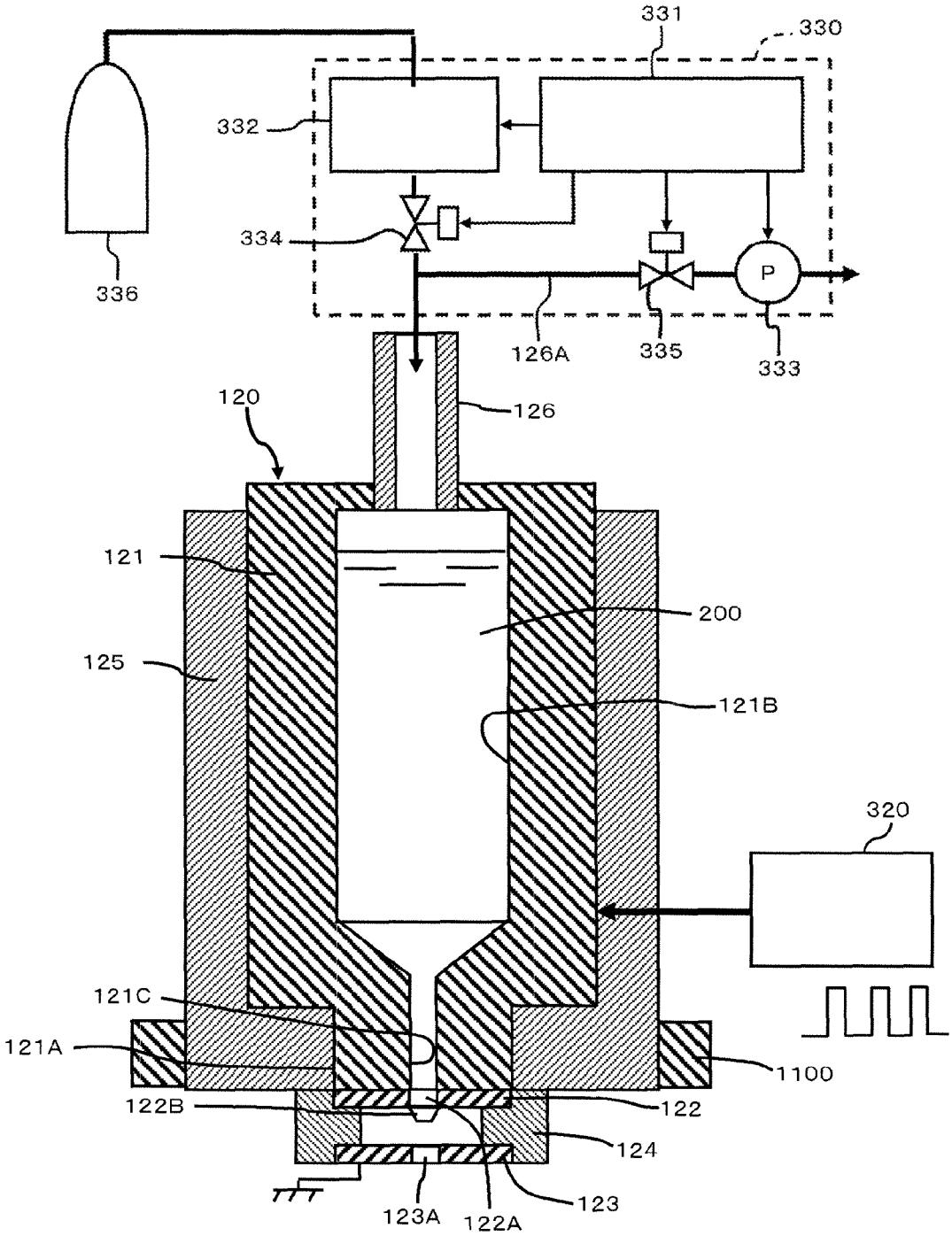
FIG. 39 illustrates a target output unit according to the nineteenth embodiment.

Referring to FIG. 38 and FIG. 39, a nineteenth embodiment will be described. In the following several embodiments including the nineteenth embodiment, a high potential may be applied to the target material 200 inside the target output unit 120, and the electrode unit 123 and the chamber 100 may be grounded. FIG. 38 is a descriptive view illustrating the general configuration of an EUV light source apparatus 1F. FIG. 39 illustrates the configurations of the target output unit 120 and the pressure control unit 330.

The configuration of this embodiment may differ from the configuration of the first embodiment in that high potential pulses may be applied to the target output unit 120 from the pulse control unit 320. Accordingly, in this embodiment, an electrical insulator 1100 may preferably be disposed between the chamber 100 and the target output unit 120. The pulsed potential may either be a positive or negative high potential pulse signal.

The insulator 1100 may electrically insulate between the target output unit 120 and the chamber 100, and maintain the airtightness of the chamber 100. Further, the insulator 1100 may preferably be formed of a material having a heat-insulating property and a heat-resistant property against the target material 200. In consideration of the above, the insulator 1100 may preferably constitute by alumina ($Al_2O_3$), silica, or synthetic quartz ($SiO_2$), for example.

In this embodiment, the chamber 100 and the electrode unit 123 may be grounded. Note that the chamber 100 and the electrode unit 123 being grounded does not necessarily mean that they are set to the ground potential.

When the pulsed potential is applied to the main body 121 from the pulse control unit 320, the target material 200 at the tip of the nozzle 122B may be charged via the main body 121. The target material 200 to which the high potential is applied may be pulled out through the tip of the nozzle 122B with the electrostatic attraction force that may work between the target material 200 and the electrode unit 123, thereby being turned into the droplet 201. The droplet 201 may be accelerated in one direction along a path (in electric field) leading to the electrode unit 123 from the nozzle 122B.

The droplet 201, being accelerated, may increase its speed, and the distance between the droplets 201 may increase. In this embodiment, as has been described above, high potential pulses may be applied to the target material 200 inside the main body 121, and the electrode unit 123 may be grounded. The chamber 100, as well as the components inside the chamber 100, may be grounded. Accordingly, the potential of the electrode unit 123 and the potentials of the chamber 100 and the components inside the chamber 100 may substantially be the same, and thus the potential difference may hardly exist therebetween. Therefore, the droplet 201 having passed through the electrode unit 123 may head toward the plasma generation region P202.

In the embodiment shown in FIG. 38 and FIG. 39, the configuration may be such that predetermined pressure is applied to the target material 200 inside the main body 121 by the pressure control unit 330. This embodiment, however, may be applied to the configuration in which the pressure is not applied to the target material 200.

Twentieth Embodiment

Figure 40:
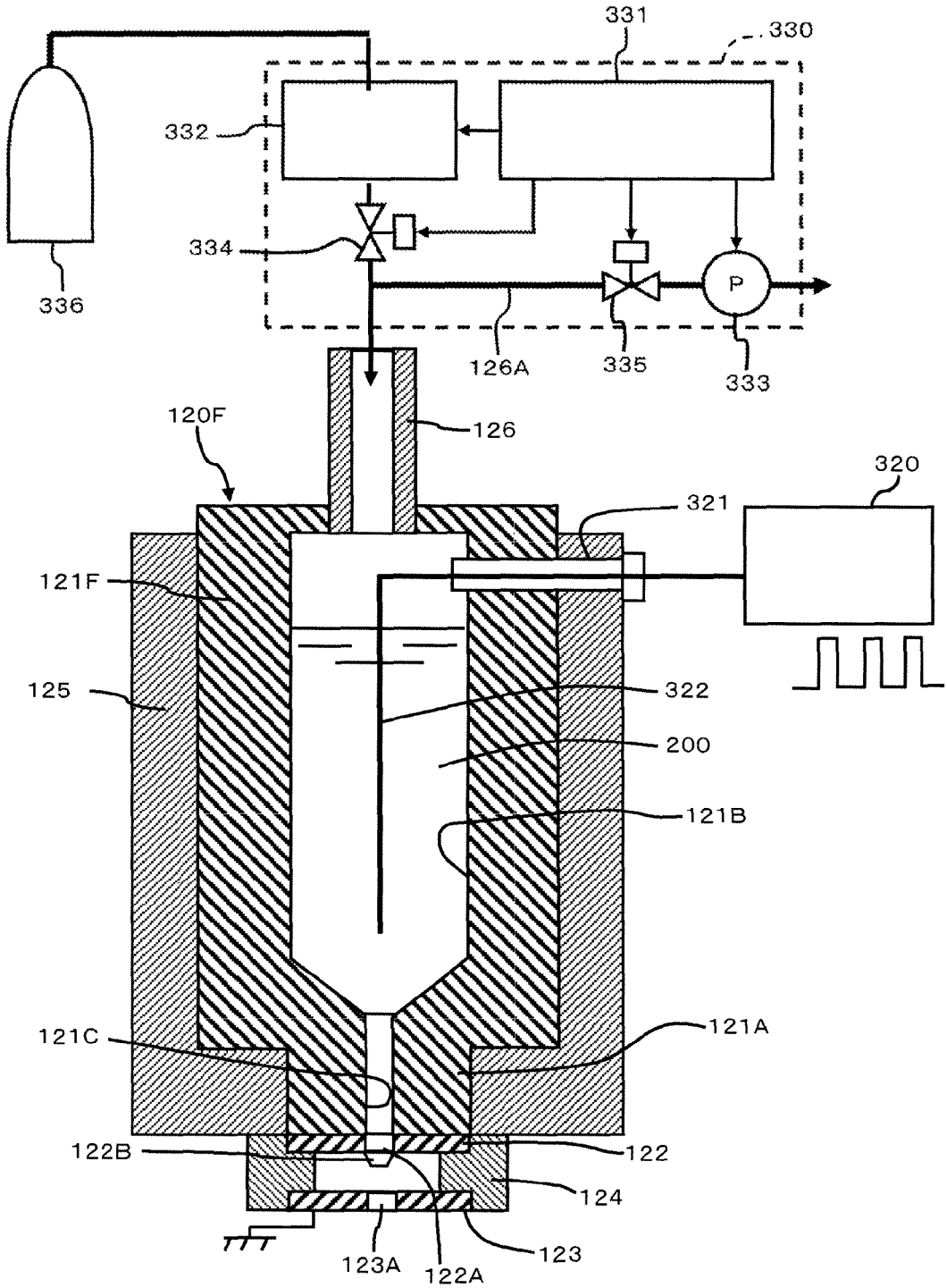
FIG. 40 illustrates a target output unit according to a twentieth embodiment.

Referring to FIG. 40, a twentieth embodiment will be described. In this embodiment, a main body 121F of a target output unit 120F may preferably be formed of an electrically insulating material ($Al_2O_3$, AlN, or the like). Accordingly, the insulator 1100 required in the nineteenth embodiment may not be required in this embodiment.

In this embodiment, at least one feedthrough 321 may preferably be provided so as to pass through the heating unit 125 and the main body 121F in the radial direction of the target output unit 120F. The feedthrough 321 is a terminal for introducing electric current. The feedthrough 321 may be formed, into a cylindrical shape, of an insulating material such as ceramics or the like, for example.

The trailing end of a conductive wire 322 may be connected to the pulse control unit 320. The leading end of the conductive wire 322 may preferably be inserted into the main body 121F via the feedthrough 321. The leading end of the conductive wire 322 may extend toward the leading end of the main body 121F. The pulse control unit 320 may apply high potential pulses to the target material 200 via the conductive wire 322.

The embodiment configured in this way may yield similar effects as the nineteenth embodiment. Further, according to this embodiment, the pulsed potential may directly be applied to the target material 200 without the main body 121F intervening therebetween. Thus, the insulator 1100 may not be required, and the configuration may be simplified.

Although only one feedthrough 321 is illustrated in FIG. 40, the feedthrough 321 may be disposed in plurality.

Twenty-First Embodiment

Figure 41:
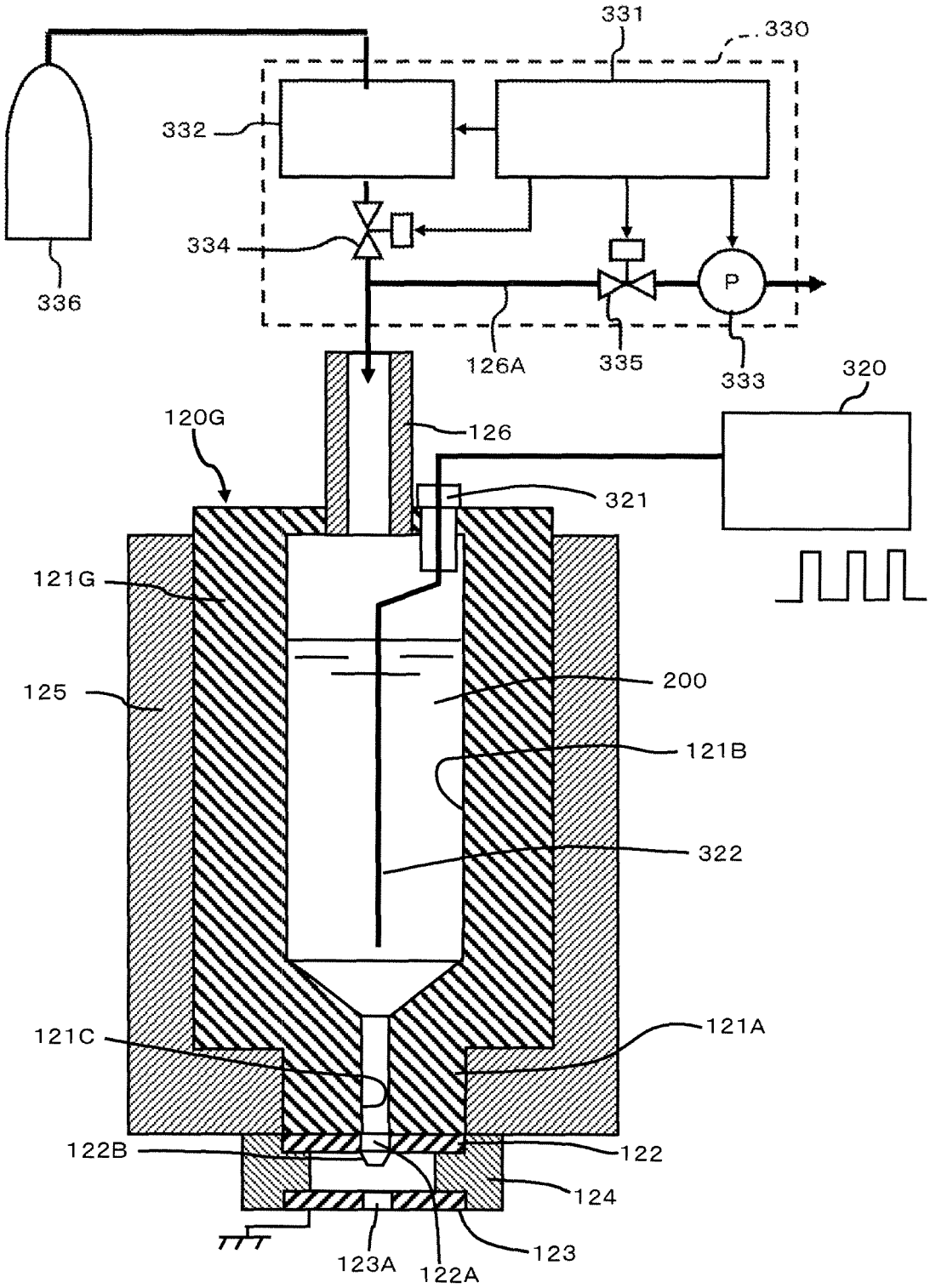
FIG. 41 illustrates a target output unit according to a twenty-first embodiment.

Referring to FIG. 41, a twenty-first embodiment will be described. This embodiment may include many components that are common to the twentieth embodiment. A main body 121G may be formed of an electrically insulating material, as in the twentieth embodiment. However, the feedthrough 321 of this embodiment may be provided so as to pass only through the main body 121G. The feedthrough 321 may preferably be inserted, for example, through the ceiling part of the main body 121G toward the nozzle unit 122. The feedthrough 321 of this embodiment may not pass through the heating unit 125.

The embodiment configured in this way may yield similar effects as the twentieth embodiment. Further, in this embodiment, since the feedthrough 321 may be provided so as to pass only through the main body 121G, the configuration can be made simpler than that of the twentieth embodiment.

Twenty-Second Embodiment

Figure 42:
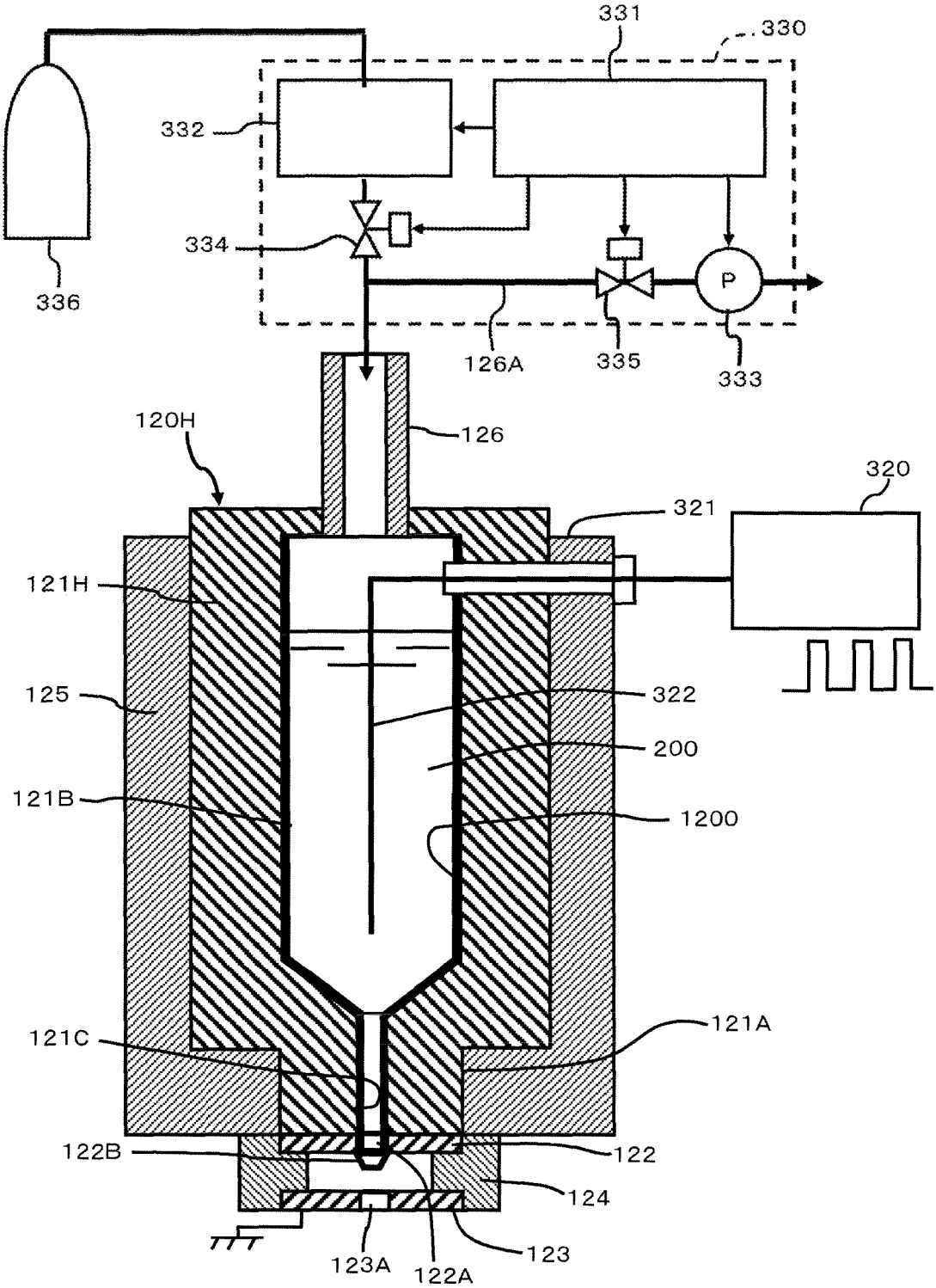
FIG. 42 illustrates a target output unit according to a twenty-second embodiment.

Referring to FIG. 42, a twenty-second embodiment will be described. This embodiment may include many components that are common to the twentieth embodiment. However, in this embodiment, an insulator 1200 may be provided by coating an inner surface of the container 121B of a main body 121H and an inner surface of the output flow path 121C with an insulating material.

The embodiment configured in this way may yield similar effects as the nineteenth embodiment. Since the inner surface of the container 121B or the like may be covered with the insulator 1200 in this embodiment, the main body 121H may not need to be constituted of an electrically insulating material. Thus, the main body 121H may be constituted of a conductive material such as metal, whereby the configuration can be simplified.

In order to enhance the electric field at the target material 200, the nozzle unit 122 may preferably have an electrically insulating property. For example, materials for the nozzle unit having an electrically insulating property may include diamond, crystalline alumina, and so forth.

Twenty-Third Embodiment

Figure 43:
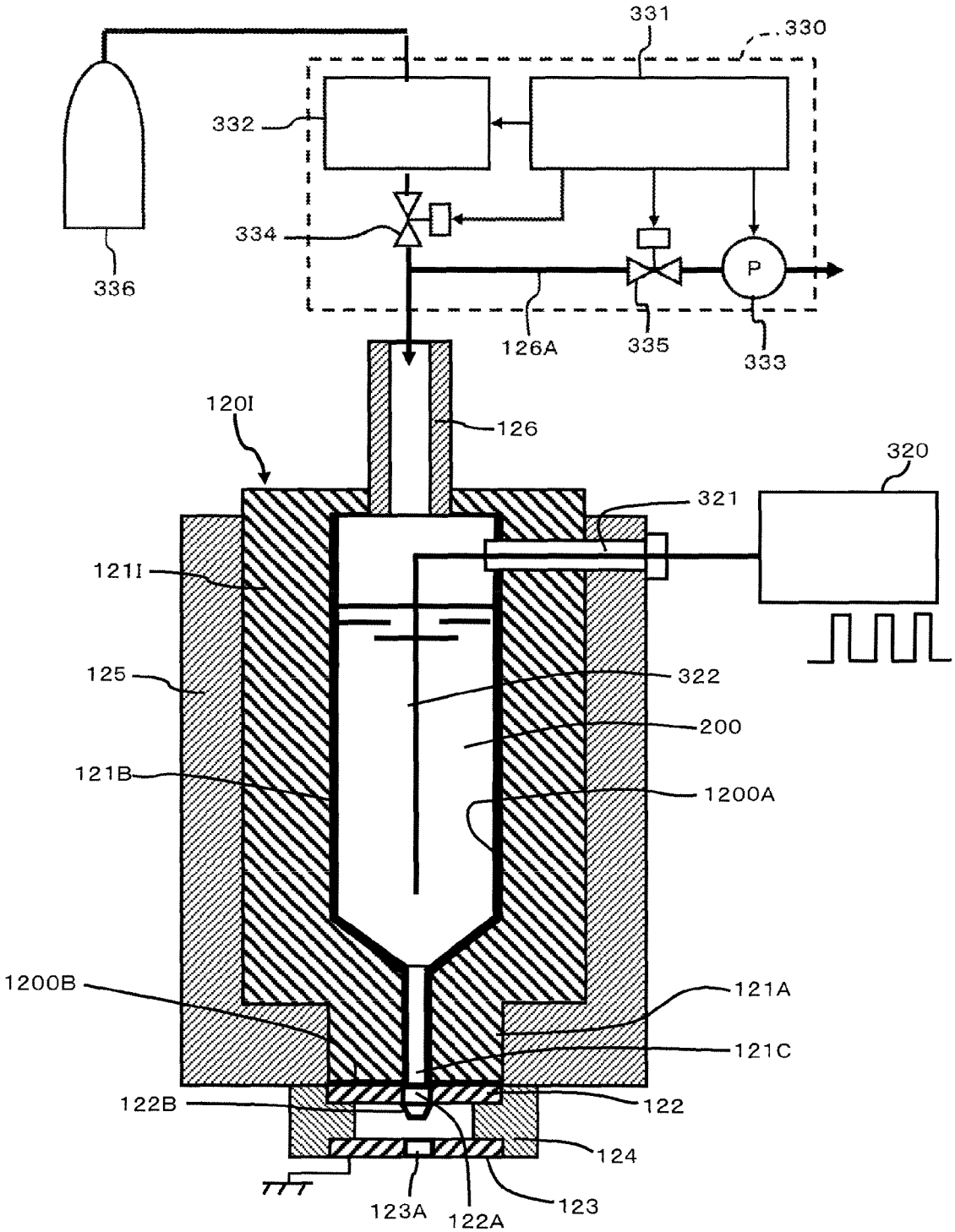
FIG. 43 illustrates a target output unit according to a twenty-third embodiment.

Referring to FIG. 43, a twenty-third embodiment will be described. In this embodiment, an insulator 1200A may be provided on an inner surface of the container 121B of a main body 121I and on an inner surface of the output flow path 121C. Further, in this embodiment, another insulator 1200B may be provided between the main body 121I and the nozzle unit 122. The insulator 1200B may preferably be provided so as to prevent a creeping discharge from occurring at the contact surfaces of the main body 121(I) and of the nozzle unit 122. The embodiment configured in this way may yield similar effects as the nineteenth embodiment.

Twenty-Fourth Embodiment

Figure 44:
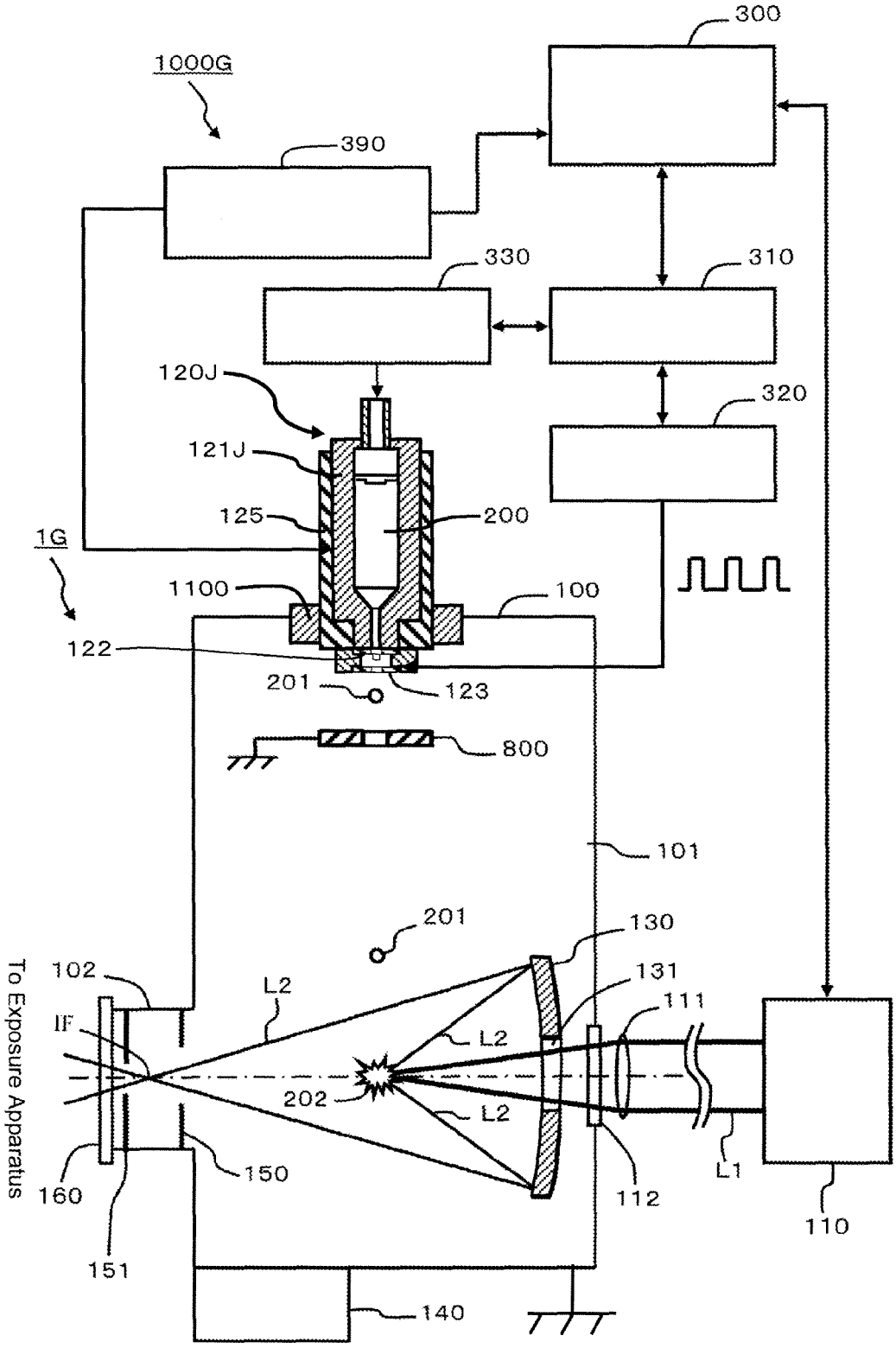
FIG. 44 illustrates the configuration of an EUV light source apparatus according to a twenty-fourth embodiment.
Figure 45:
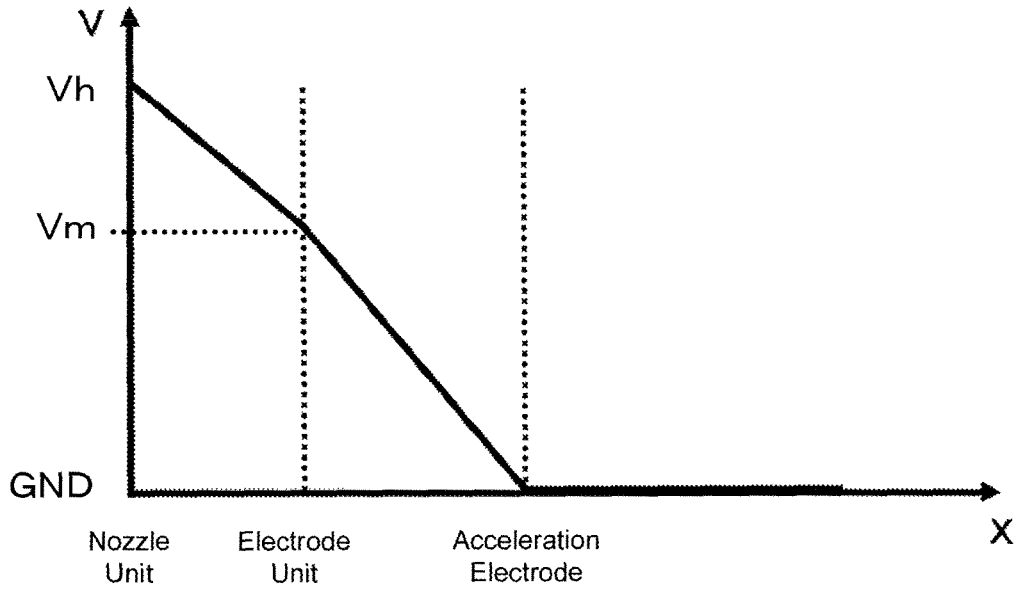
FIG. 45 shows changes in potentials from a nozzle unit to an acceleration electrode.

Referring to FIG. 44 and FIG. 45, a twenty-fourth embodiment will be described. FIG. 44 is a descriptive view illustrating the general configuration of an EUV light source apparatus 1G. FIG. 45 shows the change in potentials along a path leading to the acceleration electrode 800 from the nozzle unit 122.

In the EUV light source apparatus 1G of this embodiment, high voltage may be applied between a main body 121J and the electrode unit 123. The acceleration electrode 800 may be grounded. As shown in FIG. 45, a high potential application unit 390 for applying a high potential may apply a high potential Vh to the main body 121J. A pulsed potential Vm may be applied to the electrode unit 123 for pulling out the target material 200 through the nozzle by the pulse control unit 320. The potential Vh applied to the main body 121J being the base potential, the pulsed potential Vm may be set to a lower potential than the potential Vh.

The target material 200 pulled out through the nozzle unit 122 with the electric field generated by the electrode unit 123 may be turned into the droplet 201 and head toward the plasma generation region P202. Since the acceleration electrode 800 and the chamber 100 may be grounded, the potential difference may hardly exist along the path from the acceleration electrode 800 to the plasma generation region P202. Accordingly, the droplet 201 having passed through the acceleration electrode 800 will head toward the plasma generation region P202.

The embodiment configured in this way may yield similar effects as the nineteenth embodiment.

In the twentieth through twenty-fourth embodiments (see FIG. 40 through FIG. 43), although the conductive wire 322 extends toward the leading end of the main body (121F through 121I), the conductive wire 322 can be made shorter. It may be ideal to make the conductive wire 322 to pass through a liquid surface of the target material 200. Accordingly, a follow-up mechanism with which the leading end of the conductive wire 322 may remain in contact with the target material 200 may be provided.

Twenty-Fifth Embodiment

Figure 46:
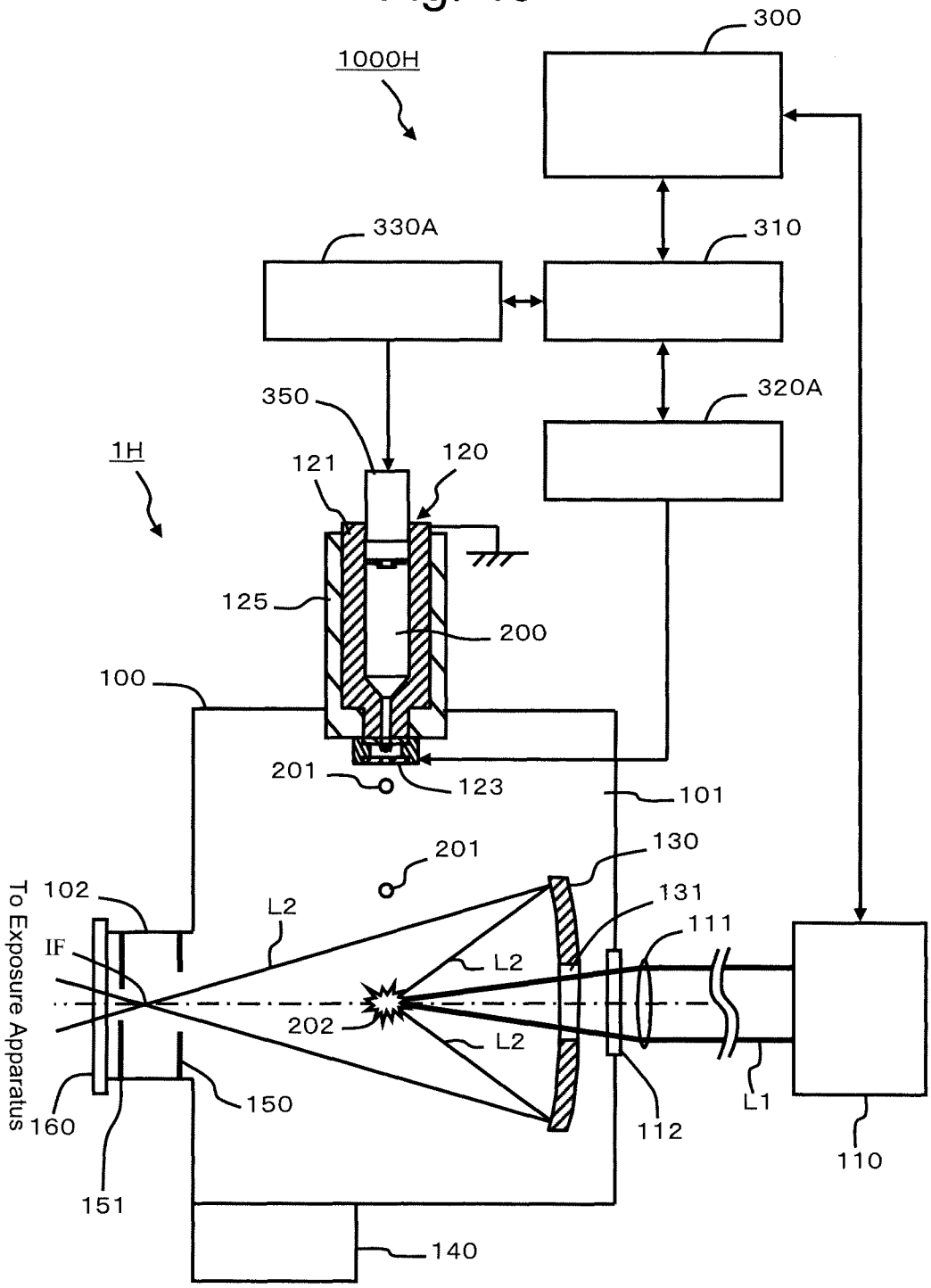
FIG. 46 illustrates the configuration of an EUV light source apparatus according to a twenty-fifth embodiment.
Figure 47A:
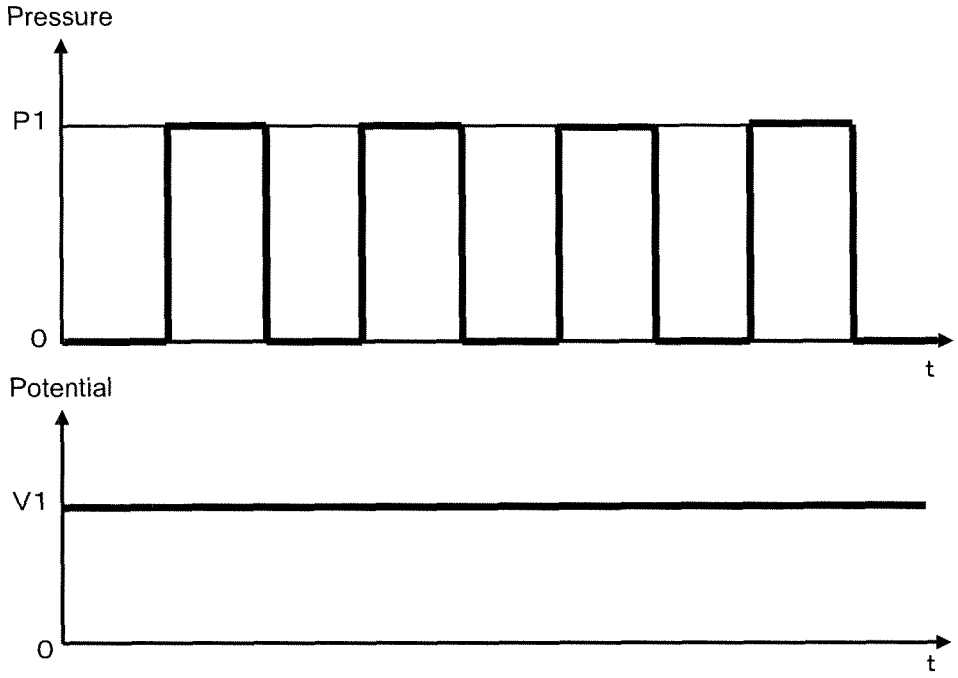
FIGS. 47A and 47B show a relationship between voltage and pressure.
Figure 47B:
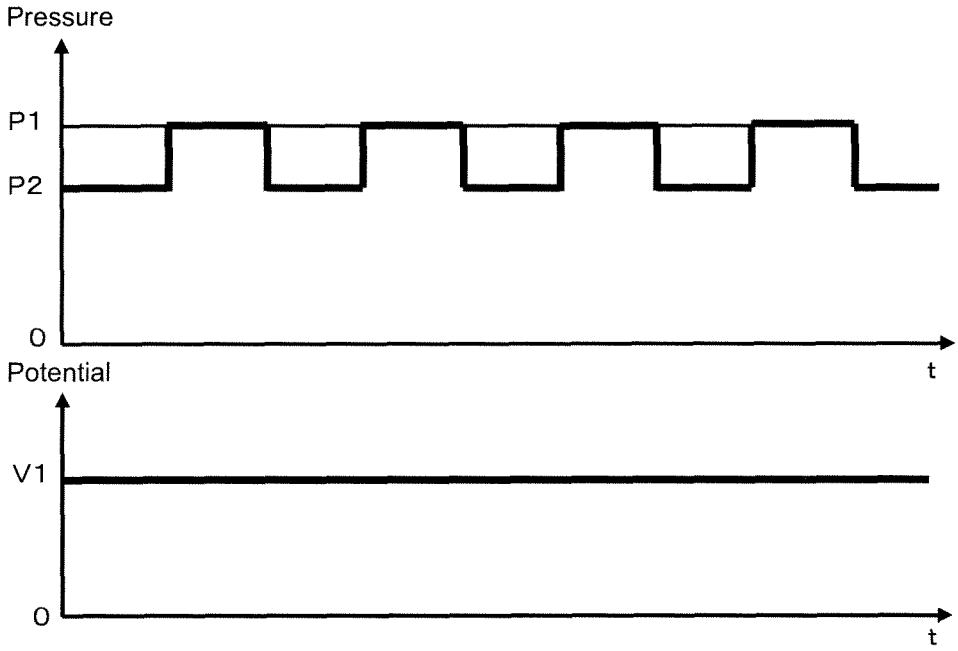

Referring to FIGS. 46 through 47B, a twenty-fifth embodiment will be described. In the above-described embodiments, the voltage may be applied between the electrode unit 123 and the target material 200 in pulses; however, in this embodiment, while the constant voltage may be applied therebetween, the pressure may be applied to the target material 200 in pulses. Applying the pressure to the target material 200 may mean herein that the pressure may be applied to the target material 200 either directly or indirectly.

FIG. 46 illustrates the configuration of an EUV light source apparatus 1H and a target supply unit 1000H serving as the "target output device" according to this embodiment.

In this embodiment, in place of the pulse control unit 320 for generating a pulsed potential, a DC voltage control unit 320A for generating DC voltage may be used. Further, in this embodiment, in place of the pressure control unit 330 for applying the constant pressure to the target material 200, a pressure control unit 330A for applying pulsed pressure to the target material 200 may be used.

FIGS. 47A and 47B show a relationship between the potential and the pressure. As shown in FIG. 47A, the pressure control unit 330A may supply an inert gas into the main body 121, for example, and cause the pressure applied to the target material 200 inside the main body 121 to change in pulses. The maximum value of the applied pressure may be set to P1. The DC voltage control unit 320A may output a predetermined constant potential V1. That is, the DC voltage control unit 320A may apply the DC potential V1 to the electrode unit 123.

In the case shown in FIG. 47A, with the electrostatic attraction force acting between the electrode unit 123 and the target material 200, the target material 200 inside the nozzle 122B may project toward the electrode unit 123 slightly but not enough to break off. When the pressure P1 is applied to the target material 200 in this state, the target material 200 at the tip of the nozzle 122B may be outputted as the droplet 201 toward the electrode unit 123. The droplet(s) 201 can be outputted through the nozzle 122B in synchronization with the pulsed pressure change.

As shown in FIG. 47B, pressure P2 may be applied to the target material 200 in advance, and the pressure may be increased from P2 to P1 when a droplet is to be outputted. In the case shown in FIG. 47B as well, constant electrostatic attraction force with the DC potential V1 may act on the target material 200. When the pressure applied on the target material 200 is changed from P2 to P1 under the state where the electrostatic attraction force is acting thereon, the droplet 201 can be outputted through the nozzle 122B.

By causing the pressure applied on the target material 200 to be changed under the state where the constant potential V1 is applied to the electrode unit 123, the droplet 201 can be outputted through the nozzle 122B.

Twenty-Sixth Embodiment

Figure 48:
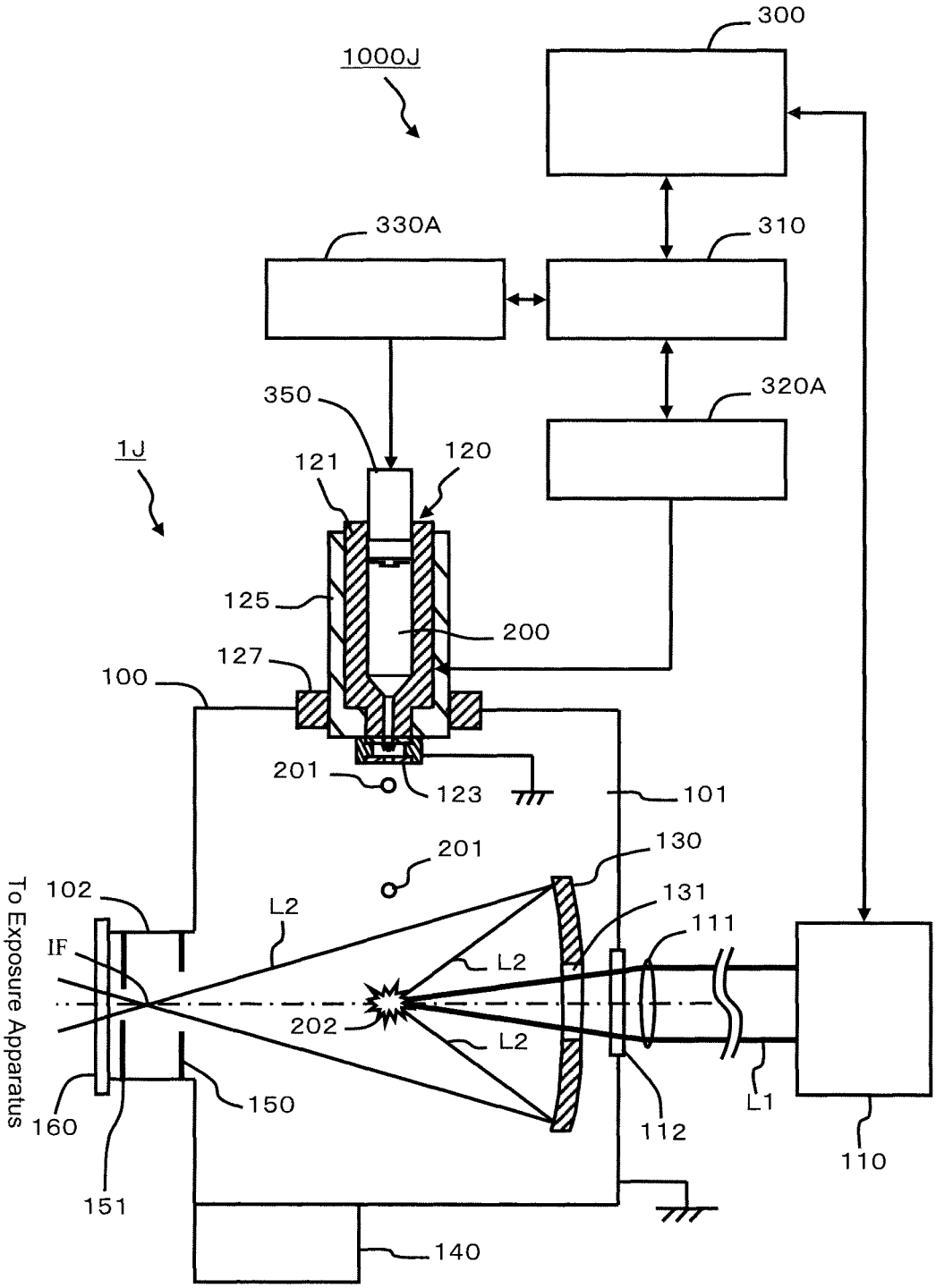
FIG. 48 illustrates the configuration of an EUV light source apparatus according to a twenty-sixth embodiment.

Referring to FIG. 48, an EUV light source apparatus 1J according to a twenty-sixth embodiment will be described. In a target supply unit 1000J of this embodiment, an insulator 127 may be provided between the target output unit 120 and the chamber 100, and a DC potential may be applied to the target material 200 inside the main body 121. The electrode unit 123 of this embodiment may be grounded.

With this embodiment as well, the potential and the pressure as shown in FIGS. 47A and 47B may be applied to the target material 200. In synchronization with the pressure that may change in pulses, the droplet 201 can be outputted through the nozzle unit 122B into the chamber 100.

Twenty-Seventh Embodiment

Referring to FIG. 49 through FIG. 52, a twenty-seventh embodiment will be described. In the embodiments to follow including the twenty-seventh embodiment, a constant potential and constant pressure may be made to act on the target material 200 simultaneously, whereby the droplet 201 may be outputted through the nozzle unit 122.

Figure 49:
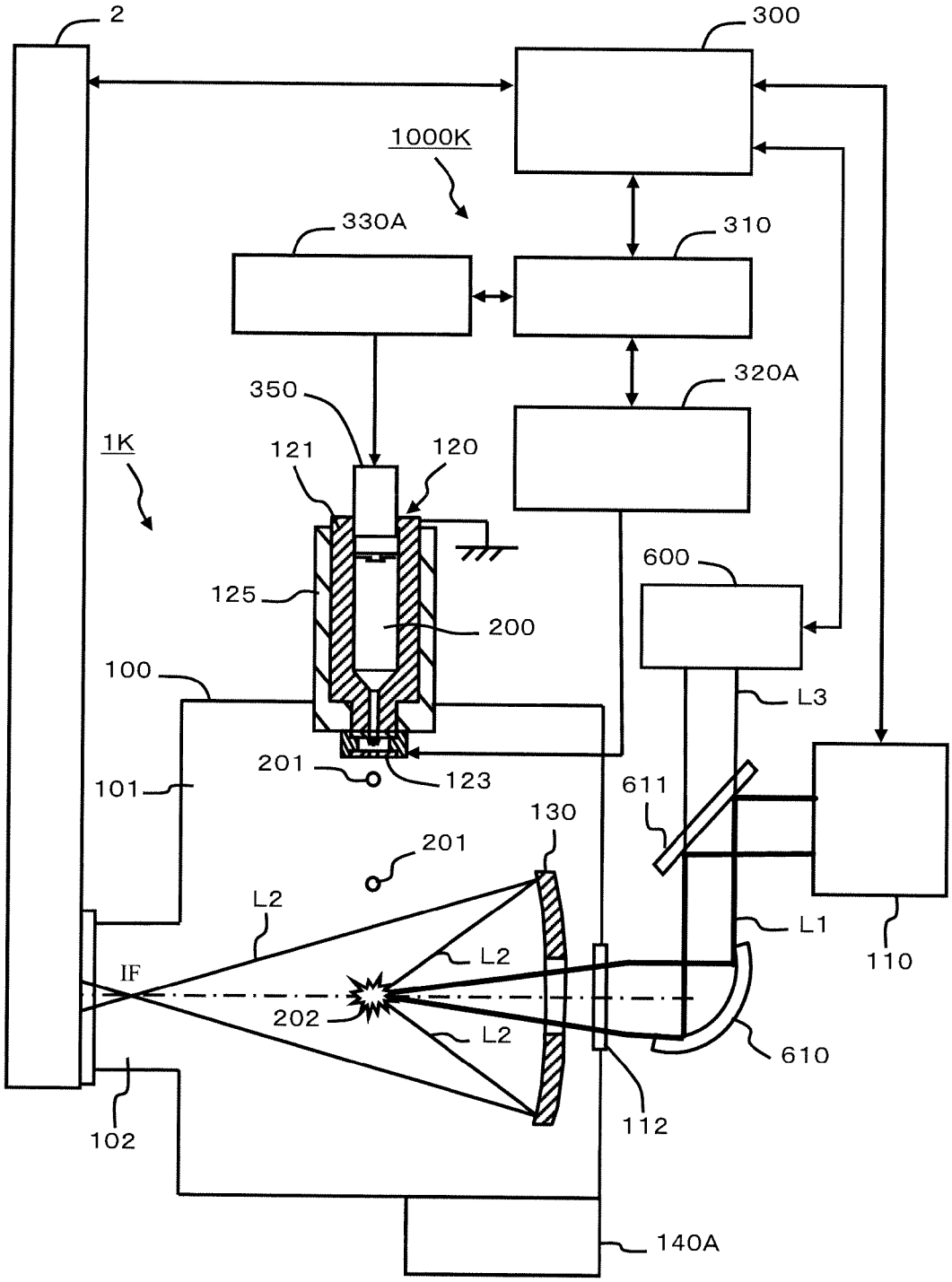
FIG. 49 illustrates the configuration of an EUV light source apparatus according to a twenty-seventh embodiment.

FIG. 49 illustrates the configuration of an EUV light source apparatus 1K including a target supply unit 1000K according to this embodiment.

The EUV light source apparatus 1K of this embodiment may include a ventilation unit 140A in place of the exhaust pump 140. The ventilation unit 140A may include an exhaust pump or the like, for example. The ventilation unit 140A can maintain the interior of the chamber 100 at low pressure of approximately from 0.1 to several tens Pa, and can also maintain the interior of the chamber 100 at pressure of approximately from several hundreds to several tens of thousands Pa as well.

Further, the EUV light source apparatus 1K of this embodiment, as in the ninth embodiment, may include a pre-pulse laser source 600. A pre-pulse laser beam L3 outputted from the pre-pulse laser source 600 may preferably be guided to the plasma generation region inside the chamber 100 via the pre-pulse laser beam introduction mirror 611, a off-axis paraboloidal mirror 610, an input window 112, and so forth.

Figure 50:
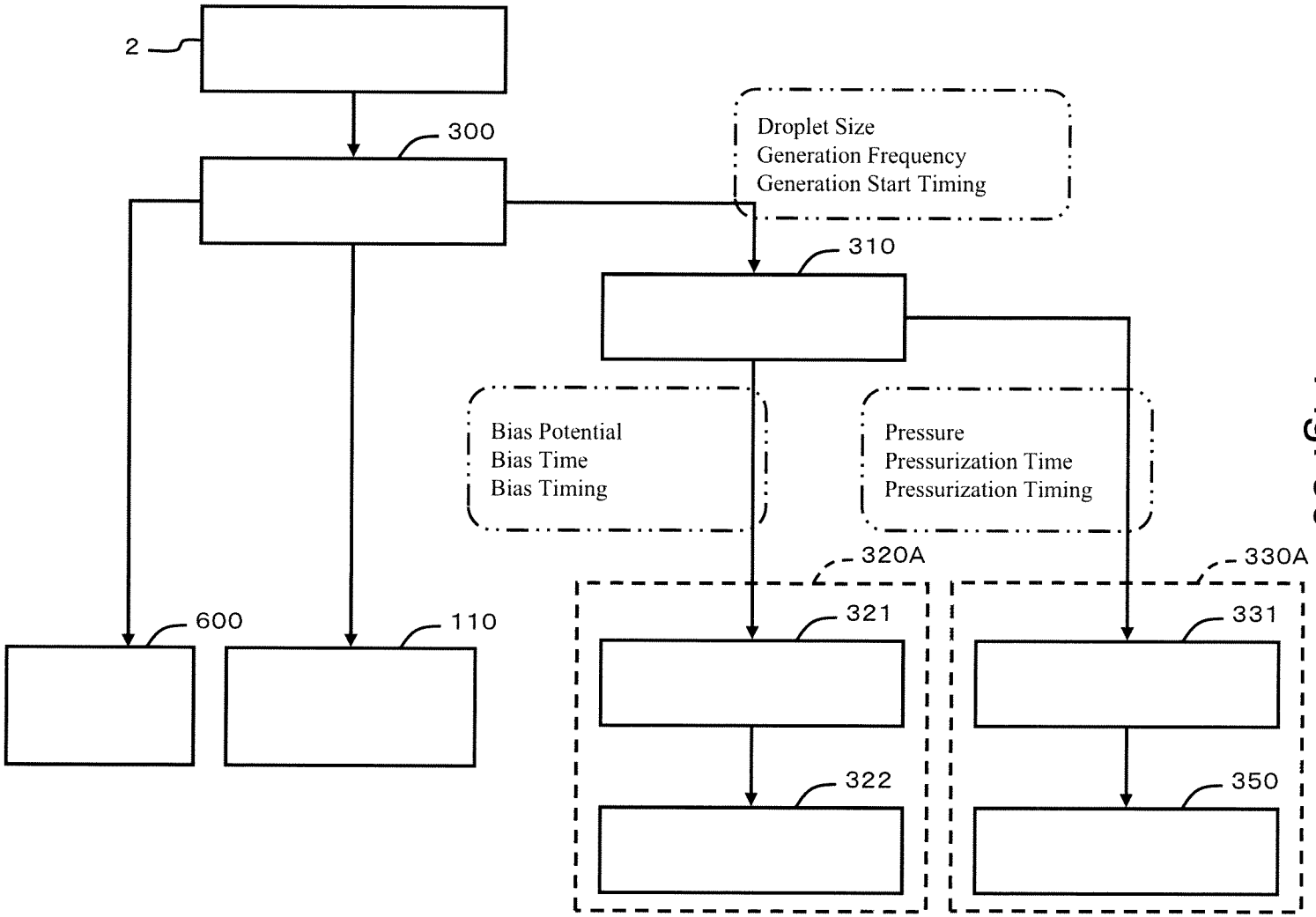
FIG. 50 schematically shows a control architecture.

FIG. 50 schematically shows the control configuration. The exposure apparatus 2 may transmit an EUV light emission request signal for requesting emission of the EUV light to the EUV light source controller 300.

The EUV light source controller 300 may, based on the EUV light emission request signal, determine at least a droplet size, a droplet generation frequency, and droplet generation timing, and transmit these values to the droplet controller 310.

The droplet controller 310 may, based on the droplet size, the droplet generation frequency, and the droplet generation timing received from the EUV light source controller 300, determine a plurality of parameters for controlling the voltage and another plurality of parameters for controlling the pressure.

The plurality of the parameters for controlling the voltage, for example, may include the value of the voltage (also called bias voltage) applied between the electrode unit 123 and the target material 200, the duration in which the bias voltage is applied (first period of time), and the timing at which the bias voltage is applied (first timing). The plurality of the parameters for controlling the voltage may be called a plurality of voltage control parameters.

The another plurality of the parameters for controlling the pressure, for example, may include the pressure applied to the target material 200, the duration of in which the pressure is applied to the target material 200 (second period of time), and the timing at which the pressure is applied to the target material 200 (second timing). The another plurality of the parameters for controlling the pressure may be called a plurality of pressure control parameters.

The droplet controller 310, for example, may calculate the plurality of the voltage control parameters and the plurality of the pressure control parameters by substituting the values (droplet size, droplet generation frequency, droplet generation timing) inputted from the EUV light source controller 300 into a predetermined operational expression.

Alternatively, the droplet controller 310 may select the plurality of the voltage control parameters and the plurality of the pressure control parameters using a plurality of predetermined tables generated based on experimental results or simulation results.

In this embodiment, either or both of the method in which the predetermined operational expression is used and the method in which the predetermined tables are used may be employed. For example, the configuration may be such that either of the voltage control parameters or the pressure control parameters may be calculated from the predetermined operational expression and the other parameters may be selected from the predetermined tables.

The DC voltage control unit 320A may include a controller 321 for controlling the DC voltage value, and a voltage generation unit 322. The DC voltage control unit 320A may control the actuation of the voltage generation unit 322, based on the voltage control parameters inputted from the droplet controller 310, and generate predetermined voltage.

The pressure control unit 330A may include a pressure controller 331 and a pressurization unit 350. The pressurization unit 350 may be configured, as shown in FIG. 2, to deliver an inert gas into the main body 121, or may be configured to utilize the deformation of the piezoelectric element, as shown in FIG. 6, FIG. 9, FIG. 13, and FIG. 15. Further, the configuration may be such that an acoustic wave generation device such as a speaker is used to apply pressure to the target material 200 with acoustic pressure.

The pressure control unit 330A may control the actuation of the pressurization unit 350, based on the pressure control parameters inputted from the droplet controller 310, and generate predetermined pressure.

With the configuration shown, as in FIG. 2, in which the inert gas is delivered into the main body 121, the range in which the pressure can be adjusted may be made relatively large. However, a response time to the pressure change may be relatively slow.

On the other hand, as shown in FIG. 6 and FIG. 13, with the configuration in which the piezoelectric element 400 is provided midway in the output flow path 121C on the outer wall thereof, the response time to the pressure change may be made shorter. Accordingly, the pressure on the target material 200 can be increased or decreased more quickly. However, the range in which the pressure can be adjusted may be relatively small.

When the predetermined pressure is applied to the target material 200 and the predetermined voltage is applied between the target material 200 and the electrode unit 123, the droplet 201 may be outputted through the nozzle unit 122 at predetermined frequency.

When the EUV light source controller 300, upon receiving the EUV light emission request signal from the exposure apparatus 2, may send control signals to the pre-pulse laser source 600 and the driver pulse laser source 110, respectively. With this, the droplet 201 may first be irradiated with the pre-pulse laser beam L3, and then the droplet 201 may be irradiated with the driver pulsed laser beam L1, whereby the droplet 201 may be turned into the plasma 202. The EUV light L2 emitted from the plasma 202 may be supplied to the exposure apparatus 2.

Figure 51:
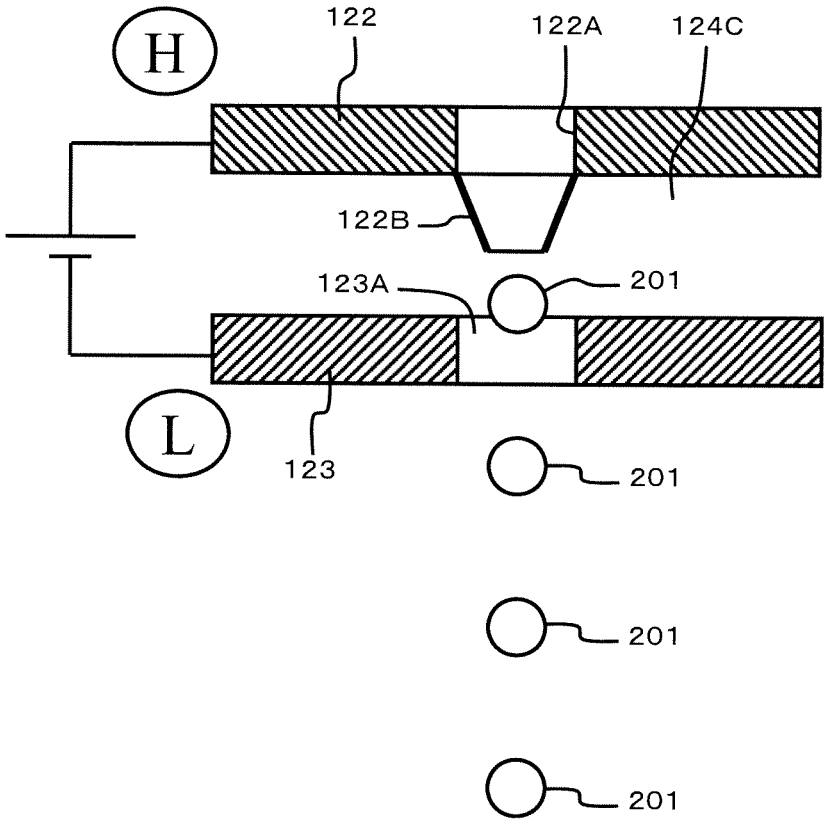
FIG. 51 shows a state in which voltage is applied between a nozzle unit and an electrode.

FIG. 51 schematically illustrates a state where voltage is applied between the nozzle unit 122 and the electrode unit 123. To be more precise, the voltage may be applied between the target material 200 inside the nozzle unit 122 and the electrode unit 123, but for the sake of simplicity, it will be described as that the voltage is applied between the nozzle unit 122 and the electrode unit 123.

In this embodiment, predetermined voltage may be applied such that the potential at the nozzle unit 122 is relatively higher than the potential at the electrode unit 123. Conversely, the predetermined voltage may be applied between the electrode unit 123 and the nozzle unit 122 such that the potential at the electrode unit 123 is relatively lower than the potential at the nozzle unit 122 (potential at the target material 200).

Since electrons are extremely light in mass, an electrical discharge may be likely to occur at the anode due to the field emission. In addition, the electrical discharge due to the field emission may be likely to occur at the region of field enhancement. That is, when the region of field enhancement is at the anode, dielectric breakdown voltage may be lower, compared to the case where the region of field enhancement is at the cathode.

In this embodiment, in order to make the electrostatic attraction force act effectively on the target material 200 at the tip of the nozzle 122B, the nozzle 122B may be provided so as to project toward the electrode unit 123. With this, the electric field may be enhanced at the projection of the nozzle 122B. At this time, if the potential at the nozzle 122B is set to be lower than the potential at the electrode unit 123 and the nozzle 122B is set to be the anode, the dielectric breakdown voltage may become lower.

On the contrary, in this embodiment, as shown in FIG. 51, by setting the potential at the nozzle unit 122 higher than the potential at the electrode unit 123, the dielectric breakdown voltage is made higher with the nozzle unit 122 being the anode. With this, higher voltage can be applied between the nozzle unit 122 and the electrode unit 123 than in the case where the nozzle unit 122 is set to be the cathode. The higher the voltage applied therebetween, the higher electrostatic attraction force can be obtained. There are, however, cases where the electrostatic attraction force may be small due to the properties or the like of the target material. In this case, since the potential difference can be made small, as will be described later, the configuration in which the potential at the nozzle unit 122 is lower than the potential at the electrode unit 123 may be feasible.

Figure 52:
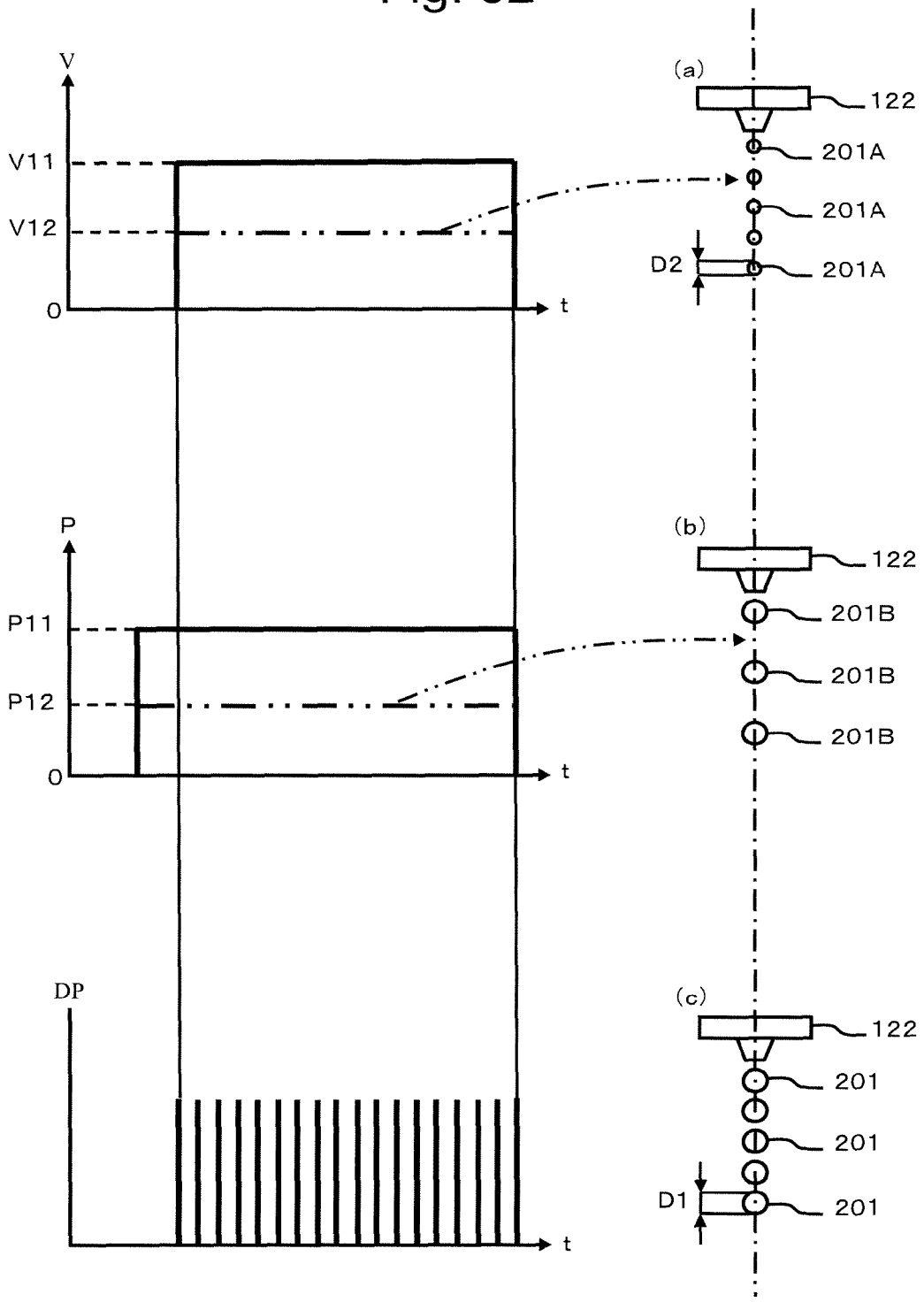
FIG. 52 shows a state in which voltage and pressure are applied to a target material, whereby droplet targets are outputted discretely.

FIG. 52 shows changes in the output states of the droplet 201 when the voltage value and the pressure value are changed. At the left side of FIG. 52, descending from the top, states of the voltage, the pressure, and the droplet are shown, respectively. At the right side of FIG. 52, the output states (a), (b), and (c) of the droplets are shown.

When predetermined voltage V11 being applied between the target material 200 and the electrode unit 123, predetermined pressure P11 may be applied to the target material 200, the droplets 201 may be outputted at a set frequency through the nozzle unit 122, as shown at the lower side of FIG. 52. Each line shown at the lower side of FIG. 52 indicates a single output of the droplet 201.

In the period during which the predetermined voltage and the predetermined pressure may act simultaneously, the state in which the droplets 201 are outputted through the nozzle unit 122 at a constant frequency may be called a reference state (c). The droplet size in the reference state (c) may be set to D1, the droplet generation frequency may be set to fr1. When the constant frequency fr1 is made to coincide with the output frequency of the pre-pulse laser beam and of the driver pulsed laser beam, the target material 200 can be consumed without being wasted, and the EUV light may be obtained efficiently.

With reference to FIG. 52, considering the lead time (time delay) of the pressure, it may be preferable to set the timing (pressurization timing) at which the pressure is applied to the target material 200 to fall before the timing (bias timing) at which the voltage is applied thereto.

As shown at the top section of FIG. 52 and in (a) of FIG. 52, when the voltage applied between the target material 200 and the electrode unit 123 is decreased from V11 to V12 (V12<V11), the droplet size will be D2, which is smaller than the reference value D1 (D2<D1).

It is conceivable that lowering the voltage value may cause the electrostatic attraction force acting on the target material 200 to weaken, and as a result, the target material 200 in a lesser amount than the reference value may be outputted as a droplet 201A. Accordingly, the droplet size may be controlled by varying the voltage value.

As shown in the middle section of FIG. 52 and in (b) of FIG. 52, when the pressure applied to the target material 200 is decreased from the reference pressure P11 to P12 (P12<P11), the droplet generation frequency will be fr12, which is larger than the reference frequency fr1 (fr12>fr1).

Lowering the pressure value may cause the total amount (flow rate) of the target material discharged through the nozzle unit 122 in a given amount of time to be reduced; therefore, the droplet generation frequency fr12 may become longer than the reference frequency fr1. Accordingly, the droplet generation frequency may be controlled by varying the pressure value.

In the embodiment configured in this way, the constant voltage may be applied between the target material 200 and the electrode unit 123 and the predetermined pressure may be applied to the target material 200, whereby the droplet 201 can be outputted through the nozzle unit 122 at a constant frequency.

Further, in this embodiment, the droplet size may be controlled by controlling the voltage value, and the droplet generation frequency may be controlled by controlling the pressure value. Accordingly, the droplet 201 having an appropriate droplet size can be outputted into the chamber 100 at an appropriate frequency in accordance with the request from the exposure apparatus 2. As a result, in this embodiment, generation of debris can be suppressed and the EUV light can be obtained more efficiently with a less complicated configuration.

Twenty-Eighth Embodiment

A twenty-eighth embodiment will be described with reference to FIG. 53A through FIG. 55B. In this embodiment, several modifications of the voltage control and of the pressure control, which may be applied to the twenty-seventh embodiment, will be disclosed.

Figure 53A:
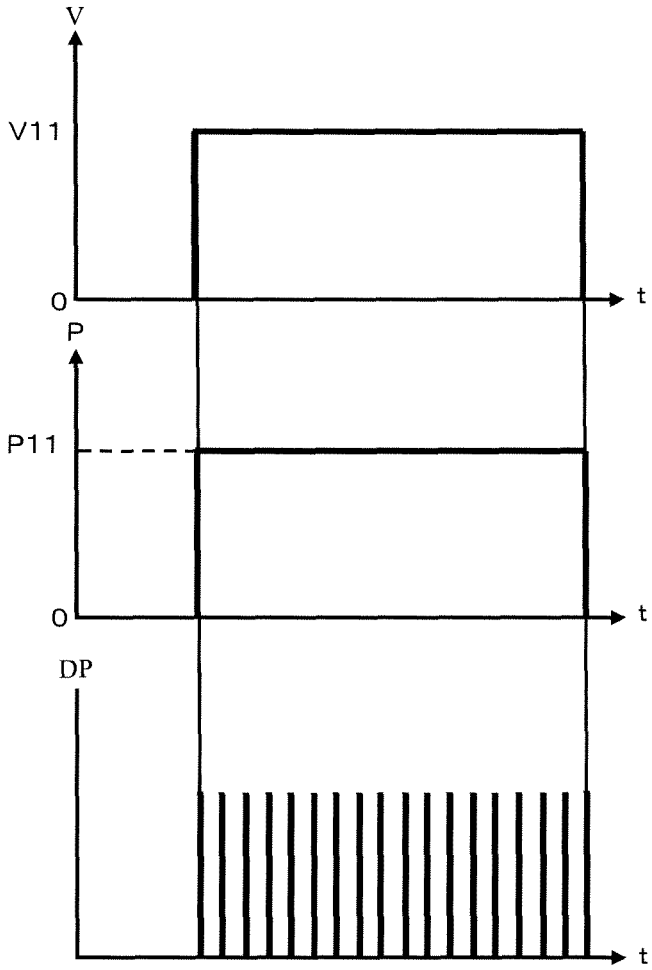
FIGS. 53A and 53B show a relationship among voltage, pressure, and a target according to a twenty-eighth embodiment.

As shown in FIG. 53A, the configuration may be such that the timing at which and the duration in which the predetermined voltage is applied between the target material 200 and the electrode unit 123 is made to substantially coincide with the timing at which and the duration in which the predetermined pressure is applied to the target material 200.

Figure 53B:
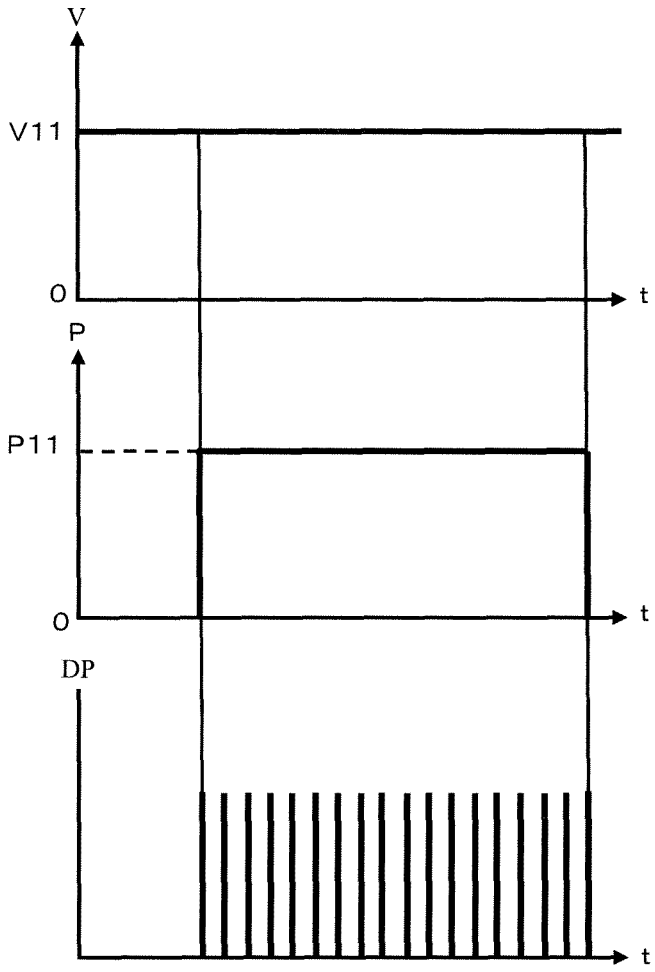

As shown in FIG. 53B, the configuration may be such that the predetermined voltage being applied continuously between the target material 200 and the electrode unit 123, for example, the predetermined pressure is applied to the target material 200.

Figure 54A:
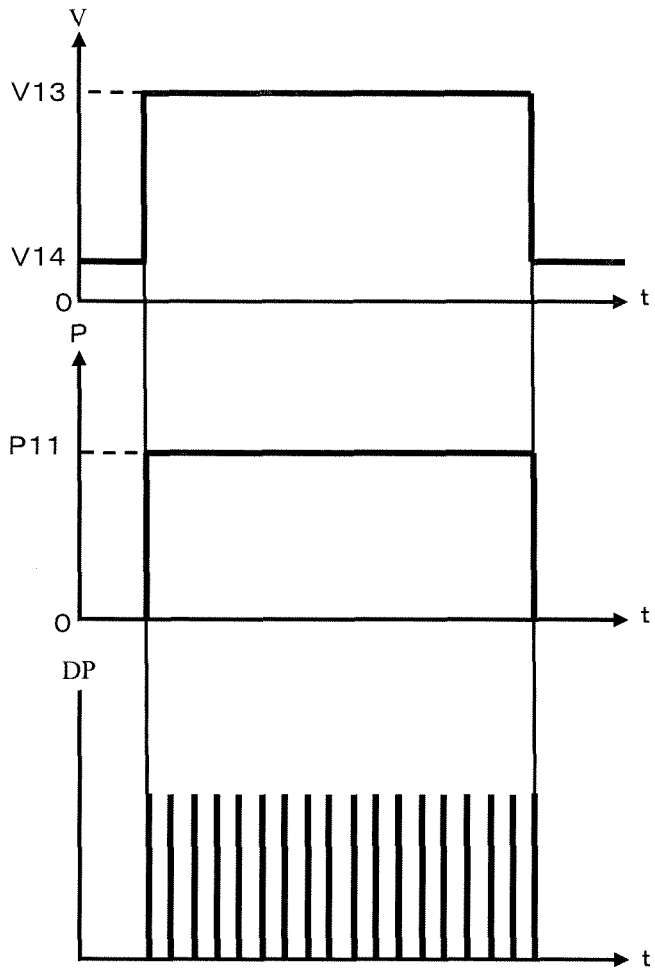
FIGS. 54A and 54B are other diagrams illustrating a relationship among voltage, pressure, and a target.

As shown in FIG. 54A, the configuration may be such that, low voltage V14 being pre-applied between the target material 200 and the electrode unit 123, the voltage V14 may be raised to predetermined voltage V13 at predetermined timing. In this case, the configuration may be such that at the same time as the voltage is raised to V13, the predetermined pressure P11 is applied to the target material 200; alternatively, the configuration may be such that the predetermined pressure P11 is applied to the target material 200 with the voltage V14 being applied thereto.

Figure 54B:
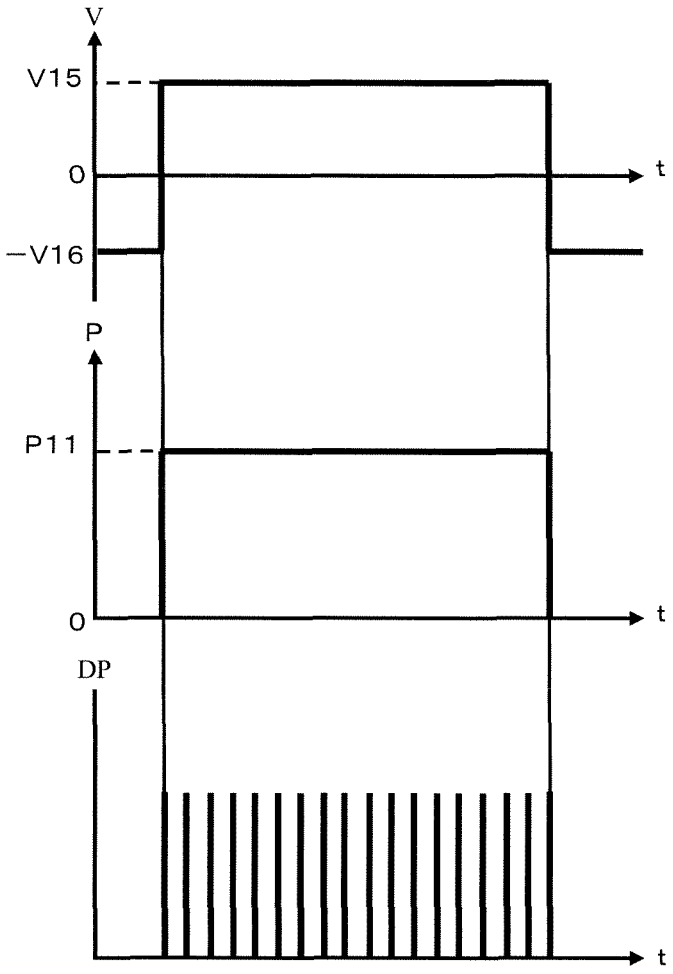

As shown in FIG. 54B, a predetermined potential difference serving as the predetermined voltage can be obtained from a potential −V16, which is lower than the ground potential (0 v), and a potential V15, which is higher than the ground potential. That is, the potential at the electrode unit 123 may be set to −V16, and the potential at the nozzle unit 122 may be set to V15.

Figure 55A:
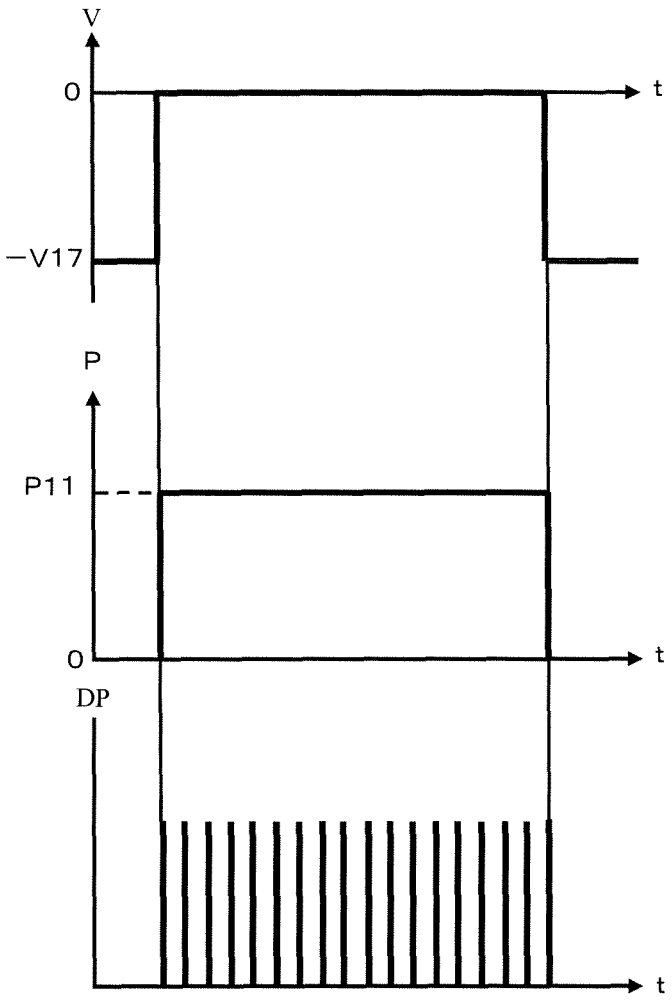
FIGS. 55A and 55B are yet other diagrams illustrating a relationship among voltage, pressure, and a target.

As shown in FIG. 55A, the predetermined potential difference may be obtained from the ground potential and a potential −V17, which is lower than the ground potential.

Figure 55B:
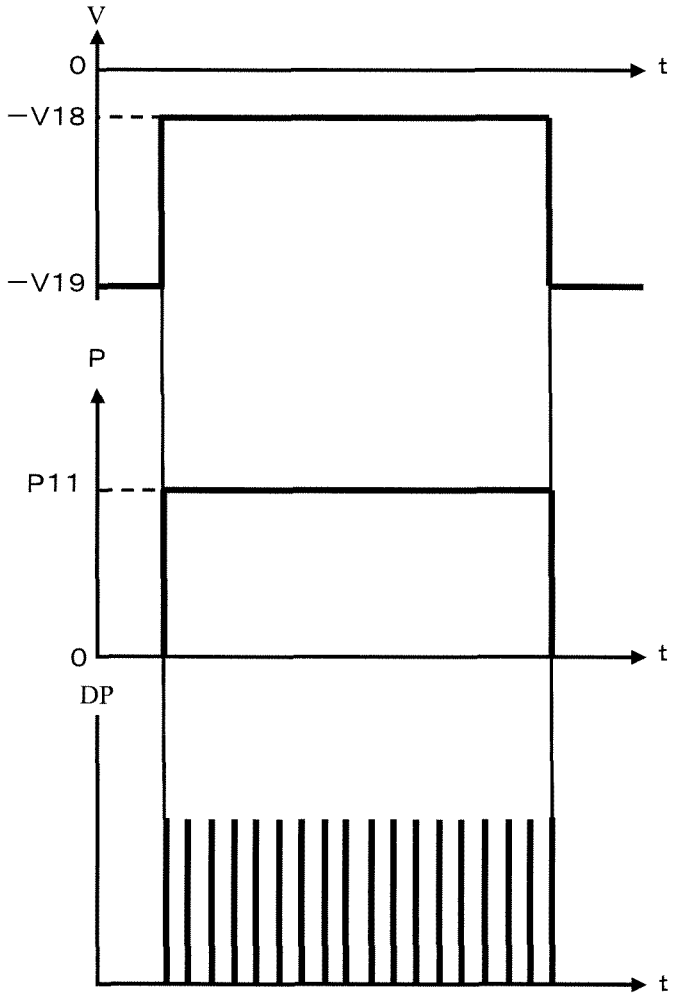

As shown in FIG. 55B, the configuration may be such that the predetermined potential difference is obtained from a potential −V18, which is lower than the ground potential, and a potential −V19, which is lower than −V18.

As shown in FIGS. 54A through 55B, the potential difference applied between the target material 200 inside the nozzle unit 122 and the electrode unit 123 may be generated above the ground voltage, across the ground potential, or below the ground potential.

Twenty-Ninth Embodiment

Figure 56:
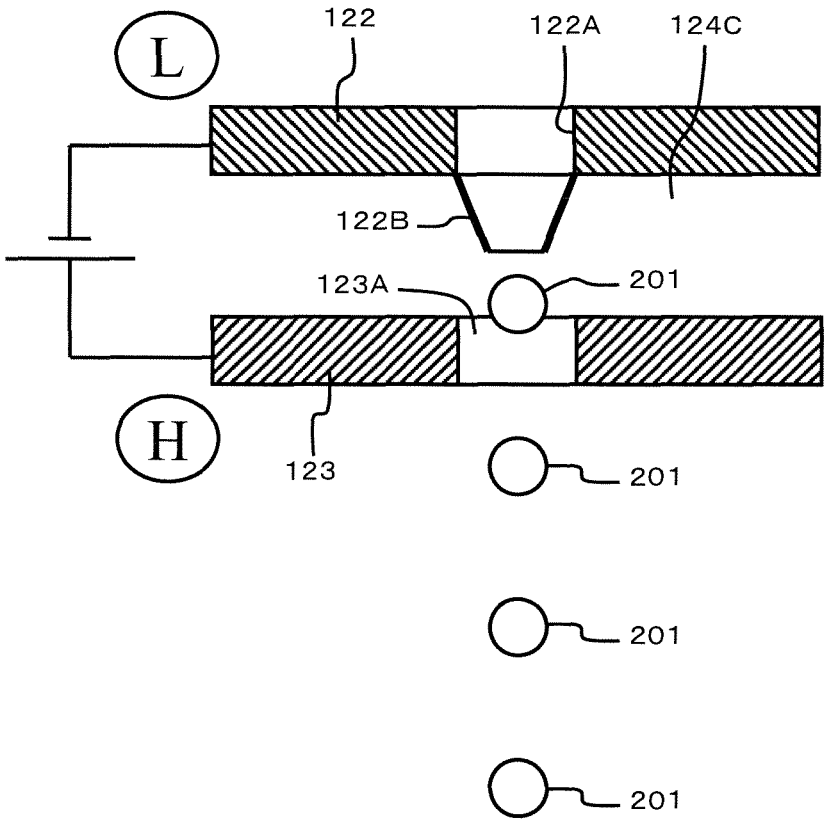
FIG. 56 show how voltage is applied in an EUV light source apparatus according to a twenty-ninth embodiment.

A twenty-ninth embodiment will be described with reference to FIG. 56 through FIG. 58. In this embodiment, several other modifications of the voltage control and the pressure control will be disclosed. FIG. 56 shows a method of applying voltage according to this embodiment.

In each of the above-described embodiments, as has been described with reference to FIG. 51, the predetermined voltage may be applied such that the potential at the nozzle unit 122 (target material 200) is higher than the potential at the electrode unit 123. On the other hand, in this embodiment, the potential at the nozzle unit 122 may be set to be lower than the potential at the electrode unit 123.

To the configuration shown in FIG. 56, either of the voltage application patterns shown in FIG. 57B and FIG. 58, which will be described later, may be applied.

Figure 57A:
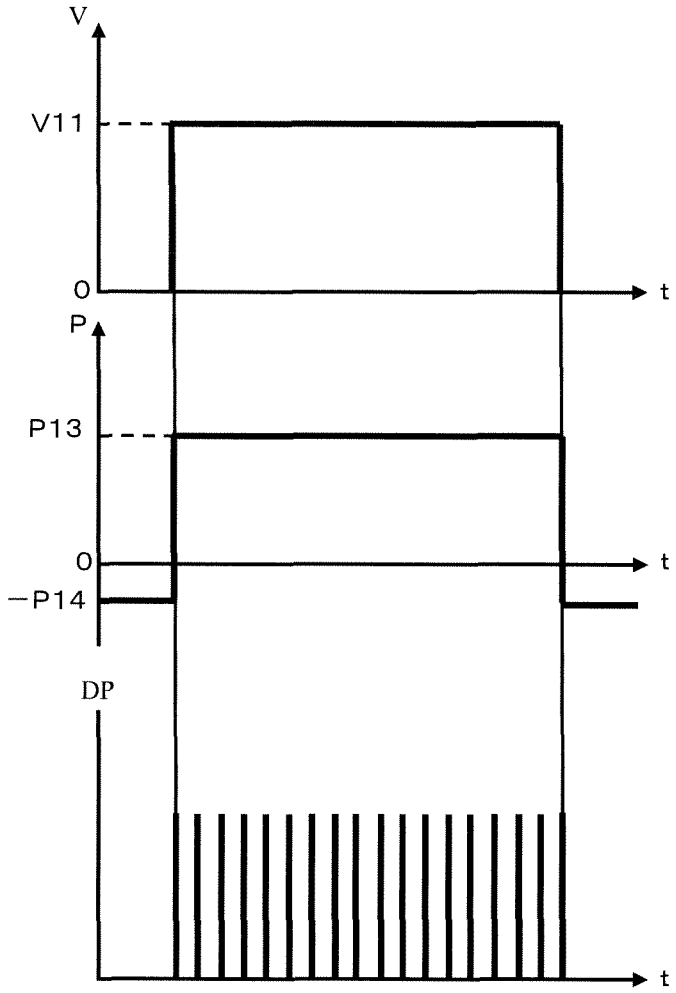
FIGS. 57A and 57B shows a relationship among voltage, pressure, and a target.

FIG. 57A shows the configuration in which the target material 200 is pressurized from slightly negative pressure −P14 to positive pressure P13, in the case where the potential at the nozzle unit 122 is set to be higher than the potential at the electrode unit 123.

Generally, the interior of the chamber 100 is maintained in a relatively low pressure state of approximately several Pa. However, there may be a case where halogen gas or argon gas is supplied into the chamber 100, for example, for ion control, debris protection, cleaning of components inside the chamber 100, maintenance work, and so forth. In that case, since the pressure inside the chamber 100 may increase, the configuration may be such that pressurization onto the target material 200 is started at the value −P14, which is slightly lower than the pressure inside the chamber 100.

This disclosure, however, is not restricted by gas properties inside the chamber 100. It can be applied to a configuration in which a reactive gas such as hydrogen gas or halogen gas, or an inert gas such as argon gas is supplied into the chamber 100 relatively frequently and/or continuously.

Figure 57B:
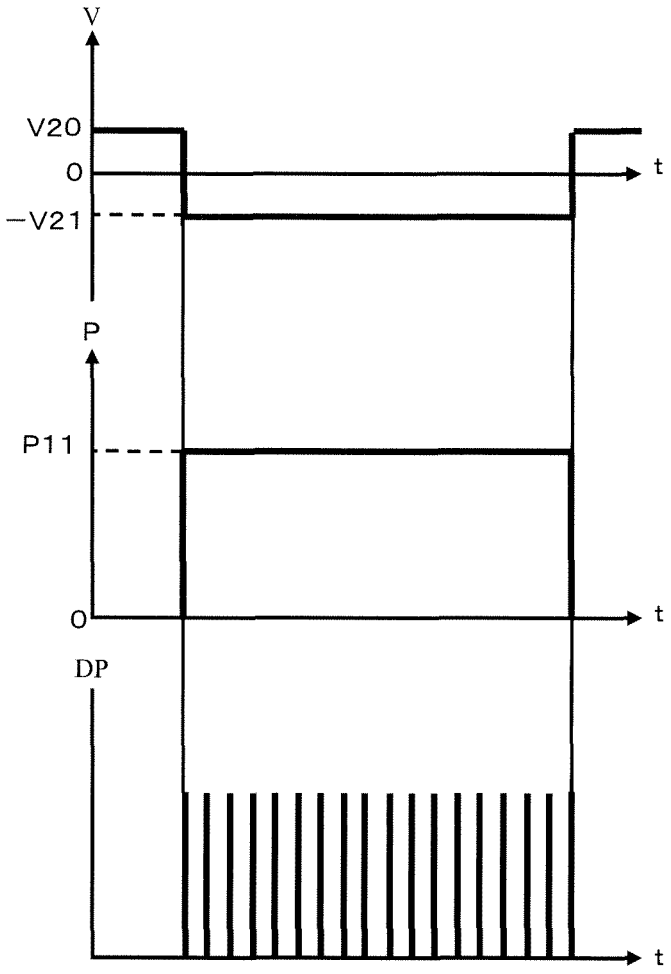

Referring to FIG. 57B, the configuration shown in FIG. 57B can be applied to the configuration shown in FIG. 56. When the value of the predetermined potential difference serving as the predetermined voltage can be set to be relatively small, an unintended discharge phenomenon (irregular discharge) may be less likely to occur. When relatively small voltage is applied in this way, the potential at the nozzle unit 122 can be set to be lower than the potential at the electrode unit 123, as described with reference to FIG. 56.

When the voltage applied between the nozzle unit 122 and the electrode unit 123 can be set to be relatively small, as shown in FIG. 57B, relatively small positive voltage value V20 may be applied to the electrode unit 123, and relatively small negative voltage-V21 may be applied to the nozzle unit 122.

When the pressure P11 is applied to the target material 200 in a state where a relatively small potential difference (=|V20−(−V21)|) is applied to the target material 200, the droplet 201 may be outputted through the nozzle unit 122.

Figure 58:
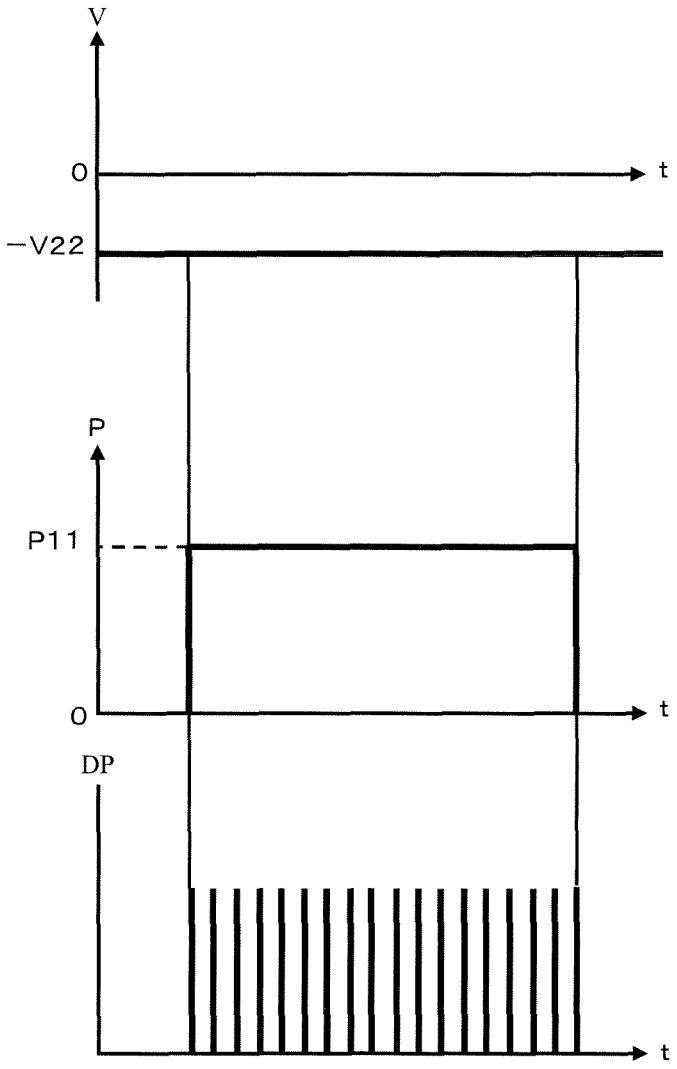
FIG. 58 shows another relationship among voltage, pressure, and a target.

With reference to FIG. 58, the configuration may be such that relatively small negative constant voltage −V22 is applied between the nozzle unit 122 and the electrode unit 123. In this case as well, during the period in which the pressure P11 is applied to the target material 200, the droplet 201 may be outputted through the nozzle unit 122.

Thirtieth Embodiment

Figure 59:
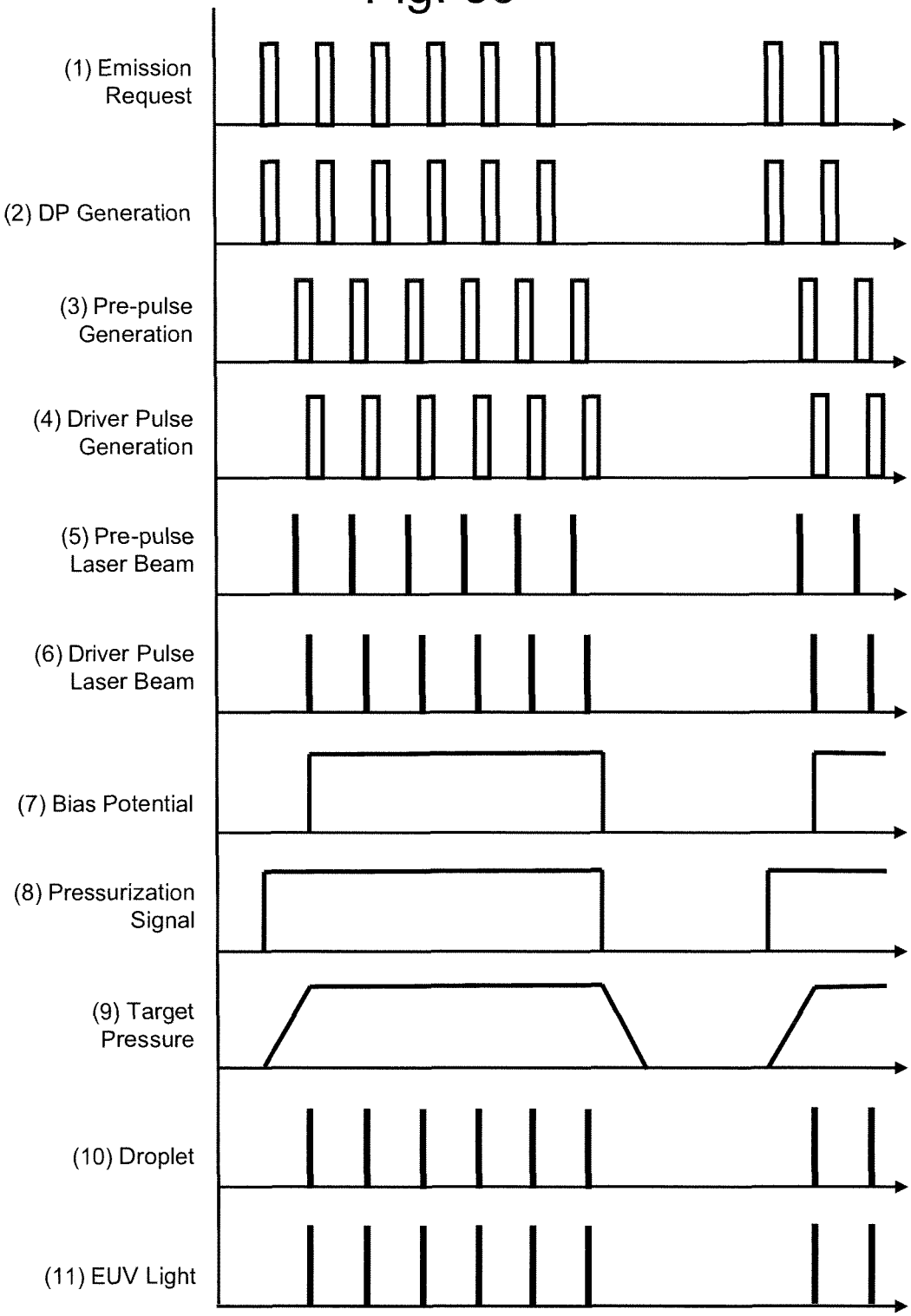
FIG. 59 is a time chart for an EUV light source apparatus according to a thirtieth embodiment.

A thirtieth embodiment will be described with reference to FIG. 59. In this embodiment, an example of an operation time chart of the EUV light source apparatus will be described. In FIG. 59, (1) indicates an EUV light emission request signal from the exposure apparatus 2, and (2) indicates a droplet generation signal inputted from the EUV light source controller 300 to the droplet controller 310.

(3) indicates a pre-pulse laser beam generation signal outputted from the EUV light source controller 300 to the pre-pulse laser source 600, and (4) indicates a driver pulsed laser beam generation signal outputted from the EUV light source controller 300 to the driver pulsed laser source 110.

(5) indicates the pre-pulse laser beam outputted from the pre-pulse laser source 600, and (6) indicates the driver pulsed laser beam outputted from the driver pulsed laser source 110.

(7) indicates a bias application signal outputted from the droplet controller 310 to the DC voltage controller 321. The bias application signal may be a signal for causing bias voltage (predetermined voltage) to be applied between the target material 200 and the electrode unit 123. (8) indicates a pressurization signal outputted from the droplet controller 310 to the pressure controller 331.

(9) indicates the pressure changes on the target material 200 due to the actuation of the pressurization unit 350. (10) indicates generation of droplet(s). (11) indicates emission of the EUV light.

In synchronization with the timing at which the EUV light emission request signal (1) is outputted, the droplet generation signal (2) may be outputted, and in synchronization with the timing at which the droplet generation signal (2) is outputted, the pressurization signal (8) may be outputted. With the pressurization signal, the pressurization unit 350 may be actuated so as to increase the pressure on the target material 200. Considering that a given amount of time may be required for the pressure on the target material 200 to increase, the pressurization signal (8) may be outputted prior to the bias application signal (7).

Calculating the timing at which the pressure on the target material 200 may reach the predetermined pressure, the bias application signal (7) may be outputted so as to cause the predetermined voltage to be applied between the target material 200 and the electrode unit 123.

With this, the electrostatic attraction force due to the predetermined voltage being applied between the target material 200 and the electrode unit 123 and the predetermined pressure may act on the target material 200 simultaneously. Accordingly, a small amount of the target material 200 may be pulled out of the nozzle unit 122 and can be made to be outputted into the chamber 100 as the droplet 201. In substantially synchronization with the timing at which the droplet 201 is generated, the pre-pulse laser beam and the driver laser beam may be outputted, and each of these laser beams may strike the droplet 201. With this, the droplet 201 may be turned into the plasma 202, from which the EUV light may be emitted.

Thirty-First Embodiment

A thirty-first embodiment will be described with reference to FIG. 60. In this embodiment, another time chart of the EUV light source apparatus will be described. (2) through (11) in FIG. 60 are substantially the same as the above-described (2) through (11) in FIG. 59.

Figure 60:
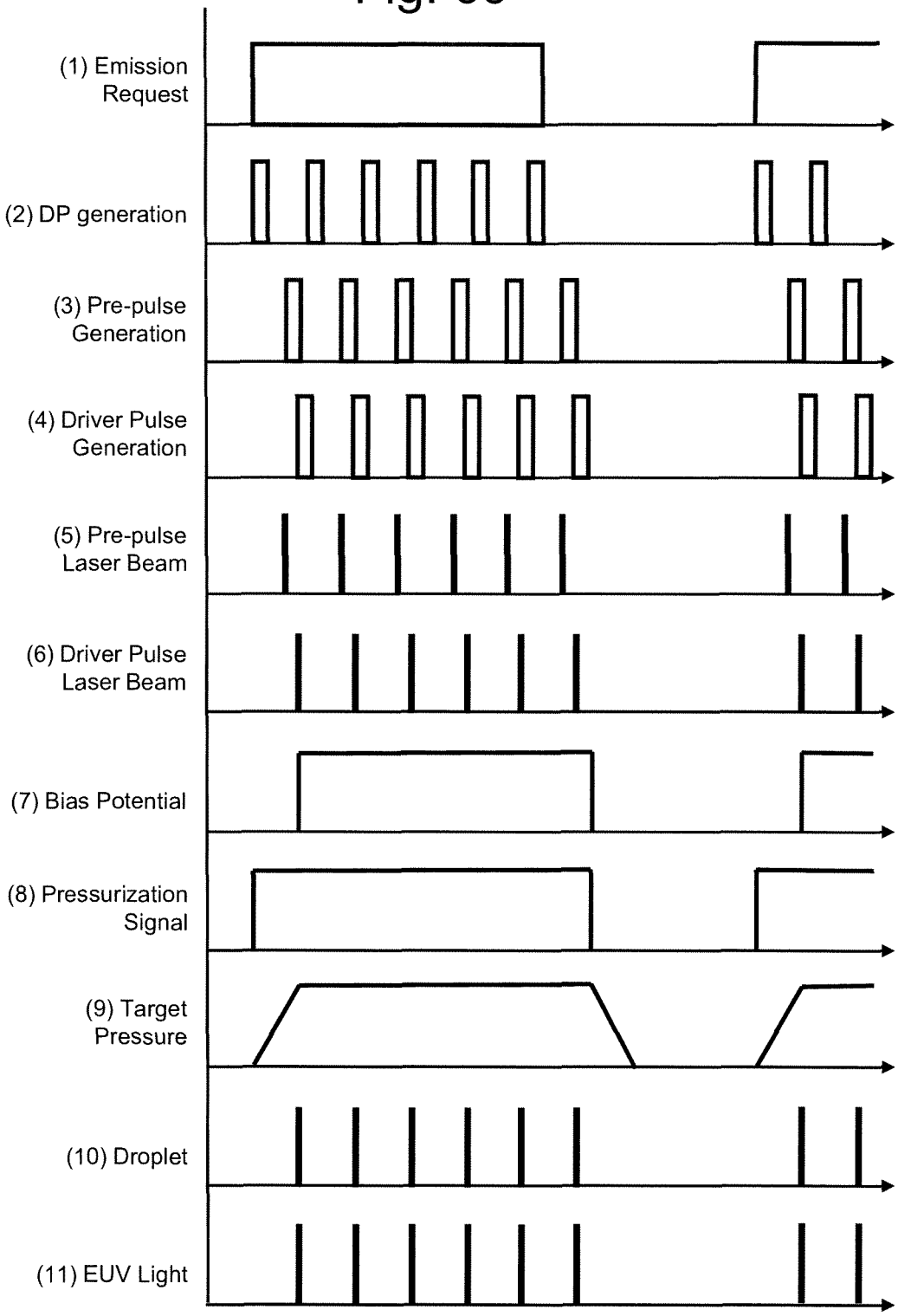
FIG. 60 is a time chart for an EUV light source apparatus according to a thirty-first embodiment.

The time chart in FIG. 60 and the time chart in FIG. 59 may differ in the EUV light emission request signal (1). In the example shown in FIG. 59, the EUV light emission request signal (1) is configured as a pulse train. On the other hand, in this embodiment, the EUV light emission request signal (1) may be configured as a gate signal.

The gate signal may not include information on the EUV light emission intensity, the EUV light emission frequency, the droplet size, the droplet generation frequency, and so forth. In such case, the EUV light emission intensity and the EUV light emission frequency may be inputted to the EUV light source controller 300 as separate signals, or the configuration may be such that the EUV light emission intensity and the EUV light emission frequency are pre-set to the EUV light source controller 300. The EUV light source controller 300 may transmit the values of the droplet size, the droplet generation frequency, and the droplet generation timing to the droplet controller 310.

This disclosure is not limited to the above-described embodiments. Not all combinations of the features described in each embodiment need to be requisite components of this disclosure. One skilled in the art can make various additions, modifications, and the like within the scope of this disclosure. For example, the above-described embodiments and the modifications thereof can be appropriately combined.

In some of the embodiments described above, the configuration may be such that an inert gas is delivered into the main body in order to cause the target material in a molten state to slightly protrude from the nozzle. Instead, the configuration may be such that the target material may be caused to slightly protrude from the tip of the nozzle with the weight of the target material. Alternatively, the configuration may be such that the target material is caused to slightly protrude from the tip of the nozzle in other ways such as with the magnetic force.

The piezoelectric element is cited as an example of an element that deforms in accordance with an input signal, but without being limited thereto, a magnetostrictive element or the like which may deform in accordance with magnetic field fluctuation may be used, for example.

What is claimed is:

1. A target output device for providing a target material to an extreme ultraviolet light source device, the target output device comprising:

a main body for storing a target material;

a nozzle for outputting the target material from the main body;

an electrode disposed to face the nozzle;

a first pulse controller configured to apply a voltage pulse between the main body and the electrode;

a first pressure controller configured to supply a gas into the main body to apply a pressure to the target material;

a second pressure controller arranged at the main body and configured to apply a pressure to the target material by mechanically-transforming based on a voltage pulse applied thereto;

a second pulse controller configured to apply the voltage pulse to the second pressure controller;

a droplet controller configured to output the target material from the nozzle by synchronously operating the first pulse controller and the second pulse controller while pressuring the main body by operating the first pressure controller and a member arranged in a flow channel of the target material from the main body to the nozzle and having an orifice for suppressing dispersion of the pressure to be applied to the target material by the second pressure controller into the main body.

2. The target output device according to claim 1, wherein the nozzle is provided so as to project in a direction in which the target material is outputted, in order to enhance field strength applied to the target material near an output port of the nozzle.

3. The target output device according to claim 1, wherein the first pressure controller supplies an inert gas into the main body to apply a predetermined pressure to the target material.

4. The target output device according to claim 1, wherein the target material is tin or a metal substance containing tin, the main body includes a heating unit for heating the target material to or above a melting point of the target material, and the nozzle maintains the target material inside the nozzle in a molten state by having heat from the heating unit transmitted thereto via the main body.

5. An extreme ultraviolet light source apparatus for generating extreme ultraviolet light by irradiating a target material with a laser beam, the extreme ultraviolet light source apparatus comprising:

a chamber;

a target output device for outputting the target material toward a predetermined region inside the chamber; and a laser configured to irradiate the target material with a laser beam to turn the target material into plasma from which the extreme ultraviolet light is emitted, wherein the target output device includes:

a main body for storing the target material, a nozzle for outputting the target material from the main body, an electrode disposed to face the nozzle, a first pulse controller configured to apply a voltage pulse between the main body and the electrode, a first pressure controller configured to supply a gas into the main body to apply a pressure to the target material, a second pressure controller arranged at the main body and configured to apply a pressure to the target material by mechanically-transforming based on a voltage pulse applied thereto;

a second pulse controller configured to apply the voltage pulse to the second pressure controller, a droplet controller configured to output the target material from the nozzle by synchronously operating the first pulse controller and the second pulse controller while pressuring the main body by operating controller and a member arranged in a flow channel of the target material from the main body to the nozzle and having an orifice for suppressing dispersion of the pressure to be applied to the target material by the second pressure controller into the main body.

6. The extreme ultraviolet light source apparatus according to claim 5, wherein the nozzle is provided so as to project in a direction in which the target material is outputted, in order to enhance field strength applied to the target material near an output port of the nozzle.

7. The extreme ultraviolet light source apparatus according to claim 5, wherein the first pressure controller supplies an inert gas into the main body to apply a predetermined pressure to the target material.

8. The extreme ultraviolet light source apparatus according to claim 5, wherein the target material is tin or a metal substance containing tin, the main body includes a heating unit for heating the target material to or above a melting point of the target material, and the nozzle maintains the target material inside the nozzle in a molten state by having heat from the heating unit transmitted thereto via the main body.

9. The target output device according to claim 1, further comprising an acceleration electrode disposed to face the electrode, the acceleration electrode being grounded.

10. The target output device according to claim 9, further comprising a correction unit disposed to face the acceleration electrode and configured to generate an electric field to correct a trajectory of the target material.

11. The target output device according to claim 1, wherein the pressure controller comprises a pressure adjusting valve, a supply valve, and an exhaust valve for the gas.

12. The target output device according to claim 11, wherein the pressure controller further comprises an exhaust pump.

13. The extreme ultraviolet light source apparatus according to claim 5, further comprising an acceleration electrode disposed to face the electrode, the acceleration electrode being grounded.

14. The extreme ultraviolet light source apparatus according to claim 13, further comprising a correction unit disposed to face the acceleration electrode and configured to generate an electric field to correct a trajectory of the target material.

15. The extreme ultraviolet light source apparatus according to claim 5, wherein the pressure controller comprises a pressure adjusting valve, a supply valve, and an exhaust valve for the gas.

16. The extreme ultraviolet light source apparatus according to claim 15, wherein the pressure controller further comprises an exhaust pump.

17. The target output device according to claim 4, wherein the electrode is made of a material including at least one of molybdenum, tungsten, tantalum, titanium and stainless.

18. The target output device according to claim 1, wherein the voltage pulse is one of a rectangular wave, a triangular wave and a sine wave.

19. The target output device according to claim 1, wherein the voltage pulse oscillates across the ground potential.

20. The target output device according to claim 1, wherein the second voltage controller includes a piezoelectric element.

21. The extreme ultraviolet light source apparatus according to claim 5, wherein the laser includes a prepulse laser for diffusing the target material and a driver laser for turning the diffused target material into the plasma.

* * * * *